US007476494B2

(12) United States Patent
Hosokawa et al.

(10) Patent No.: US 7,476,494 B2
(45) Date of Patent: Jan. 13, 2009

(54) SILVER HALIDE PHOTOSENSITIVE MATERIAL AND IMAGE-FORMING METHOD USING THE SAME

(75) Inventors: Junichiro Hosokawa, Minamiashigara (JP); Koichi Yokota, Minamiashigara (JP); Masaaki Miki, Minamiashigara (JP); Yoichi Hosoya, Minamiashigara (JP); Ryoji Nishimura, Minamiashigara (JP)

(73) Assignee: Fujifilm Corporation, Tokyo (JP)

( * ) Notice: Subject to any disclaimer, the term of this patent is extended or adjusted under 35 U.S.C. 154(b) by 0 days.

(21) Appl. No.: 11/878,889

(22) Filed: Jul. 27, 2007

(65) Prior Publication Data

US 2008/0026333 A1 Jan. 31, 2008

(30) Foreign Application Priority Data

Jul. 27, 2006 (JP) ..... 2006-205183
Mar. 30, 2007 (JP) ..... 2007-092626

(51) Int. Cl.

| | |
|---|---|
| ***G03C 1/46*** | (2006.01) |
| ***G03C 1/08*** | (2006.01) |
| ***G03C 7/26*** | (2006.01) |
| ***G03C 7/32*** | (2006.01) |
| ***G03C 7/46*** | (2006.01) |

(52) U.S. Cl. ..... 430/502; 430/503; 430/504; 430/505; 430/506; 430/567; 430/558; 430/555; 430/374; 430/387

(58) Field of Classification Search ..... 430/502–506, 430/567, 558, 555, 374, 387
See application file for complete search history.

(56) References Cited

U.S. PATENT DOCUMENTS 5,360,704 A * 11/1994 Brennecke ..... 430/506

* cited by examiner

*Primary Examiner*—Geraldina Visconti
(74) *Attorney, Agent, or Firm*—Birch, Stewart, Kolasch & Birch, LLP

(57) ABSTRACT

A silver halide photosensitive material having at least one blue-sensitive layer, at least one green-sensitive layer, and at least one red-sensitive layer, on a transparent support, wherein at least one of the green-sensitive layers contains a coupler represented by general formula (I) or general formula (Z), and all of the green-sensitive layers contain silver halide emulsion having an average equivalent-spherical diameter of 0.35 μm or less:

General formula (I)

General formula (Z)

9 Claims, 1 Drawing Sheet

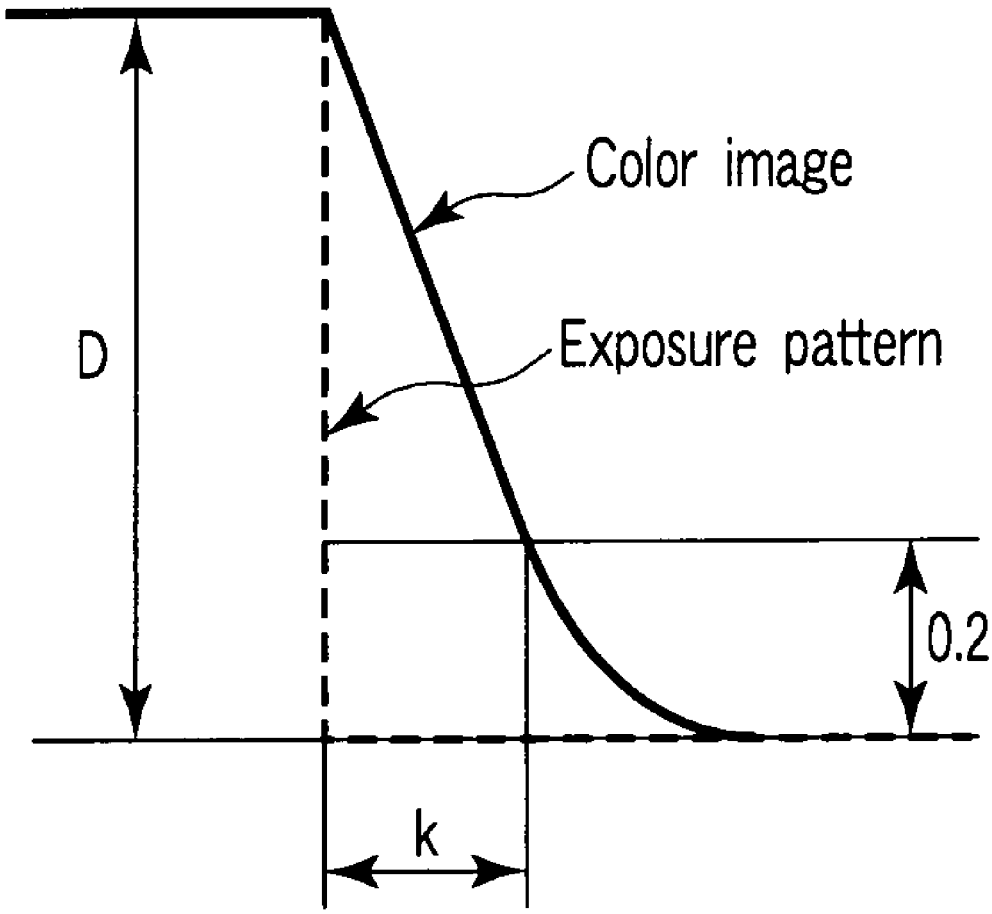
FIGURE

SILVER HALIDE PHOTOSENSITIVE MATERIAL AND IMAGE-FORMING METHOD USING THE SAME

CROSS-REFERENCE TO RELATED APPLICATIONS

This application is based upon and claims the benefit of priority from prior Japanese Patent Applications No. 2006-205183, filed Jul. 27, 2006; and No. 2007-092626, filed Mar. 30, 2007, the entire contents of both of which are incorporated herein by reference.

BACKGROUND OF THE INVENTION

1. Field of the Invention

The present invention relates to an image-forming method using a silver halide photosensitive material, and more specifically to an image-forming method for recording digital information on a silver halide photosensitive material with little deterioration. Further specifically, the present invention relates to a silver halide photosensitive material realizing the image-forming method and excellent in storability.

2. Description of the Related Art

The production of cinema has conventionally applied a method of using image information pictured using a negative film for photographing, as the image of an original plate, preparing copy by printing it in an intermediate film and further printing this copy in a positive film for cinema to be provided for projection.

In many cases, the intermediate film for preparation of a copy is used twice. The negative film of an original plate is printed on a negative type intermediate film for preparing a master positive. Then, the master positive is printed again on the intermediate film for preparing a duplicate negative. The duplicate negative is finally printed on a cinema positive film for preparing a print for screening.

In the production of cinema, there has recently prevailed rapidly a method of carrying out the digital synthesis and editing of the original plate image and converting it into an analogue image on a film again by a film recorder. This is carried out because image impossible in reality is prepared by synthesis and editing by a computer and the freedom of image representation can be expanded. As the original plate image, there can be used various images such as image information obtained by digitizing image information photographed in a negative film for photographing by a film scanner, image information photographed by an HD video camera and image information obtained by computer graphics and the like.

As the pixel count of the original plate image, for example, when a negative film for photographing is digitized with a film scanner to prepare the image information of 2048×1556, the pixel count is 3.18 million pixels.

When the image original plate is conveniently prepared as digital information as described above and this is put on the screen by conventional analog screening, there is applied a process of printing the original plate prepared as digital information on an intermediate film and printing this on a positive film for cinema as in a conventional process.

However, when the method is applied, a new problem is generated in accordance with the high resolution of digital information. When an original image is printed on a silver halide photosensitive material, there has been a problem that the deterioration of image quality occurs and adequate image quality for screening is not maintained. There has been required reduction of the deterioration of image quality performance such as the generation of blotting, the deterioration of sharpness and the lowering of color reproducibility that originate in the photographic properties of an analog silver halide photosensitive material. Jpn. Pat. Appln. KOKAI Publication No.(hereinafter referred to as JP-A-)10-20461 discloses a silver halide color photosensitive material characterized in that the value N of a magenta image by laser scanning exposure is 100 μm to 200 μm. The value N is quantity corresponding to the blotting of an image and it is disclosed that the blotting of characters is lessened in recording on a color paper. However, the size of a pixel is 12 μm or less in the resolution of 2000 dpi or more that has been recently used in the field of cinema production and the above-mentioned value N is clearly not suitable for resolving fine image information. Consequently, there has been intensively desired a method of recording digital information with little deterioration on a silver halide photosensitive material.

Further, a problem at the time of recording digital image information on a photosensitive material using a film recorder was also newly generated. When the digital image information is usually recorded using the film recorder, 10 hours or more are often required from the start of recording to the end thereof. In this case, a problem was the fluctuation of photographic performance with the lapse of time until development processing after exposure of the film, so-called storability of a latent image. Difference in the lapse of time until development processing after exposure of the film is generated between the initial portion and the final portion of the recording information. Therefore, a problem that the color of an image is deviated was generated. Consequently, a photosensitive material having little fluctuation in the storability of a latent image has been desired intensively.

BRIEF SUMMARY OF THE INVENTION

It is an object of the invention to provide a method capable of recording digital image information on a silver halide photosensitive material at high resolution and with little deterioration. Further, it is to provide a silver halide photosensitive material capable of realizing the image-forming method with little deterioration and excellent in the storability of a latent image.

Herein, the recording with little deterioration in the invention means that the fading at the time of recording an image structure included in digital image information is suppressed to a low level and further, the fluctuation of color information at the time of recording is suppressed to a low level.

As a result of intensive studies for achieving the above-mentioned object, it has been found that a photosensitive material with little blotting and the little deterioration of color reproducibility is obtained by using a silver halide emulsion of the invention having an average spherical equivalent diameter of 0.35 μm or less together with a coupler expressed by the general formula (I) or the general formula (Z).

An image obtained is superior in granularity by using the silver halide emulsion with a small size of 0.35 μm or less of the invention, and the blotting of the image can be suppressed to the maximum extent by suppressing the scattering of light as much as possible. Further, unfavorable interaction between the silver halide and coupler is reduced by using the coupler of the general formula (I) or the general formula (Z) of the invention and, as a result, the influence of photographic fluctuation at the time of processing is barely exerted and the color muddiness of hue is small. Therefore, it is deduced that more preferable color reproducibility can be realized.

Further, it has been also found that, when the coupler of the general formula (I) or the general formula (Z) of the invention is used, it has an unexpected result that the above-mentioned storability of a latent image can be preferably improved.

Namely, in the process of carrying out the intensive studies using emulsion with a small size of 0.35 μm or less in order to attain the photosensitive material preferable in blotting and color reproducibility, it has been found that, when emulsion with the above-mentioned size is used, the regression of a latent image in a very short time occurs remarkably in particular in combination use with a conventional coupler. Furthermore, it has been found that the performance is remarkably improved by using the coupler of the general formula (I) or the general formula (Z) of the invention in combination. Although the details of the mechanism are not clear, it has been deduced that the coupler of the invention having little interaction with silver halide suppressed adverse influence on the storability of the latent image in a short period to the maximum extent.

Consequently, the object of the invention can be attained by the following. Namely, (1) A silver halide photosensitive material having at least one blue-sensitive layer, at least one green-sensitive layer, and at least one red-sensitive layer, on a transparent support, wherein at least one of the green-sensitive layers contains a coupler represented by general formula (I) or general formula (Z), and all of the green-sensitive layers contain silver halide emulsion having an average equivalent spherical diameter of 0.35 μm or less:

General formula (I)

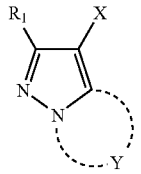

wherein $R_1$ represents a hydrogen atom or a substituent; Y represents a nonmetal atom group containing 1 or 2 nitrogen atoms and necessary for forming a 5-membered azole ring containing 2 or 3 nitrogen atoms, and the azole ring may optionally have a substituent (including a condensed ring); X represents a hydrogen atom or a group capable of being eliminated at the time of coupling reaction with an oxidant of a developing agent;

General formula (Z)

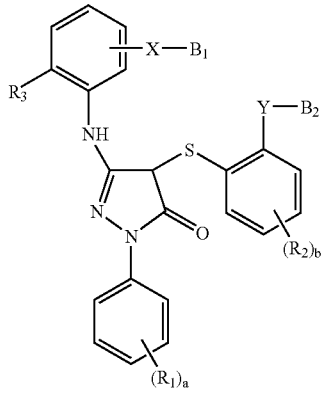

wherein a represents an integer of 0 to 3; b represents an integer of 0 to 2; each of $R_1$ and $R_2$ is independently hydrogen, an alkyl group, an alkoxy group, a halogen group, an aryl group, an aryloxy group, an acylamino group, a sulfonamide group, a sulfamoyl group, a carbamoyl group, an arylsulfonyl group, an aryloxycarbonyl group, an alkoxycarbonyl group, an alkoxysulfonyl group, an aryloxysulfonyl group, an alkylureido group, an arylureido group, a nitro group, a cyano group, a hydroxyl group or a carboxyl group; $R_3$ is a halogen atom, an alkyl group or an aryl group; X and Y are a direct bond or a bonding group; and $B_1$ and $B_2$ are a stabilizing group that does not diffuse the coupler.

(2) The silver halide photosensitive material according to item (1), wherein digital image information can be recorded with little deterioration at the time of image formation in which the digital image information is recorded at a resolution of 2000 dpi or more.

(3) The silver halide photosensitive material according to item (1), wherein digital image information with 3 million or more pixels can be recorded with little deterioration.

(4) The silver halide photosensitive material according to any one of items (1) to (3), wherein blotting k of the image at the time of image recording satisfies formula (A):

$$k \leqq 4.5\ \mu m \times (D-0.2)^2 \quad (A)$$

in formula (A);

D: Color density of the silver halide photosensitive material,

Blotting k: blotting (μm) at color density D.

(5) The silver halide photosensitive material according to any one of items (1) to (4), wherein color purity rate is 80% or more in the color reproduction at the time of image recording.

(6) An image-forming method, wherein digital image information recorded in the silver halide photosensitive material according to any one of items (1) to (5) is further recorded on the silver halide photosensitive material by an analog system.

BRIEF DESCRIPTION OF THE SEVERAL VIEWS OF THE DRAWING

The single FIGURE is a schematic diagram for explaining blotting k in the invention.

DETAILED DESCRIPTION OF THE INVENTION

The invention will be described in more detail.

The digital image information of the invention will be described. The digital image information of the invention means, for example, image information obtained by digitizing image information photographed in a negative film for photographing by a film scanner, image information photographed by an HD video camera, and image information obtained by computer graphics and the like.

Then, the pixel count of the invention will be described. The pixel count of the invention means the total number of pixels contained in the above-mentioned digital image information in the invention used at the time of recording on the silver halide photosensitive material. For example, when a negative film for photographing is digitized with a film scanner to prepare the image information of 2048×1556, the pixel count is 3.19 million pixels.

(Method of Evaluating Blotting)

In the invention, it is preferable that blotting k at the time of image recording satisfies the below-mentioned formula (A).

$$k \leqq 4.5\ \mu m \times (D-0.2)^2 \quad (A)$$

In the formula (I);

D: Color density of the silver halide photosensitive material.

Blotting k: blotting (μm) at color density D.

Herein, it is necessary that the formula (A) is satisfied for all exposure light sources used at the time of image recording. For example, when exposure light sources use 3 color light sources of red, green and blue, the exposure of each single light is carried out and the color density D and the blotting k at that time satisfy the formula (A).

Further, although it is preferable that the formula (A) is satisfied for all zones from Dmin+0.2 to Dmax, it is necessary that evaluation is carried out in at least 2 points of the color densities of Dmin and Dmin+2 and the formula (A) is satisfied at both the densities. Herein, Dmin represents the minimum value of the color density in a photosensitive material and corresponds to density after processing of an unexposed film. Dmax represents the maximum value of the color density in a photosensitive material. The maximum value of the color density corresponds to the maximum value of the density of digital image information. In the case of Cineon form widely used, the maximum density is a value between Dmin+2 to Dmin+2.2.

The blotting k is obtained by measuring the out-of-focus width of a color image at a density of Dmin+2 in a plane direction of the photosensitive material when exposure quantity is adjusted so that the photosensitive material develops color at the density of D and stepwise exposure is carried out as shown in FIG. 1.

In the invention, it is preferable for recording with little deterioration that the blotting k at the time of image recording satisfies the above-mentioned formula (A), but it is more preferable to satisfy the below-mentioned formula (A-2) and it is most preferable to satisfy the below-mentioned formula (A-3).

$$k \leqq 4.0\ \mu m \times (D-0.2)^2 \quad \text{(A-2)}$$

$$k \leqq 3.5\ \mu m \times (D-0.2)^2 \quad \text{(A-3)}$$

(Method of Evaluating Color Purity Rate)

In the invention, the color purity rate is represented by the below-mentioned formula (B) when symmetrical exposure is carried out by each single color of red, green and blue, and image density obtained for the main color density in the single color exposure is referred to as "a", and the color density of coloring different from the main color density existing in mixture in color at the density and color with high density is referred to as "b".

$$\text{Color purity rate } (\%) = (a-b)/a \times 100 \quad \text{(B)}$$

It is necessary that the color purity rate represented by the formula (B) is 80% or more for all zones of the above-mentioned main color density from Dmin+0.1 to Dmax, and it is also necessary that the above condition is satisfied for all cases of the single color exposure of each of red, green and blue. Dmin represents the lowest value of the color density in a photosensitive material and corresponds to density after processing of an unexposed film. Dmax represents the maximum value of the color density in a photosensitive material. The maximum value of the color density corresponds to the maximum value of the density of digital image information. In the case of Cineon form widely used, the maximum density is a value between Dmin+2 to Dmin+2.2.

In the invention, it is preferable for recording with little deterioration that the color purity rate is 80% or more, but 85% or more is more preferable and 90% or more is further preferable.

Devices that can be used for the method of the invention and can record digital image information on a silver halide photosensitive material are not particularly limited to film recorders, and therefore commercially available devices may also be used.

For example, commercially available devices include ARRILASER and ARRILASER HD manufactured by ARRI Group and using BGR laser as a light source system, FURY and FIRESTORM manufactured by CELCO Inc. and using a CRT system, IMAGICA realtime and an HSR high-speed recorder manufactured by IMAGICA Corporation and using an LCOS system, Cinevator One and Cinevator Five manufactured by CINEVATION AS, etc.

It has been found as a result of extensive studies that the use of a silver halide photosensitive material designed so as to lessen image deterioration at the time of recording is remarkably effective for attaining the invention. The main cause of generating the blotting of an image is scattering of recording light in the inside of the photosensitive material and the blotting of the image can be remarkably improved by reducing the scattered light. Since light scattering is greatly subjected to the influence of silver halide fine particles in a photosensitive material, it is effective that the use amount of the silver halide fine particles is as little as possible. It is also effective that the size of the silver halide fine particles is reduced. Since these procedures induce the sensitivity lowering of the photosensitive material, it is preferable that the sensitivity of the silver halide fine particles is enhanced. Further, it has been known that a dye can be preferably used for absorbing scattered light. The dye includes a water-soluble type and an oil-soluble type. The water-soluble dye has been widely used for a conventional photosensitive material, but it has been found as a result of study that remarkable result is obtained by using the oil-soluble dye. For example, when an oil-soluble cyanine dye absorbing red light is used, it is effective to use it on an upper layer that is as near as possible to the red sensitive layer. The reason is deduced that the influence of scattered light is minimized by removing red light scattered in a photosensitive material just before it reaches the red sensitive layer. Further, it is effective to prevent color mixing in order to enhance the color purity. When the use amount of an anti-color mixing agent used for an intermediary layer situated between respective color sensitive layers is insufficient, processing color mixing is generated, but when the amount is too much, the sensitivity of the photosensitive material is lowered. Therefore, it is effective to set it at an optimum value. Further, it is also important to reduce spectral color mixing caused by exposing a color sensitive layer different from exposure light color. For example, the spectral color mixing can be reduced by enlarging the difference between red sensitivity of the red sensitive layer and each of green sensitivity and blue sensitivity. In order to do so, it is extremely effective to let the red light at the time of recording coincide with the wavelength of red sensitivity of the photosensitive material.

Then, the coupler represented by the general formula (I) that is used for the invention will be specifically described.

General formula (I)

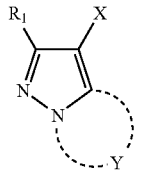

Where $R_1$ represents a hydrogen atom or a substituent. Y represents a nonmetal atom group necessary for forming a 5-membered azole ring containing 2 to 3 nitrogen atoms, and the azole ring may optionally have a substituent (including a condensed ring). X represents a hydrogen atom or a group capable of being eliminated at the time of coupling reaction with an oxidant of a developing agent.

Preferable examples of the coupler skeleton represented by the general formula (I) that is used for the invention are 1H-imidazo[1,2-b]pyrazole, 1H-pyrazolo[1,5-b][1,2,4]triazole and 1H-pyrazolo[5,1-c][1,2,4]triazole. They are respectively represented by the formulae [M-I], [M-II] and [M-III].

[M-I]

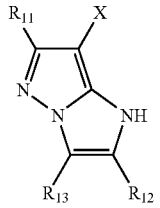

[M-II]

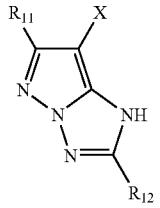

[M-III]

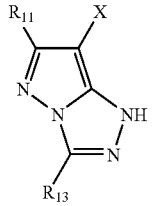

$R_{11}$, $R_{12}$, $R_{13}$ and X in the formulae [M-I], [M-II] and [M-III] will be described in detail.

$R_{11}$ represents a hydrogen atom, a halogen group, an alkyl group, an aryl group, a heterocyclic group, a cyano group, a hydroxy group, a nitro group, a carboxy group, an amino group, an alkoxy group, an aryloxy group, an acylamino group, an alkylamino group, an anilino group, a ureido group, a sulfamoylamino group, an alkylthio group, an arylthio group, an alkoxycarbonylamino group, a sulfonamide group, a carbamoyl group, a sulfamoyl group, a sulfonyl group, an alkoxycarbonyl group, a heterocyclic oxy group, an azo group, an acyloxy group, a carbamoyloxy group, a silyloxy group, an aryloxycarbonylamino group, an imide group, a heterocyclic thio group, a sulfinyl group, a phosphonyl group, an aryloxycarbonyl group, an acyl group or azolyl group. $R_{11}$ may form a bis structure with a divalent group.

More specifically, $R_{11}$ represents a hydrogen atom, halogen groups (e.g., a chlorine atom and a bromine atom), alkyl groups (each being a linear, branched or cyclic alkyl group, and including an alkyl group, an aralkyl group, an alkenyl group, an alkynyl group, a cycloalkyl group and a cycloalkenyl group, having 1 to 32 carbon atoms, such as methyl, ethyl, n-propyl, isopropyl, t-butyl, tridecyl, 2-methanesulfonylethyl, 3-(3-pentadecylphenoxy)propyl, 3-{4-{2-[4-(4-hydroxyphenylsulfonyl)phenoxy] dodecaneamide}phenyl}propyl, 2-ethoxytridecyl, trifluoromethyl, cyclopentyl or 3-(2,4-di-t-amylphenoxy) propyl]), aryl groups (e.g., a phenyl, 4-t-butylphenyl, 2,4-di-t-amylphenyl and 4-tetradecaneamidephenyl), heterocyclic groups (e.g., 2-furyl, 2-thienyl, 2-pyrimidinyl and 2-benzothiazolyl), a cyano group, a hydroxy group, a nitro group, a carboxy group, an amino group, alkoxy groups (e.g., methoxy, ethoxy, 2-methoxyethoxy, 2-dodecylethoxy and 2-methanesulfonylethoxy), aryloxy groups (e.g., phenoxy, 2-methylphenoxy, 4-t-butylphenoxy, 3-nitrophenoxy, 3-t-butyloxycarbamoylphenoxy and 3-methoxycarbamoyl), acylamino groups (e.g., acetamido, benzamide, tetradecaneamide, 2-(2,4-di-t-amylphenoxy) butanamide, 4-(3-t-butyl-4-hydroxyphenoxy) butanamide, and 2-{4-(4-hydroxyphenylsulfonyl)phenoxy}decaneamide), alkylamino groups (e.g., methylamino, butylamino, dodecylamino, diethylamino and methylbutylamino), anilino group (e.g., phenylamino, 2-chloroanilino, 2-chloro-5-tetradecaneaminoanilino, 2-chloro-5-dodecyloxycarbonylanilino, N-acetylanilino and 2-chloro-5-{α-(3-t-butyl-4-hydroxyphenoxy) dodecaneamide}anilino), ureido groups (e.g., phenylureido, methylureido and N,N-dibuthylureido), sulfamoylamino groups (e.g., N,N-dipropylsulfamoylamino, and N-methyl-N-decylsulfamoylamino), alkylthio groups (e.g., methylthio, octylthio, tetradecylthio, 2-phenoxyethylthio, 3-phenoxypropylthio and 3-(4-t-butylphenoxy)propylthio), arylthio groups (e.g., phenylthio, 2-butoxy-5-t-octylphenylthio, 3-pentadecylphenylthio, 2-carboxyphenylthio and 4-tetradecaneamidephenylthio), alkoxycarbonylamino groups (e.g., methoxycarbonylamino and tetradecyloxycarbonylamino), sulfonamide groups (e.g., methanesulfonamide, hexadecanesulfonamide, benzenesulfonamide, p-toluenesulfonamide, octadecanesulfonamide and 2-methyloxy-5-t-butylbenzenesulfonamide), carbamoyl groups (e.g., N-ethylcarbamoyl, N,N-dibutylcarbamoyl, N-(2-dodecyloxyethyl)carbamoyl, N-methyl-N-dodecyl-carbamoyl and N-{3-(2,4-di-t-amylphenoxy)propyl}carbamoyl), sulfamoyl groups (e.g., N-ethylsulfamoyl, N,N-dipropylsulfamoyl, N-(2-dodecyloxyethyl)sulfamoyl, N-ethyl-N-dodecylsulfamoyl and N,N-diethylsulfamoyl), sulfonyl groups (e.g., methanesulfonyl, octanesulfonyl, benzenesulfonyl and toluenesulfonyl), alkoxycarbonyl groups (e.g., methoxycarbonyl, butyloxycarbonyl, dodecyloxycarbonyl and octadecylcarbonyl), heterocyclic oxy groups (e.g., 1-phenyltetrazole-5-oxy and 2-tetrahydropyranyloxy), azo groups (e.g., phenylazo, 4-methoxyphenylazo, 4-pivaloylaminophenylazo and 2-hydroxy-4-propanoylphenylazo), acyloxy groups (e.g., acetone), carbamoyloxy groups (e.g., N-methylcarbamoyloxy and N-phenylcarbamoyloxy), silyloxy groups (e.g., trimethylsilyloxy and dibutylmethylsilyloxy), aryloxycarbonylamino groups (e.g., phenoxycarbonylamino), imide groups (e.g., N-succinimide, N-phthalimide and 3-octadecenylsuccinimide), heterocyclic thio groups (e.g., 2-benzothiazolylthio, 2,4-di-phenoxy-1,3,5-triazole-6-thio and 2-pyridyl), sulfinyl group (e.g., dodecanesulfinyl, 3-pentadecylphenylsulfinyl and 3-phenoxypropylsulfinyl), phosphonyl groups (e.g., phenoxyphosphonyl, octylphosphonyl and phenylphosphonyl), aryloxycarbonyl groups (e.g., phenyxycarbonyl), acyl groups (e.g., acetyl, 3-phenylpropanoyl, benzoyl and 4-dodecyloxybenzoyl) or azolyl group (e.g., imidazolyl, pyrazolyl, 3-chloro-pyrazol-1-yl and triazolyl). Among these substituents, a group capable of further having a substituent may further have an organic substituent coupled with a carbon atom, an oxygen atom, a nitrogen atom or a sulfur atom, or a halogen atom.

Among these substituents, preferable $R_{11}$ includes an alkyl group, an aryl group, an alkoxy group, an aryloxy group, an alkylthio group, a ureido group, a urethane group and an acylamino group.

$R_{12}$ is a group similar to the substituent exemplified for $R_{11}$ and preferably a hydrogen atom, an alkyl group, an aryl group, a heterocyclic group, an alkoxycarbonyl group, a carbamoyl group, a sulfamoyl group, a sulfinyl group, an acyl group and a cyano group.

Further, $R_{12}$ is a group similar to the substituent exemplified for $R_{11}$ and preferably a hydrogen atom, an alkyl group, an aryl group, a heterocyclic group, an alkoxy group, an aryloxy group, an alkylthio group, an arylthio group, an alkoxycarbonyl group, a carbamoyl group and an acyl group, and more preferably an alkyl group, an aryl group, a heterocyclic group, an alkylthio group and an arylthio group.

X represents a hydrogen atom or a group capable of being eliminated at reaction with an oxidant of an aromatic primary amine developing agent. Specific examples of the group capable of being eliminated include a halogen atom, an alkoxy group, an aryloxy group, an acyloxy group, an alkyl or arylsulfonyloxy group, an acylamino group, an alkyl or arylsulfonamide group, an alkoxycarbonyloxy group, an aryloxycarbonyloxy group, an alkyl, aryl or hetero ring thio group, a carbamoylamino group, a 5-membered or 6-membered nitrogen-containing heterocyclic group, an imido group, and an arylazo group, and these groups may be further substituted with a group that is approved as the substituent of $R_{11}$.

More specifically, X represents halogen atoms (e.g., a fluorine atom, a chlorine atom and a bromine atom), alkoxy groups (e.g., ethoxy, dodecyloxy, methoxyethylcarbamoylethoxy, carboxypropyloxy, methylsulphonylethoxy and ethoxycarbonylmethoxy) aryloxy groups (e.g., 4-methylphenoxy, 4-chlorophenoxy, 4-methoxyphenoxy, 4-carboxyphenoxy, 3-ethoxycarboxyphenoxy, 3-acetylaminophenoxy and 2-carboxyphenoxy), acyloxy groups (e.g., acetoxy, tetradecanoyloxy and benzoyloxy), alkyl- or aryl-sulfonyloxy groups (e.g., methanesulfonyloxy and toluenesulfonyloxy), acylamino groups (e.g., dichloroacetylamino and heptafluorobutylylamino), alkyl- or aryl-sulfonamide groups (e.g., methanesulfonamino, trifluoromethanesulfonamino and p-toluenesulfonylamino), alkoxycarbonyloxy groups (e.g., ethoxycarbonyloxy and benzyloxycarbonyloxy), aryloxycarbonyloxy groups (e.g., phenoxycarbonyloxy), alkyl-, aryl- or hetero ring-thio groups (e.g., dodecylthio, 1-carboxydodecylthio, phenylthio, 2-butoxy-5-t-octylphenylthio and tetrazolylthio), carbamoylamino groups (e.g., N-methylcarbamoylamino and N-phenylcarbamoylamino), 5-membered or 6-membered nitrogen-containing heterocyclic groups(e.g., imidazolyl, pyrazolyl, triazolyl, tetrazolyl and 1,2-dihydro-2-oxo-1-pyridyl), imido group(e.g., succinimide and hydantoinyl), and arylazo groups (e.g., phenylazo and 4-methoxyphenylazo).

X may additionally assume occasionally a bis-coupler type obtained by condensing a 4-equivalent coupler with aldehydes or ketones as an eliminating group that is bonded through a carbon atom. Further, X may include a photographically effective group such as a development-suppressing agent or a development-accelerating agent. Preferable X is a halogen atom, an alkoxy group, an aryloxy group, an alkyl or arylthio group and a 5-membered or 6-membered nitrogen-containing hetero ring group that is bonded with a nitrogen atom at a coupling active position.

The following are examples of a magenta coupler represented by general formula (I). However, the present invention is not limited to these examples.

[M-1]

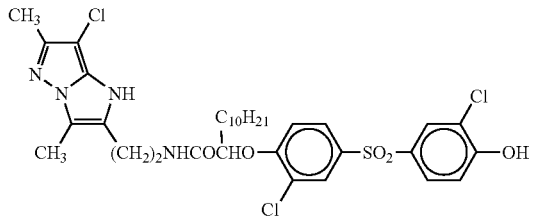

[M-2]

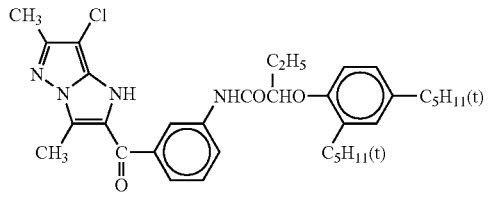

[M-3]

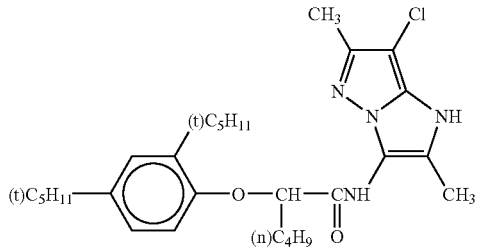

[M-4]

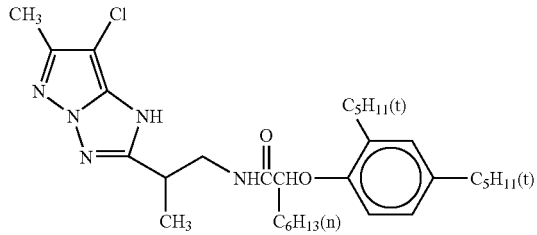

-continued
[M-5]
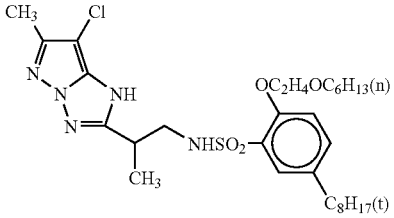
[M-6]
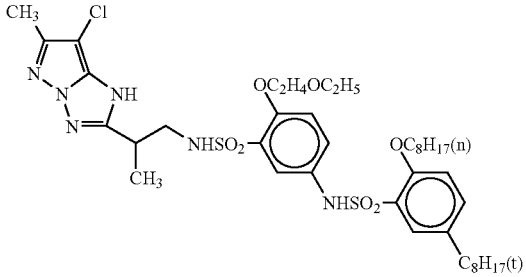
[M-7]
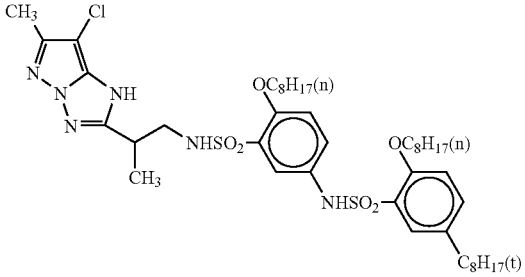
[M-8]
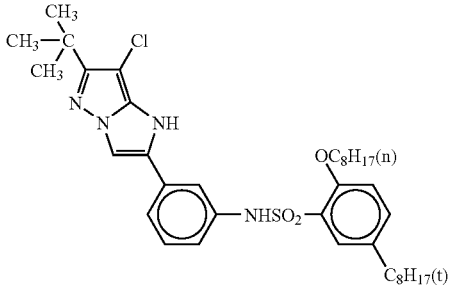
[M-9]
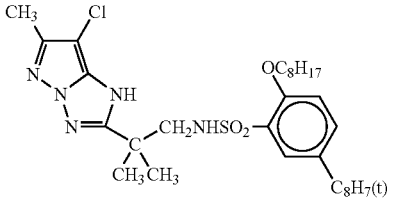
[M-10]
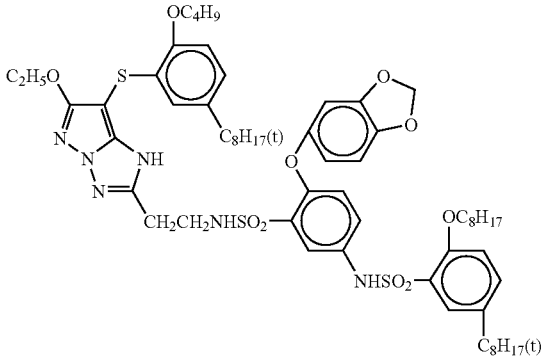
[M-11]
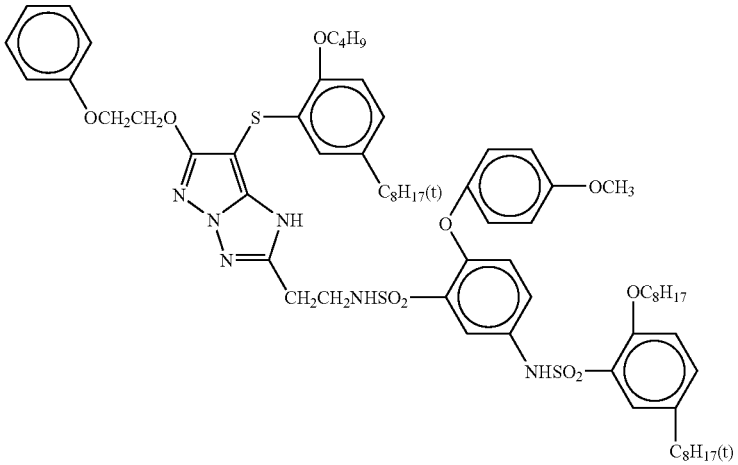

-continued
[M-12]
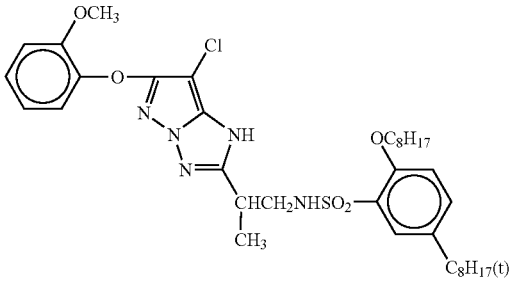
[M-13]
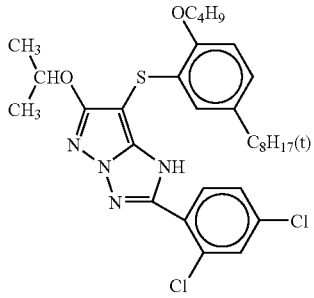
[M-14]
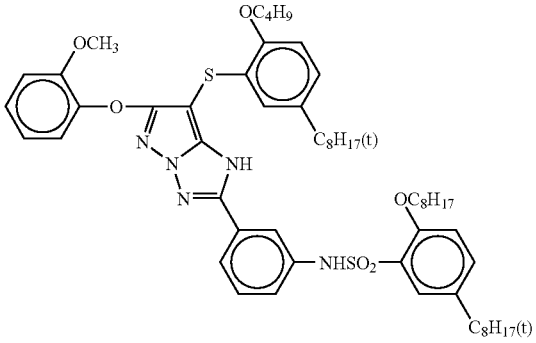
[M-15]
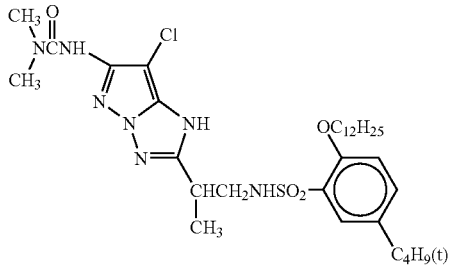
[M-16]
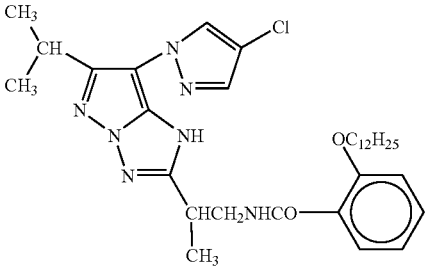
[M-17]
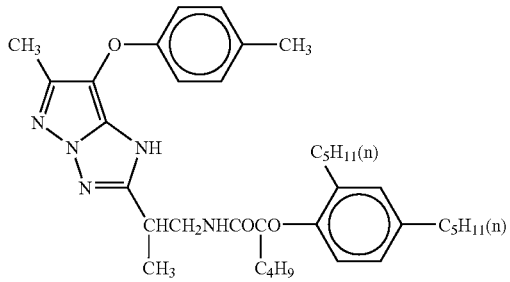
[M-18]
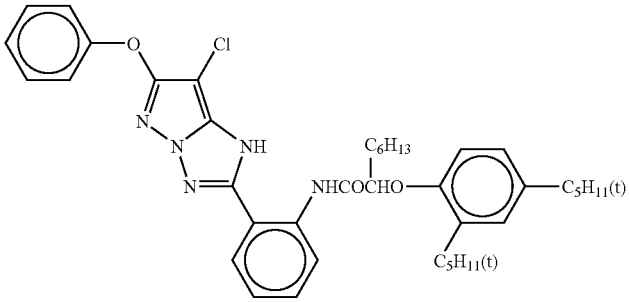
[M-19]
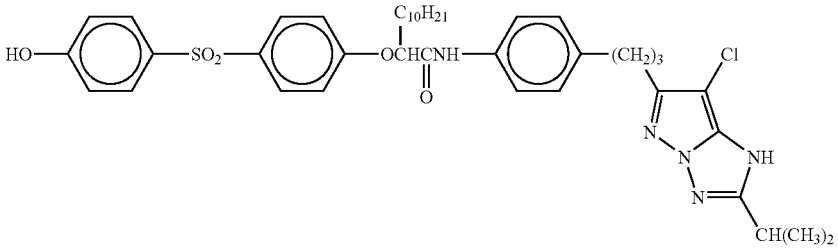

-continued
[M-20]
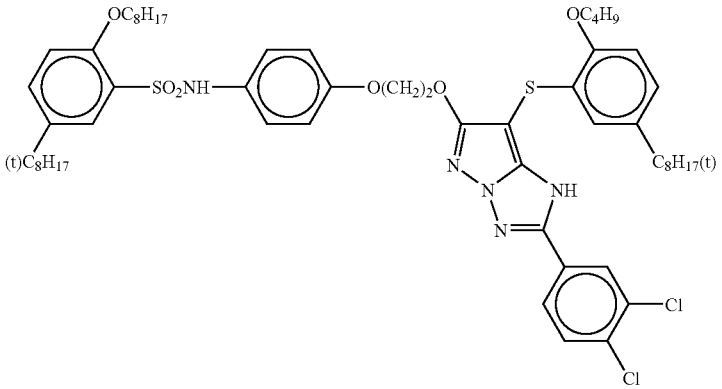
[M-21]
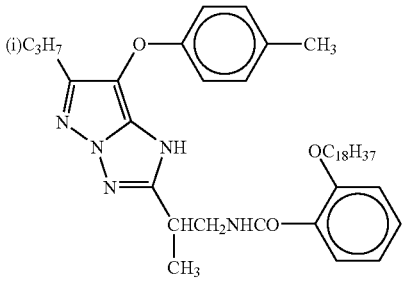
[M-22]
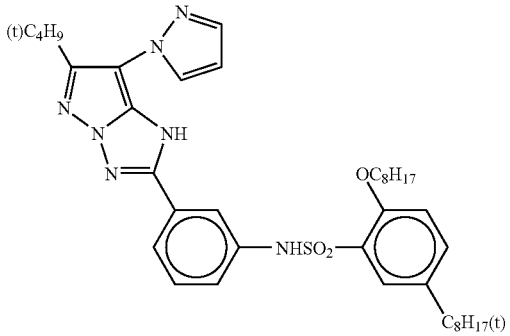
[M-23]
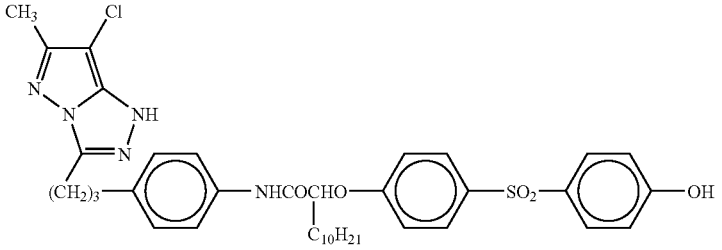
[M-24]
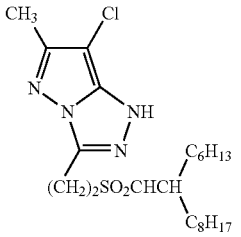
[M-25]
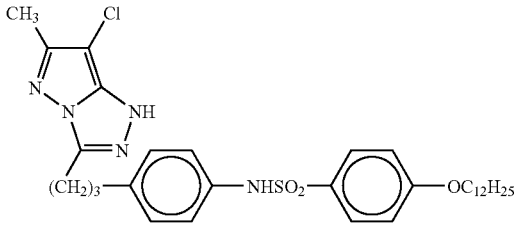
[M-26]
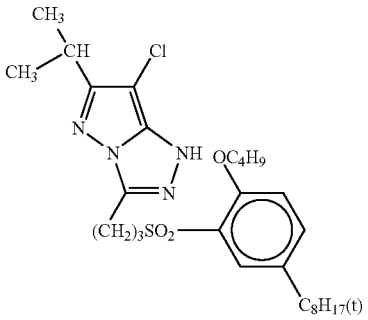
[M-27]
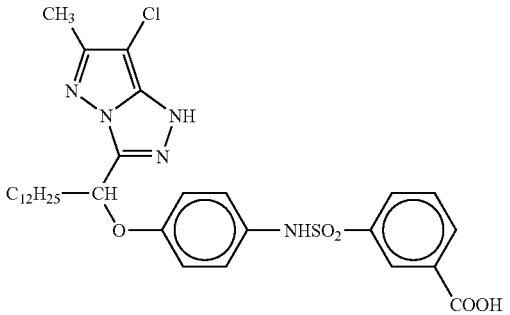

-continued
[M-28]
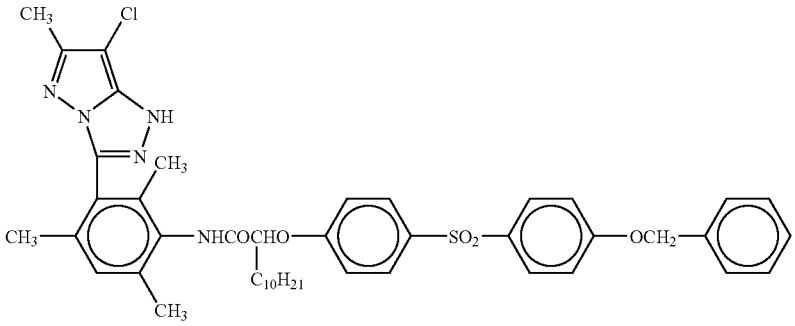
[M-29]
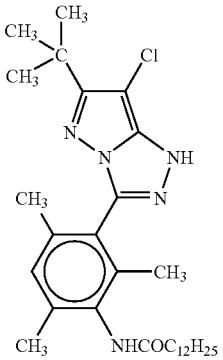
[M-30]
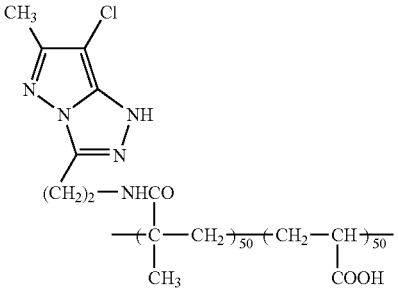
[M-31]
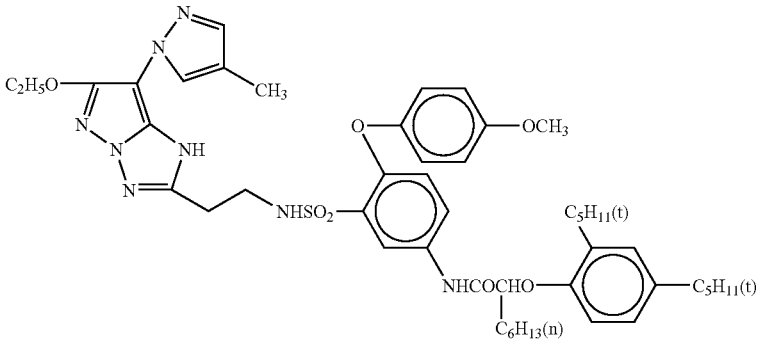
[M-32]
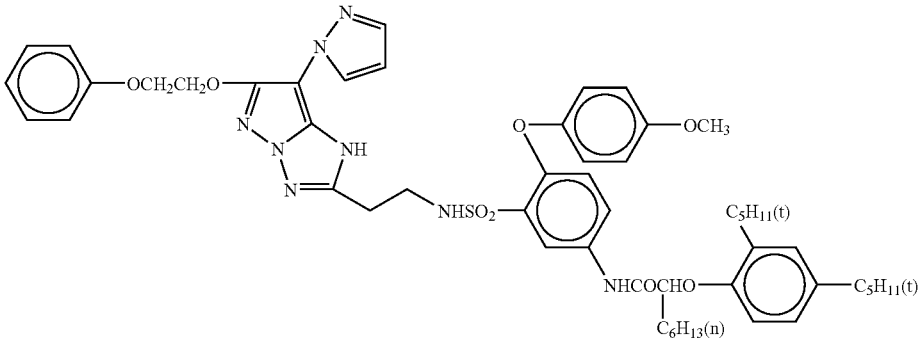

-continued
[M-33]
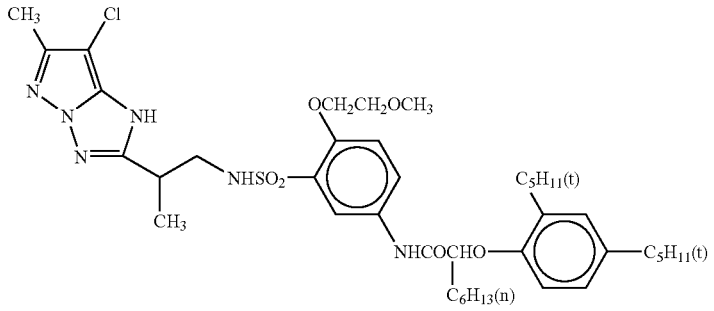
[M-34]
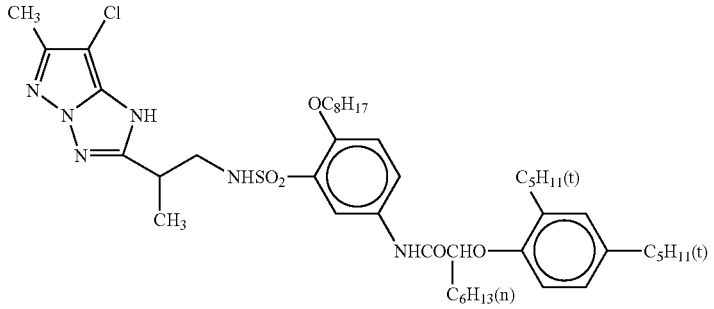
[M-35]
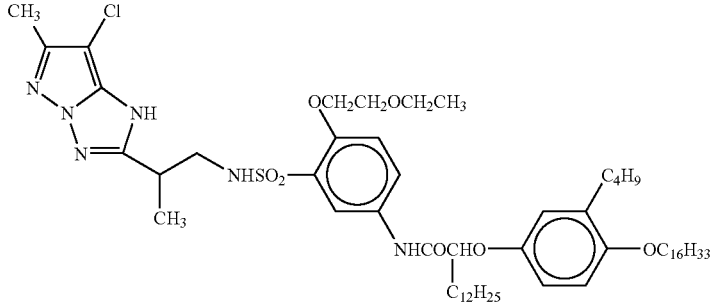
[M-36]
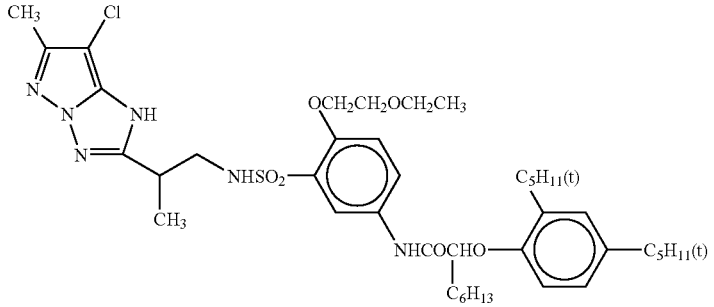
[M-37]
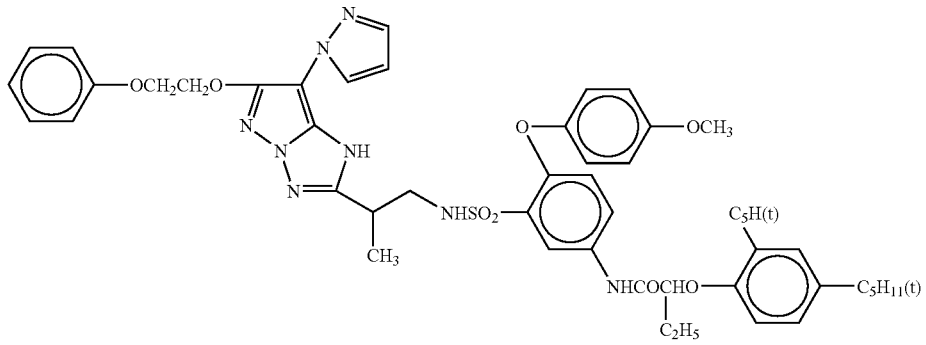

Examples of synthesis methods of the coupler represented by general formula (I) are shown in the following documents.

Compound represented by formula [M-I]: U.S. Pat. No. 4,500,630, the disclosure of which is incorporated herein by reference.

Compound represented by formula [M-II]: U.S. Pat. Nos. 4,540,654 and 4,705,863, JP-A's-61-65245, 62-209457 and 62-249155, the disclosures of which are incorporated herein by reference.

Compound represented by formula [M-III]: Jpn. Pat. Appln. KOKOKU Publication No. (hereinafter referred to as JP-B-)47-27411 and U.S. Pat. No. 3,725,067, the disclosures of which are incorporated herein by reference.

The coupler represented by general formula (Z) used in the present invention will be described in detail below.

General formula (Z)

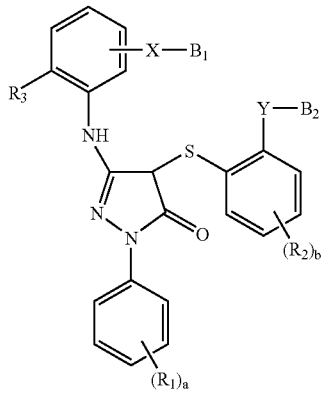

In general formula (Z), a represents an integer of 0 to 3; b represents an integer of 0 to 2; each of $R_1$ and $R_2$ is independently hydrogen, an alkyl group, an alkoxy group, a halogen group, an aryl group, an aryloxy group, an acylamino group, a sulfonamide group, a sulfamoyl group, a carbamoyl group, an arylsulfonyl group, an aryloxycarbonyl group, an alkoxycarbonyl group, an alkoxysulfonyl group, an aryloxysulfonyl group, an alkylureido group, an arylureido group, a nitro group, a cyano group, a hydroxyl group or a carboxyl group; $R_3$ is a halogen atom, an alkyl group or an aryl group; X and Y are a direct bond or a bonding group; and $B_1$ and $B_2$ are a stabilizing group that does not diffuse the coupler.

More specifically, $R_1$ and $R_2$ include a hydrogen atom, an alkyl group such as a linear, or branched alkyl group having 1 to 8 carbon atoms (e.g., methyl group, trifluoromethyl group, ethyl group, butyl group and octyl group), an alkoxy group such as an alkoxy group having 1 to 8 carbon atoms (e.g., methoxy group, ethoxy group, propoxy group, 2-methoxyethoxy group and 2-ethylhexyloxy group), a halogen (e.g., a chlorine atom, a bromine atom and a fluorine), an aryl group (e.g., phenyl group, naphthyl group and 4-tolyl group), an aryloxy group (e.g., phenoxy group, p-methoxyphenoxy group, naphthyloxy group and tolyloxy group), an acylamino group (e.g., acetoamide group, benzamide group, butylamide group and t-butylcarbonamide group), a sulfonamide group (e.g. methylsulfonamide group, benzenesulfonamide group and p-toluylsulfonamide group), a sulfamoyl group (e.g., N-methylsulfamoyl group, N,N-diethylsulfamoyl group and N,N-dimethylsulfamoyl group), a carbamoyl group (e.g., N-methylcarbamoyl group and N,N-dimethylcarbamoyl group), an arylsulfonyl group (e.g., tolylsulfonyl group), an aryloxycarbonyl group (e.g., phenoxycarbonyl group), an alkoxycarbonyl group such as an alkoxycarbonyl group having 2 to 10 carbon atoms (e.g., methoxycarbonyl group, ethoxycarbonyl group and benzyloxycarbonyl group), an alkoxysulfonyl group such as an alkoxysulfonyl group having 2 to 10 carbon atoms (e.g., methoxysulfonyl group, octylsulfonyl group and 2-ethylhexylsulfonyl group), an aryloxysulfonyl group (e.g., phenoxysulfonyl group), an alkylureido group (e.g., N-methylureido group, N,N-dimethylureido group and N,N-dibutylureido group), an arylureido group (e.g., phenylureido group), a nitro group, a cyano group, a hydroxyl group or a carboxyl group.

$R_3$ includes a halogen atom (e.g., a chlorine atom, a bromine atom and a fluorine), an alkyl group such as a linear, or branched alkyl group having 1 to 8 carbon atoms (e.g., methyl group, trifluoromethyl group, ethyl group, butyl group and octyl group) and an aryl group (e.g., phenyl group, naphthyl group and 4-tolyl group).

$B_1$ and $B_2$ are a stabilizing group, namely, an organic group for not diffusing a coupler from a layer containing the coupler. The stabilizing group includes an organic hydrophobic group having 8 to 32 carbon atoms that is bonded with a coupler directly or through a divalent bonding group X or Y (for example, an alkylene group, an imino group, an ether group, an thioether group, a carbonamide group, a sulfonamide group, a ureido group, an ester group, an imide group, a carbamoyl group and a sulfamoyl group). The specific examples of the suitable stabilizing group include an alkyl group (linear chain, branched chain or cyclic), an alkylene group, an alkoxy group, an alkylaryl group, an alkylaryloxy group, an acylamidoalkyl group, an alkoxyalkyl group, an alkoxyaryl group, an alkyl group substituted with an aryl group or a heterocyclic group, an aryl group substituted with an aryloxyalkoxycarbonyl group, and a residual group containing both of an alkenyl group or an alkenyl long chain aliphatic group and a carboxyl group or a sulfo water-soluble group described in, for example, U.S. Pat. Nos. 3,337,344, 3,418,129, 3,892,572, 4,138,258 and 4,451,559 and British Patent No. 1,494,777.

When a compound or a substituent is described in the invention using the term "group" or "residual group", a chemical substance described includes a basic group or residual group and a usual group or residual group having a substituent. When a compound or a substituent is described using the term "site", only an unsubstituted chemical substance is included. The "alkyl group" includes not only alkyl sites such as methyl, ethyl, butyl, octyl and stearyl, but also a site having substituents such as halogen, cyano, a hydroxyl group, nitro, amino and carboxylate. On the other hand, the "alkyl site" includes only methyl, ethyl, stearyl, cyclohexyl and the like.

The following are examples of a magenta coupler represented by general formula (Z) preferably used in the present invention. However, the present invention is not limited to these examples.

Z-1

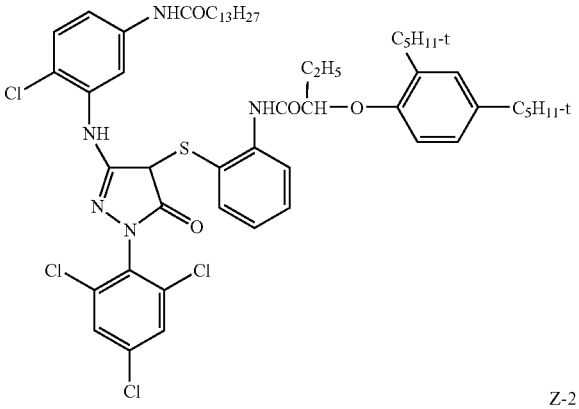

Z-2

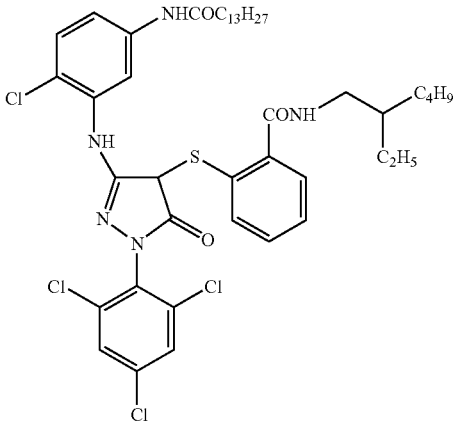

Z-3

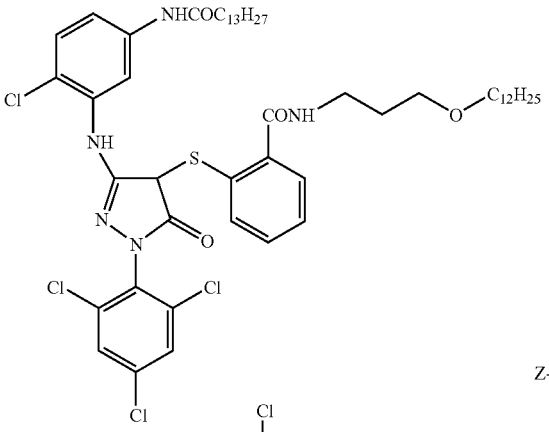

Z-4

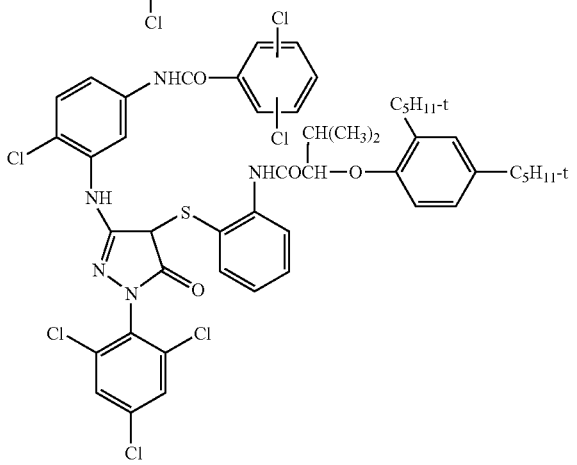

The coupler of the general formula (I) or the general formula (Z) used in the invention can be usually used in the range of $1\times10^{-3}$ mol to 1 mol, and preferably $1\times10^{-3}$ mol to $8\times10^{-1}$ mol, based on 1 mol of the silver halide of a used layer. Coating amount is preferably 0.01 to 1.0 g/m$^2$, more preferably 0.05 to 0.8 g/m$^2$ and further preferably 0.1 to 0.5 g/m$^2$. The coupler used in the invention is used in at least one layer and more preferably used in all the green sensitive layers when a plurality of the green sensitive layers used are set.

The coupler used for the invention can be introduced into the photosensitive material by various known dispersion methods. The dispersion of the coupler used in the invention can be prepared by dissolving the coupler into an auxiliary organic solvent with a low boiling point or a partially water-soluble auxiliary organic solvent. In one aspect of the invention, the dispersion can be prepared by using an organic solvent with a high boiling point, or it can be prepared without using the solvent. Then, the organic solution obtained can be mixed with aqueous gelatin solution, and the fine particles of organic phase suspended in aqueous phase are obtained by passing the mixture through a mechanical stirrer such as a colloid mill, a homogenizer, a micro-fluidizing apparatus, a high-speed mixer, an ultrasonic wave dispersing apparatus, a blade mixer, an apparatus in which liquid flow is passed through an orifice or an interaction chamber and injected at a high pressure by a pump, a Gorlin mill or a compounding machine that is generally suitable for preparing emulsified dispersion for photography and matched for high shear and turbulent mixing. In this manner, the emulsified dispersion for photography can be prepared.

The dispersion may be prepared by using one or more apparatuses. Further, the auxiliary organic solvent is removed by evaporation, noodle rinsing or membrane dialysis. The dispersion particles have preferably an average particle diameter of less than 2 μm, in general about 0.02 to 2 μm and more preferably about 0.02 to 0.5 μm. These methods are described in detail in the specifications of U.S. Pat. Nos. 2,322,027, 2,787,544, 2,801,170, 2,801,171, 2,949,360 and 3,396,027.

Examples of a high boiling point solvent used for an oil-in-water droplet dispersion method are described in U.S. Pat. No. 2,322,027 and the like. The specific examples of the high boiling point organic solvent having a boiling point of 175° C. or more at a normal pressure that is used for the oil-in-water droplet dispersion method include phthalic esters (dibutyl phthalate, dicyclohexyl phthalate, di-2-ethylhexyl phthalate, decyl phthalate, bis(2,4-di-t-amylphenyl) phthalate, bis(2,4-di-t-amylphenyl) isophthalate, bis(1,1-diethylpropyl) phthalate and the like); esters of phosphoric acid or phosphonic acid (triphenyl phosphate, tricresyl phosphate, 2-ethylhexyldiphenyl phosphate, tricyclohexyl phosphate, tri-2-ethylhexyl phosphate, tridodecyl phosphate, tributoxyethyl phosphate, tirchloropropyl phosphate, di-2-ethylhexylphenyl phosphate and the like); benzoic esters (2-ethylhexyl benzoate, dodecyl benzoate, 2-ethylhexyl-p-hydroxy benzoate and the like); amides (N,N-diethyl dodecaneamide, N,N-diethyl laurylamide, N-tetradecyl pyrrolidone and the like); alcohols or phenols (isostearyl alcohol, 2,4-di-t-amylphenol and the like); esters of aliphatic carboxylic acid (bis(2-ethylhexyl) sebacate, dioctyl azelate, glycerol tributyrate, isostearyl lactate, trioctyl citrate and the like); aniline derivatives (N,N-dibutyl-2-butoxy-5-t-octylaniline and the like); and hydrocarbons (paraffin, dodecylbenzene, diisopropylnaphthalene and the like). Further, as the auxiliary organic solvent, an organic solvent whose boiling point is about 30° C. or more and preferably 50° C. or more and about 160° C. or less can be used and the typical examples thereof include ethyl acetate, butyl acetate, ethyl propionate, methyl ethyl ketone, cyclohexanone, 2-ethoxyethyl acetate, and dimethylformamide.

The aqueous phase of the coupler dispersion of the invention contains preferably gelatin as hydrophobic colloid. This can be modified gelatin such as acetylated gelatin, phthalated gelatin and oxidized gelatin. Gelatin may be treated with a base as limed gelatin and may be treated with an acid as acid processing ossein gelatin. Further, other hydrophilic colloid such as water-soluble polymer or copolymer may be used. Examples thereof include, but not limited to, polyvinyl alcohol, partially hydrolyzed polyvinyl acetate-co vinyl alcohol, hydroxyethyl cellulose, polyacrylic acid, poly(1-vinyl pyrrolidone), sodium polystyrene sulfonate, poly(2-acrylamide-2-methane sulfonic acid) and polyacrylamide. The copolymer of these polymers having hydrophobic monomers may be used.

A surfactant may exist in the aqueous phase or the organic phase and the dispersion can be prepared without the surfactant. The surfactant can be cationic, anionic, ampholyte ionic or non ionic. The proportion of the surfactant to a liquid organic solution is generally in the range of 0.5 to 25% by mass when fine particle dispersion for photography is formed. In the preferable aspect of the invention, the aqueous gelatin solution contains an anionic surfactant.

The particularly preferable surfactant used for the invention includes alkali metal salts of arylene sulfonic acid such as sodium dodecylbenzene sulfonate or sodium isopropylnaphthalene sulfonate, the mixture of sodium diisopropyl and triisopropylnaphthalene sulfonate; alkali metal salts of alkyl sulfonic acid such as sodium dodecyl sulfonate; or alkali metal salts of alkyl sulfosuccinate such as sodium bis(2-ethylhexyl) succinic sulfonate.

Then, the silver halide emulsion used in the invention will be specifically described.

The particle size of the silver halide particles used in the invention can be evaluated using an electron microscope. Specifically, in the case of particles having a regular crystal, a diameter equivalent to projection area (when the projection area of a particle is equivalent to the area of a circle, it is the diameter of the circle) obtained by observation by the electron microscope is determined. The volume of the particle is then calculated from the diameter equivalent to projection area utilizing the regular crystal (three dimensionally isotropic). Further, when the volume of the particle is equivalent to the volume of a sphere, the diameter (sphere equivalent diameter) of the sphere is calculated to determine the particle size. Further, in the case of a planar irregular particle (not three dimensionally isotropic), its volume is calculated from a diameter equivalent to projection area obtained by observation by the electron microscope and the thickness of the particle to determine the sphere equivalent diameter. Further, the sphere equivalent diameter can be also determined by a turbidity measurement method described in Particle Characterization, Second Edition, pp 14-19 (1985).

The average equivalent-spherical diameter of the silver halide grain preferably used in the present invention is preferably 0.02 μm to 0.5 μm, more preferably 0.03 μm to 0.35 μm, and most preferably 0.03 μm to 0.2 μm.

A silver halide used in the present invention is silver iodobromide, silver iodochloride, or silver bromochloroiodide containing about 30 mol % or less of silver iodide. A silver halide is most preferably silver iodobromide or silver bromochloroiodide containing about 2 to about 10 mol % of silver iodide.

Silver halide grains contained in a photographic emulsion can have regular crystals such as cubic, octahedral, or tetradecahedral crystals, irregular crystals such as spherical or tabular crystals, crystals having crystal defects such as twin planes, or composite shapes thereof. In the present invention, cubic emulsion is preferred.

A silver halide photographic emulsion usable in the present invention can be prepared by methods described in, e.g., "I. Emulsion preparation and types," Research Disclosure (RD) No. 17643 (December, 1978), pp. 22 and 23, RD No. 18716 (November, 1979), p. 648, and RD No. 307105 (November, 1989), pp. 863 to 865; P. Glafkides, "Chemie et Phisique Photographique", Paul Montel, 1967; G. F. Duffin, "Photographic Emulsion Chemistry", Focal Press, 1966; and V. L. Zelikman et al., "Making and Coating Photographic Emulsion", Focal Press, 1964, the disclosures of which are incorporated herein by reference.

Monodisperse emulsions described in, e.g., U.S. Pat. Nos. 3,574,628, 3,655,394, and GB1,413,748, the disclosures of which are incorporated herein by reference, are also favorable.

Tabular grains having an aspect ratio of about 3 or more can also be used in the present invention. Tabular grains can be easily prepared by methods described in Gutoff, "Photographic Science and Engineering", Vol. 14, pp. 248 to 257 (1970); and U.S. Pat. Nos. 4,434,226, 4,414,310, 4,433,048, 4,439,520, and GB2,112,157, the disclosures of which are incorporated herein by reference.

A crystal structure can be uniform, can have different halogen compositions in the interior and the surface layer thereof, or can be a layered structure. Alternatively, a silver halide having a different composition can be bonded by an epitaxial junction, or a compound except for a silver halide such as silver rhodanide or lead oxide can be bonded. A mixture of grains having various types of crystal shapes can also be used.

It is preferable that the above emulsion has dislocation lines. In the tabular grains, it is especially preferred that dislocation lines are viewed in the fringe portion thereof. Dislocation lines can be introduced by, for example, adding an aqueous solution such as an alkali iodide aqueous solution to form a high silver iodide layer, adding AgI fine grains, or a method as described in JP-A-5-323487.

The above emulsion can be any of a surface latent image type emulsion which mainly forms a latent image on the surface of a grain, an internal latent image type emulsion which forms a latent image in the interior of a grain, and another type of emulsion which has latent images on the surface and in the interior of a grain. However, the emulsion must be a negative type emulsion. The internal latent image type emulsion can be a core/shell internal latent image type emulsion described in JP-A-63-264740, the disclosure of which is incorporated herein by reference. A method of preparing this core/shell internal latent image type emulsion is described in JP-A-59-133542, the disclosure of which is incorporated herein by reference. Although the thickness of a shell of this emulsion depends on the development conditions and the like, it is preferably 3 to 40 nm, and most preferably, 5 to 20 nm.

With respect to the emulsion of the present invention, general contents will be described below.

Reduction sensitization preferable performed in the present invention can be selected from a method of adding reduction sensitizers to a silver halide emulsion, a method called silver ripening in which grains are grown or ripened in a low-pAg ambient at pAg 1 to 7, and a method called high-pH ripening in which grains are grown or ripened in a high-pH ambient at pH 8 to 11. It is also possible to combine two or more of these methods.

The method of adding reduction sensitizers is preferred in that the level of reduction sensitization can be finely adjusted.

As examples of the reduction sensitizer stannous chloride, ascorbic acid and its derivatives, hydroquinone and its derivatives, catechol and is derivatives, hydroxylamine and its derivatives, amines and polyamines, hydrazine and its derivatives, para-phenylenediamin and its derivatives, formamidinesulfinic acid(thiourea dioxide), a silane compound, and a borane compound, can be mentioned. In reduction sensitization of the present invention, it is possible to selectively use these reduction sensitizers or to use two or more types of compounds together. Regarding the methods for performing the reduction sensitization, those disclosed in U.S. Pat. Nos. 2,518,698, 3,201,254, 3,411,917, 3,779,777, 3,930,867, may be used. Regarding the methods for using the reduction sensitizer, those disclosed in JP-B's-57-33572 and 58-1410, JP-A-57-179835, may be used. Preferable compounds as the reduction sensitizer are catechol and its derivatives, hydroxylamine and its derivatives, and formamidinesulfinic acid(thiourea dioxide). Further, compounds represented by the following general formulae (II) and (III) are also preferred as the reduction sensitizer.

General foamula (II)

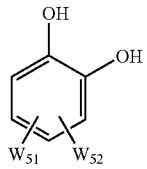

General foamula (III)

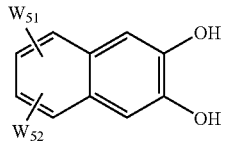

In general formulae (II) and (III), each of $W_{51}$ and $W_{52}$ is independently a sulfo group or a hydrogen atom, with the proviso that at least one of $W_{51}$ and $W_{52}$ is a sulfo group. A sulfo group is usually a water-soluble salt such as an alkali metal salt (e.g., a sodium or potassium) or an ammonium salt. Examples of a preferable compound are 3,5-disulfocatecholdisodium salt, 4-sulfocatecholammonium salt, 2,3-dihydroxy-7-sulfonaphthalenesodium salt and 2,3-dihydroxy-6,7-disulfonaphthalenepotassium salt and so on.

Although the addition amount of reduction sensitizers must be so selected as to meet the emulsion manufacturing conditions, a proper amount is $10^{-7}$ to $10^{-1}$ mol per mol of a silver halide.

The reduction sensitizer is added during grain formation by dissolving thereof to water, or organic solvents such as alcohols, glycols, ketones, esters, and amides.

Examples of the silver halide solvents which can be employed in the present invention include (a) organic thioethers described in U.S. Pat. Nos. 3,271,157, 3,531,289, and 3,574,628, JP-A's-54-1019 and 54-158917, (b) thiourea derivatives described in, for example, JP-A's-53-82408, 55-77737 and 55-2982, (c) silver halide solvents having a thiocarbonyl group interposed between an oxygen or sulfur atom and a nitrogen atom, described in JP-A-53-144319, (d) imidazoles described in JP-A-54-100717, (e) ammonia and (f) thiocyanates.

Thiocyanates, ammonia and tetramethylthiourea can be mentioned as especially preferred silver halide solvents. The amount of added solvent, although varied depending on the type thereof, is, if thiocyanate is use, preferably in the range of $1\times10^{-4}$ to $1\times10^{-2}$ mol per mol of silver halide.

In the preparation of the emulsion of the present invention, it is preferable to make salt of metal ion exist, for example, during grain formation, desalting, or chemical sensitization, or before coating in accordance with the intended use. The metal ion salt is preferably added during grain formation when doped into grains, and after grain formation and before completion of chemical sensitization when used to decorate the grain surface or used as a chemical sensitizer. The salt can be doped in any of an overall grain, only the core, the shell, or the epitaxial portion of a grain, and only a substrate grain. Examples of the metal are Mg, Ca, Sr, Ba, Al, Sc, Y, La, Cr, Mn, Fe, Co, Ni, Cu, Zn, Ga, Ru, Rh, Pd, Re, Os, Ir, Pt, Au, Cd, Hg, Tl, In, Sn, Pb, and Bi. These metals can be added as long as they are in the form of salt that can be dissolved during grain formation, such as ammonium salt, acetate, nitrate, sulfate, phosphate, hydroxide, hexa-coordinated complex salt, or tetra-coordinated complex salt. Examples are $CdBr_2$, $CdCl_2$, $Cd(NO_3)_2$, $Pb(NO_3)_2$, $Pb(CH_3COO)_2$, $K_4[Fe(CN)_6]$, $(NH_4)_4[Fe(CN)_6]$, $K_3IrCl_6$, $(NH_4)_3RhCl_6$, and $K_4Ru(CN)_6$. The ligand of a coordination compound can be selected from halo, aquo, cyano, cyanate, thiocyanate, nitrosyl, thionitrosyl, oxo, and carbonyl. These metal compounds can be used either singly or in the form of a combination of two or more types of them.

The metal compounds are preferably dissolved in an appropriate solvent, such as water, methanol or acetone, and added in the form of a solution. To stabilize the solution, an aqueous hydrogen halogenide solution (e.g., HCl or HBr) or an alkali halide (e.g., KCl, NaCl, KBr, or NaBr) can be added. It is also possible to add acid or alkali if necessary. The metal compounds can be added to a reactor vessel either before or during grain formation. Alternatively, the metal compounds can be added to a water-soluble silver salt (e.g., $AgNO_3$) or an aqueous alkali halide solution (e.g., NaCl, KBr, or KI) and added in the form of a solution continuously during formation of silver halide grains. Furthermore, a solution of the metal compounds can be prepared independently of a water-soluble salt or an alkali halide and added continuously at a proper timing during grain formation. It is also possible to combine several different addition methods.

It is sometimes useful to perform a method of adding a chalcogen compound during preparation of an emulsion, such as described in U.S. Pat. No. 3,772,031. In addition to S, Se and Te, cyanate, thiocyanate, selenocyanate, carbonate, phosphate, or acetate may be present.

The silver halide grains of the present invention can be subjected to at least one of sulfur sensitizer, selenium sensitization, tellurium sensitization, gold sensitization, palladium sensitization, noble metal sensitization and reduction sensitization, in a desired step in the process for preparation of the silver halide emulsion. Two or more kinds of sensitization are preferably used in combination. Various types of emulsion can be prepared according to in which step chemical sensitization is performed. The types include a type in which a chemical sensitizing core is embedded in each grain, a type in which a chemical sensitizing core is embedded in a position close to a surface of each grain, and a type in which a chemical sensitizing core is formed on a surface of each grain. The location of a chemical sensitizing core of the emulsion which can be used for the photosensitive material of the present invention can be selected according to the object. Generally, preferable is the case where at least one kind of chemical sensitizing core is formed in the vicinity of a surface of each grain.

One chemical sensitization which can be preferably performed in the present invention is chalcogen sensitization, noble metal sensitization, or a combination of these. The sensitization can be performed by using active gelatin as described in T. H. James, The Theory of the Photographic Process, 4th ed., Macmillan, 1977, pages 67 to 76. The sensitization can also be performed by using any of sulfur, selenium, tellurium, gold, platinum, palladium, and iridium, or by using a combination of a plurality of these sensitizers at pAg 5 to 10, pH 5 to 8, and a temperature of 30° C. to 80° C., as described in Research Disclosure, Vol. 120, April, 1974, 12008, Research Disclosure, Vol. 34, June, 1975, 13452, U.S. Pat. Nos. 2,642,361, 3,297,446, 3,772,031, 3,857,711, 3,901,714, 4,266,018, and 3,904,415, and British Patent 1,315,755. In the noble metal sensitization, salts of noble metals, such as gold, platinum, palladium, and iridium, can be used. In particular, gold sensitization, palladium sensitization, or a combination of the both is preferred.

In gold sensitization, there can be used gold salts described in Chimie et Physique Photographique (published by Paul Momtel Co., 1987, Fifth Edition) written by P. Grafkides, Research Disclosure Vol. 307, No. 307105 and the like.

Specifically, in addition to chloroauric acid, potassium chloroaurate and potassium auric thiocyanate, there can be also used gold compounds described in U.S. Pat. No. 2,642,361 (gold sulfide, gold selenide and the like), U.S. Pat. No. 3,503,749 (gold thiolate having a water-soluble group and the like), U.S. Pat. No. 5,049,484 (gold bis(methylhydantoate) complex and the like), U.S. Pat. No. 5,049,485 (gold mesoionic thiolate complex, for example, gold 1,4,5-trimethyl-1,2,4-triazolium-3-thiolate complex and the like), gold macrocyclic hetero ring complexes in U.S. Pat. Nos. 5,252,455 and 5,391,727, 5,620,841, 5,700,631, 5,759,760, 5,759,761, 5,912,111, 5,912,112 and 5,939,245, JP-A-1-147537, 8-69074, 8-69075 and 9-269554, JP-B-45-29274, German Patent DD-Nos. 264524A, 264525A, 265474A and 298321A, JP-A-2001-75214, 2001-75215, 2001-75216, 2001-75217 and 2001-75218, etc.

A palladium compound means a divalent or tetravalent salt of palladium. A preferable palladium compound is represented by $R_2PdX_6$ or $R_2PdX_4$ wherein R represents a hydrogen atom, an alkali metal atom, or an ammonium group and X represents a halogen atom, e.g., a chlorine, bromine, or iodine atom.

More specifically, the palladium compound is preferably $K_2PdCl_4$, $(NH_4)_2PdCl_6$, $Na_2PdCl_4$, $(NH_4)_2PdCl_4$, $Li_2PdCl_4$, $Na_2PdCl_6$, or $K_2PdBr_4$. It is preferable that the gold compound and the palladium compound be used in combination with thiocyanate or selenocyanate.

In sulfur sensitization, an unstable sulfur compound is used and unstable sulfur compounds described in Chimie et Physique Photographique (published by Paul Momtel Co., 1987, Fifth Edition) written by P. Grafkides, Research Disclosure Vol. 307, No. 307105 and the like can be used.

Specifically, there can be also used known sulfur compounds such as thiosulfates (for example, hypo); thioureas (for example, diphenyl thiourea, triethyl thiourea, N-ethyl-N'-(4-methyl-2-thiazolyl) thiourea, dicarboxymethyl-dimethyl thiourea and carboxymethyl-trimethyl thiourea); thioamides (for example, thioacetamide); rhodanines (for example, diethylrhodanine and 5-benzylidene-N-ethylrhodanine); phosphine sulfides (for example, trimethylphosphine sulfide); thiohydantoines; 4-oxo-oxazolidine-2-thions; disulfides or polysulfides (for example, dimorpholine disulfide, cystine, hexathiocan-thione); mercapto compounds (for example, cysteine); polythionic acid salt; and elemental sulfur, and active gelatin and the like. In particular, thiosulfates, thioureas, phosphine sulfides and rhodanines are preferable.

In selenium sensitization, unstable selenium compounds are used and there can be used selenium compounds described in JP-B-43-13489 and 44-15748, JP-A-4-25832, 4-109340, 4-271341, 5-40324, 5-11385, 6-51415, 6-175258, 6-180478, 6-208186, 6-208184, 6-317867, 7-92599, 7-98483, 7-140579 and the like.

Specifically, there can be also used colloidal metal selenium; selenoureas (for example, N,N-dimethyl selenourea, trifluoromethylcarobonyl-trimethyl selenourea and acetyl-trimethyl selenourea); selenoamides (for example, selenoamide and N,N-diethylphenyl selenoamide); phosphine selenides (for example, triphenylphosphine selenide and pentafluorophenyl-triphenylphosphine selenide); selnophosphates (for example, tri-p-tolyl selnophosphate and tri-n-butyl selnophosphate); selenoketones (for example, selenobenzophenone); isoselenocyanates; selenocarboxylic acids; selenoesters (for example, methoxyphenyl selenocarboxy-2,2-dimethoxycyclohexane ester); diacyl selenides and the like. Furthermore, non-unstable selenium compounds described in JP-B-46-4553, 52-34492 and the like, for example, selenious acid, selenocyanic acids (for example, potassium selenocyanate), selenazoles, selenides and the like can be also used. In particular, phosphine selenides, selenoureas, selenoesters and selenocyanic acids are preferable.

In tellurium sensitization, unstable tellurium compounds are used and there can be used unstable tellurium compounds described in JP-A-4-224595, 4-271341, 4-333043, 5-303157, 6-27573, 6-175258, 6-180478, 6-208186, 6-208184, 6-317867, 7-140579 and the like.

Specifically, there may be used phosphine tellurides (for example, butyl-diisopropylphosphine telluride, tributylphosphine telluride, tributoxyphosphine telluride and ethoxy-diphenylphosphine telluride); diacyl (di)tellurides (for example, bis(diphenylcarbamoyl) ditelluride, bis(N-phenyl-N-methylcarbamoyl) ditelluride, bis(N-phenyl-N-methylcarbamoyl) telluride, bis(N-phenyl-N-benzylcarbamoyl) telluride and bis(ethoxycarbonyl) telluride); tellulourea (for example, N,N'-dimethylethylene tellulourea and N,N'-diphenylethylene tellulourea); telluloamides; telluloesters and the like.

Compounds such as azaindene, azapyridazine and azapyrimidine that have been known to suppress fog in the process of chemical sensitization and increase sensitivity are used for a useful chemical sensitization aid. The examples of the modifier of the chemical sensitization aid are described in U.S. Pat. Nos. 2,131,038, 3,411,914 and 3,554,757, and JP-A-58-126526 and the above-mentioned "Photographic Emulsion Chemistry" written by Daphine, pp 138-143.

The use amounts of the gold sensitizer and a chalcogen sensitizer used in the invention are changed depending on silver halide particles used and chemical sensitization conditions, but about $10^{-8}$ to $10^{-2}$ mol per 1 mole of silver halide, preferably $10^{-7}$ to $10^{-3}$ mol, can be used.

The condition of chemical sensitization in the invention is not specifically limited, but pAg is 6 to 11 and preferably 7 to 10, pH is 4 to 10 and preferably 5 to 8, and temperature is 40° C. to 95° C. and preferably 45° C. to 85° C.

It is preferable to use an oxidizer for silver during the process of producing emulsions used in the present invention. An oxidizer for silver is a compound having an effect of converting metal silver into silver ion. A particularly effective compound is the one that converts very fine silver grains, formed as a by-product in the process of formation and chemical sensitization of silver halide grains, into silver ion. The silver ion produced can form a silver salt hard to dissolve in water, such as a silver halide, silver sulfide, or silver selenide, or a silver salt easy to dissolve in water, such as silver nitrate. An oxidizer for silver can be either an inorganic or organic substance. Examples of an inorganic oxidizer are ozone, hydrogen peroxide and its adduct (e.g., $NaBO_2.H_2O_2.3H_2O$, $2NaCO_3.3H_2O_2$, $Na_4P_2O_7.2H_2O_2$, and $2Na_2SO_4.H_2O_2.2H_2O$), peroxy acid salt (e.g., $K_2S_2O_8$, $K_2C_2O_6$, and $K_2P_2O_8$), a peroxy complex compound (e.g., $K_2[Ti(O_2)C_2O_4].3H_2O$, $4K_2SO_4.Ti(O_2)OH.SO_4.2H_2O$, and $Na_3[VO(O_2)(C_2H_4)_2.6H_2O]$), permanganate (e.g., $KMnO_4$), an oxyacid salt such as chromate (e.g., $K_2Cr_2O_7$), a halogen element such as iodine and bromine, perhalogenate (e.g., potassium periodate), a salt of a high-valence metal (e.g., potassium hexacyanoferrate(II)), and thiosulfonate.

Examples of an organic oxidizer are quinones such as p-quinone, an organic peroxide such as peracetic acid and perbenzoic acid, and a compound for releasing active halogen (e.g., N-bromosuccinimide, chloramine T, and chloramine B).

Preferable oxidizers of the present invention are inorganic oxidizers such as ozone, hydrogen peroxide and its adduct, a halogen element, and thiosulfonate, and organic oxidizers such as quinones. It is preferable to use the reduction sensitization described above and the oxidizer for silver together. In this case, the reduction sensitization can be performed after the oxidizer is used or vice versa, or the oxidizer can be used simultaneously with the reduction sensitization. These methods can be applied to both the grain formation step and the chemical sensitization step.

Photographic emulsions used in the present invention can contain various compounds in order to prevent fog during the preparing process, storage, or photographic processing of a sensitized material, or to stabilize photographic properties. That is, it is possible to add many compounds known as antifoggants or stabilizers, e.g., thiazoles such as benzothiazolium salt, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles, and mercaptotetrazoles (particularly 1-phenyl-5-mercaptotetrazole); mercaptopyrimidines; mercaptotriazines; a thioketo compound such as oxazolinethione; and azaindenes such as triazaindenes, tetrazaindenes (particularly 4-hydroxy-substituted(1,3,3a,7)tetrazaindenes), and pentazaindenes. For example, compounds described in U.S. Pat. Nos. 3,954,474 and 3,982,947 and JP-B-52-28660 can be used. One preferred compound is described in JP-A-63-212932. Antifoggants and stabilizers can be added at any of several different timings, such as before, during, and after grain formation, during washing with water, during dispersion after the washing, before, during, and after chemical sensitization, and before coating, in accordance with the intended application. The antifoggants and stabilizers can be added during preparation of an emulsion to achieve their original fog preventing effect and stabilizing effect. In addition, the antifoggants and stabilizers can be used for various purposes of, e.g., controlling the crystal habit of grains, decreasing the grain size, decreasing the solubility of grains, controlling chemical sensitization, and controlling the arrangement of dyes.

Photographic emulsions used in the present invention are preferably subjected to spectral sensitization by methine dyes and the like in order to achieve the effects of the present invention. Usable dyes involve a cyanine dye, merocyanine dye, composite cyanine dye, composite merocyanine dye, holopolar cyanine dye, hemicyanine dye, styryl dye, and hemioxonole dye. Most useful dyes are those belonging to a cyanine dye, merocyanine dye, and composite merocyanine dye. Any nucleus commonly used as a basic heterocyclic nucleus in cyanine dyes can be applied to these dyes. Examples of an applicable nucleus are a pyrroline nucleus, oxazoline nucleus, thiozoline nucleus, pyrrole nucleus, oxazole nucleus, thiazole nucleus, selenazole nucleus, imidazole nucleus, tetrazole nucleus, and pyridine nucleus; a nucleus in which an aliphatic hydrocarbon ring is fused to any of the above nuclei; and a nucleus in which an aromatic hydrocarbon ring is fused to any of the above nuclei, e.g., an indolenine nucleus, benzindolenine nucleus, indole nucleus, benzoxadole nucleus, naphthoxazole nucleus, benzthiazole nucleus, naphthothiazole nucleus, benzoselenazole nucleus, benzimidazole nucleus, and quinoline nucleus. These nuclei can be substituted on a carbon atom.

It is possible to apply to a merocyanine dye or a composite merocyanine dye a 5- to 6-membered heterocyclic nucleus as a nucleus having a ketomethylene structure. Examples are a pyrazoline-5-one nucleus, thiohydantoin nucleus, 2-thiooxazolidine-2,4-dione nucleus, thiazolidine-2,4-dione nucleus, rhodanine nucleus, and thiobarbituric acid nucleus.

Although these sensitizing dyes can be used singly, they can also be used together. The combination of sensitizing dyes is often used for a supersensitization purpose. Representative examples of the combination are described in U.S. Pat. Nos. 2,688,545, 2,977,229, 3,397,060, 3,522,052, 3,527,641, 3,617,293, 3,628,964, 3,666,480, 3,672,898, 3,679,428, 3,703,377, 3,769,301, 3,814,609, 3,837,862, and 4,026,707, British Patent Nos. 1,344,281 and 1,507,803, JP-B-43-4936, JP-B-53-12375, JP-A-52-110618, and JP-A-52-109925.

Emulsions can contain, in addition to the sensitizing dyes, dyes having no spectral sensitizing effect or substances not essentially absorbing visible light and presenting supersensitization.

The sensitizing dyes can be added to an emulsion at any point in the preparation of an emulsion, which is conventionally known to be useful. Most ordinarily, the addition is performed after the completion of chemical sensitization and before coating. However, it is possible to perform the addition at the same timing as the addition of chemical sensitizing dyes to perform spectral sensitization and chemical sensitization simultaneously, as described in U.S. Pat. Nos. 3,628,969 and 4,225,666. It is also possible to perform the addition prior to chemical sensitization, as described in JP-A-58-113928, or before the completion of the formation of a silver halide grain precipitation to start spectral sensitization. Alternatively, as disclosed in U.S. Pat. No. 4,225,666, these compounds can be added separately; a portion of the compounds is added prior to chemical sensitization, while the remaining portion is added after that. That is, the compounds can be added at any timing during the formation of silver halide grains, including the method disclosed in U.S. Pat. No. 4,183,756. The addition amount of the sensitizing dye is preferably $4\times10^{-6}$ to $8\times10^{-3}$ mol per mol of silver halide.

It is preferred that the silver halide photosensitive material of the present invention contains the compound selected from among the following compounds of type 1 and type 2.

(Type 1)

Compound which undergoes a one-electron oxidation so as to form a one-electron oxidation product capable of, through subsequent bond cleavage reaction, releasing one or more electrons.

(Type 2)

Compound which undergoes a one-electron oxidation so as to form a one-electron oxidation product capable of, after subsequent bond formation reaction, releasing one or more electrons.

First, the compound of type 1 will be described.

With respect to the compound of type 1, as the compound which undergoes a one-electron oxidation so as to form a one-electron oxidation product capable of, through subsequent bond cleavage reaction, releasing one electron, there can be mentioned compounds referred to as "one photon two electrons sensitizers" or "deprotonating electron donating sensitizers", as described in, for example, JP-A-9-211769 (examples: compounds PMT-1 to S-37 listed in Tables E and F on pages 28 to 32), JP-A-9-211774, JP-A-11-95355 (examples: compounds INV 1 to 36), PCT Japanese Translation Publication 2001-500996 (examples: compounds 1 to 74, 80 to 87 and 92 to 122), U.S. Pat. Nos. 5,747,235 and 5,747,236, EP 786692A1 (examples: compounds INV 1 to 35), EP 893732A1 and U.S. Pat. Nos. 6,054,260 and 5,994,051. Preferred ranges of these compounds are the same as described in the cited patent specifications.

With respect to the compound of type 1, as the compound which undergoes a one-electron oxidation so as to form a one-electron oxidation product capable of, through subsequent bond cleavage reaction, releasing one or more electrons, there can be mentioned compounds of the general formula (1) (identical with the general formula (1) described in JP-A-2003-114487), the general formula (2) (identical with the general formula (2) described in JP-A-2003-114487), the general formula (3) (identical with the general formula (3) described in JP-A-2003-114487), the general formula (3) (identical with the general formula (1) described in JP-A-2003-114488), the general formula (4) (identical with the general formula (2) described in JP-A-2003-114488), the general formula (5) (identical with the general formula (3) described in JP-A-2003-114488), the general formula (6) (identical with the general formula (1) described in JP-A-2003-75950), the general formula (8) (identical with the general formula (1) described in JP-A-2004-239943) and the general formula (9) (identical with the general formula (3) described in JP-A-2004-245929) among the compounds of inducing the reaction represented by the chemical reaction formula (1) (identical with the chemical reaction formula (1) described in JP-A-2004-245929). Preferred ranges of these compounds are the same as described in the cited patent specifications.

General formula (1)

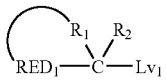

General formula (2)

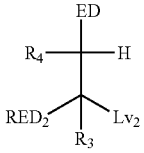

In the general formulae (1) and (2), each of $RED_1$ and $RED_2$ represents a reducing group. $R_1$ represents a nonmetallic atom group capable of forming a cyclic structure corresponding to a tetrahydro form or hexahydro form of 5-membered or 6-membered aromatic ring (including aromatic heterocycle) in cooperation with carbon atom (C) and $RED_1$. Each of $R_2$, $R_3$ and $R_4$ represents a hydrogen atom or a substituent. Each of $L_{v1}$ and $L_{v2}$ represents a split off group. ED represents an electron donating group.

General formula (3)

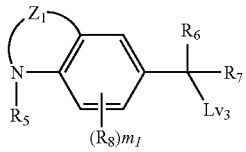

General formula (4)

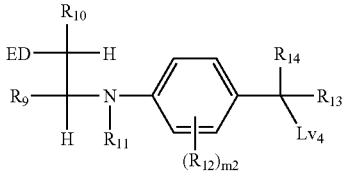

General formula (5)

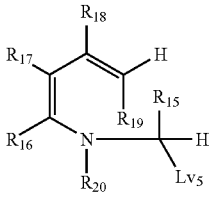

In the general formulae (3), (4) and (5), $Z_1$ represents an atomic group capable of forming a 6-membered ring in cooperation with a nitrogen atom and two carbon atoms of benzene ring. Each of $R_5$, $R_6$, $R_7$, $R_9$, $R_{10}$, $R_{11}$, $R_{13}$, $R_{14}$, $R_{15}$, $R_{16}$, $R_{17}$, $R_{18}$ and $R_{19}$ represents a hydrogen atom or a substituent. $R_{20}$ represents a hydrogen atom or a substituent, provided that when $R_{20}$ represents a non-aryl group, $R_{16}$ and $R_{17}$ are bonded to each other to thereby form an aromatic ring or aromatic heterocycle. Each of $R_8$ and $R_{12}$ represents a substituent capable of substitution on benzene ring. $m_1$ is an integer of 0 to 3. $m_2$ is an integer of 0 to 4. Each of $L_{v3}$, $L_{v4}$ and $L_{v5}$ represents a split off group. ED represents an electron donating group.

General formula (6)

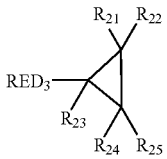

General formula (7)

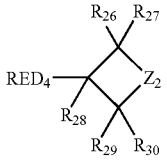

In the general formulae (6) and (7), each of $RED_3$ and $RED_4$ represents a reducing group. Each of $R_{21}$ to $R_{30}$ represents a hydrogen atom or a substituent. $Z_2$ represents $—CR_{111}R_{112}—$, $—NR_{113}—$ or —O—. Each of $R_{111}$ and $R_{112}$ independently represents a hydrogen atom or a substituent. $R_{113}$ represents a hydrogen atom, an alkyl group, an aryl group or a heterocyclic group.

General formula (8)

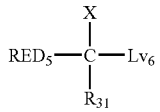

In the general formula (8), $RED_5$ is a reducing group, representing an arylamino group or a heterocyclic amino group. $R_{31}$ represents a hydrogen atom or a substituent. X represents an alkoxy group, an aryloxy group, a heterocyclic oxy group, an alkylthio group, an arylthio group, a heterocyclic thio group, an alkylamino group, an arylamino group or a heterocyclic amino group. $L_{v6}$ is a split off group, representing carboxyl or its salt or a hydrogen atom.

Chemical reaction formula (1)

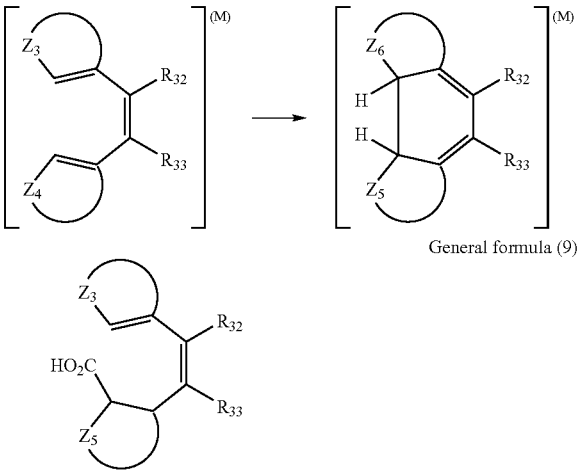

General formula (9)

The compound represented by the general formula (9) is one which undergoes a two-electron oxidation accompanied by decarbonation and is further oxidized to thereby effect a bond forming reaction of chemical reaction formula (1). In the chemical reaction formula (1), each of $R_{32}$ and $R_{33}$ represents a hydrogen atom or a substituent. $Z_3$ represents a group capable of forming a 5- or 6-membered heterocyclic ring in cooperation with C═C. $Z_4$ represents a group capable of forming a 5- or 6-membered aryl group or heterocyclic ring in cooperation with C═C. Each of $Z_5$ and $Z_6$ represents a group capable of forming a 5- or 6-membered cycloaliphatic hydrocarbon group or heterocyclic ring in cooperation with C—C. M represents a radical, a radical cation or a cation. In the general formula (9), $R_{32}$, $R_{33}$, $Z_3$ and $Z_5$ have the same meaning as in the chemical reaction formula (1).

Now, the compounds of type 2 will be described.

As the compounds of type 2, namely, compounds which undergo a one-electron oxidation so as to form a one-electron oxidation product capable of, through subsequent bond formation reaction, releasing one or more electrons, there can be mentioned compounds of the general formula (10) (identical with the general formula (1) described in JP-A-2003-140287) and compounds of the general formula (11) (identical with the general formula (2) described in JP-A-2004-245929) capable of inducing the reaction represented by the chemical reaction formula (1) (identical with the chemical reaction formula (1) described in JP-A-2004-245929). Preferred ranges of these compounds are the same as described in the cited patent specifications.

$RED_6$-Q-Y General formula (10)

In the general formula (10), $RED_6$ represents a reducing group which undergoes a one-electron oxidation. Y represents a reactive group containing carbon to carbon double bond moiety, carbon to carbon triple bond moiety, aromatic group moiety or nonaromatic heterocyclic moiety of benzo condensation ring capable of reacting with a one-electron oxidation product formed by a one-electron oxidation of $RED_6$ to thereby form a new bond. Q represents a linking group capable of linking $RED_6$ with Y.

Chemical reaction formula (1)

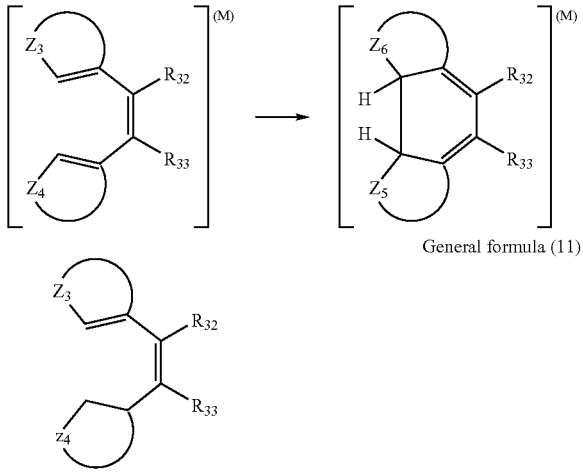

General formula (11)

The compound represented by the general formula (11) is one oxidized to thereby effect a bond forming reaction of chemical reaction formula (1). In the chemical reaction formula (1), each of $R_{32}$ and $R_{33}$ represents a hydrogen atom or a substituent. $Z_3$ represents a group capable of forming a 5- or 6-membered heterocyclic ring in cooperation with C═C. $Z_4$ represents a group capable of forming a 5- or 6-membered aryl group or heterocyclic ring in cooperation with C═C. Each of $Z_5$ and $Z_6$ represents a group capable of forming a 5- or 6-membered cycloaliphatic hydrocarbon group or heterocyclic ring in cooperation with C—C. M represents a radical, a radical cation or a cation. In the general formula (11), $R_{32}$, $R_{33}$, $Z_3$ and $Z_4$ have the same meaning as in the chemical reaction formula (1).

Among the compounds of types 1 and 2, "compounds having in the molecule an adsorptive group on silver halides" and "compounds having in the molecule a partial structure of spectral sensitizing dye" are preferred. As representative examples of adsorptive groups on silver halides, there can be mentioned groups described in JP-A-2003-156823, page 16 right column line 1 to page 17 right column line 12. The partial structure of spectral sensitizing dye is as described in the same reference, page 17 right column line 34 to page 18 left column line 6.

Among the compounds of types 1 and 2, "compounds having in the molecule at least one adsorptive group on silver halides" are more preferred. "Compounds having in the same molecule two or more adsorptive groups on silver halides" are still more preferred. When two or more adsorptive groups are present in a single molecule, they may be identical with or different from each other.

As preferred adsorptive groups, there can be mentioned a mercapto-substituted nitrogenous heterocyclic group (e.g., 2-mercaptothiadiazole group, 3-mercapto-1,2,4-triazole group, 5-mercaptotetrazole group, 2-mercapto-1,3,4-oxadiazole group, 2-mercaptobenzoxazole group, 2-mercaptobenzothiazole group or 1,5-dimethyl-1,2,4-triazoium-3-thiolate group) and a nitrogenous heterocyclic group capable of forming an iminosilver (>NAg) and having —NH— as a partial structure of heterocycle (e.g., benzotriazole group, benzimidazole group or indazole group). Among these, a 5-mercaptotetrazole group, a 3-mercapto-1,2,4-triazole group and a benzotriazole group are more preferred. A 3-mercapto-1,2,4-triazole group and a 5-mercaptotetrazole group are most preferred.

An adsorptive group having two or more mercapto groups as a partial structure in the molecule is also especially preferred. The mercapto group (—SH) when tautomerizable may be in the form of a thione group. As preferred examples of adsorptive groups each having two or more mercapto groups as a partial structure (e.g., dimercapto-substituted nitrogenous heterocyclic groups), there can be mentioned a 2,4-dimercaptopyrimidine group, a 2,4-dimercaptotriazine group and a 3,5-dimercapto-1,2,4-triazole group.

Moreover, a quaternary salt structure of nitrogen or phosphorus can preferably be used as the adsorptive group. As the quaternary salt structure of nitrogen, there can be mentioned, for example, an ammonio group (such as trialkylammonio, dialkylaryl(heteroaryl)ammonio or alkyldiaryl(heteroaryl) ammonio) or a group containing a nitrogenous heterocyclic group containing a quaternarized nitrogen atom.

As the quaternary salt structure of phosphorus, there can be mentioned, a phosphonio group (such as trialkylphosphonio, dialkylaryl(heteroaryl)phosphonio, alkyldiaryl(heteroaryl) phosphonio or triaryl(heteroaryl)phosphonio). Among these, the quaternary salt structure of nitrogen is more preferred. The 5- or 6-membered nitrogenous aromatic heterocyclic group containing a quaternarized nitrogen atom is still more preferred. A pyridinio group, a quinolinio group and an isoquinolinio group are most preferred. The above nitrogenous heterocyclic group containing a quaternarized nitrogen atom may have any arbitrary substituent.

As examples of counter anions to the quaternary salts, there can be mentioned a halide ion, a carboxylate ion, a sulfonate ion, a sulfate ion, aperchlorate ion, a carbonate ion, a nitrate ion, $BF_4^-$, $PF_6^-$ and $Ph_4B^-$. When in the molecule a group with negative charge is had by carboxylate, etc., an intramolecular salt may be formed therewith. A chloro ion, a bromo ion or a methanesulfonate ion is most preferred as a counter anion not present in the molecule.

Among the compounds of types 1 and 2 having the structure of quaternary salt of nitrogen or phosphorus as the adsorptive group, preferred structures can be represented by the general formula (X).

$$(P\text{-}Q_1\text{-})_i\text{—}R(\text{-}Q_2\text{-}S)_j \qquad \text{General formula (X)}$$

In the general formula (X), each of P and R independently represents the structure of quaternary salt of nitrogen or phosphorus, which is not a partial structure of sensitizing dye. Each of $Q_1$ and $Q_2$ independently represents a linking group, which may be, for example, a single bond, an alkylene group, an arylene group, a heterocyclic group, —O—, —S—, —$NR_N$—, —C(=O)—, —$SO_2$—, —SO— and —P(=O)—, these used individually or in combination. $R_N$ represents a hydrogen atom, an alkyl group, an aryl group or a heterocyclic group. S represents a residue resulting from removal of one atom from the compound of type 1 or type 2. Each of i and j is an integer of 1 or greater, provided that i+j is in the range of 2 to 6. i=1 to 3 while j=1 to 2 is preferred, i=1 or 2 while j=1 is more preferred, and i=j=1 is most preferred. With respect to the compounds represented by the general formula (X), the total number of carbon atoms thereof is preferably in the range of 10 to 100, more preferably 10 to 70, still more preferably 11 to 60, and most preferably 12 to 50.

The compounds of type 1 and type 2 will be described below. Of course, the present invention is not limited to these.

1

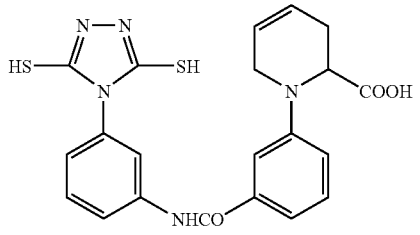

2

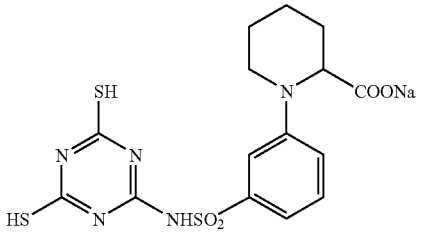

3

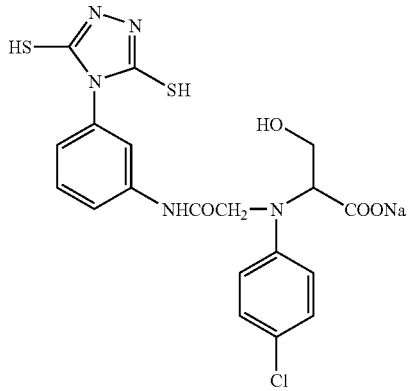

4

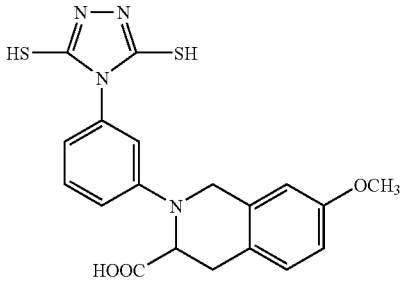

-continued
5
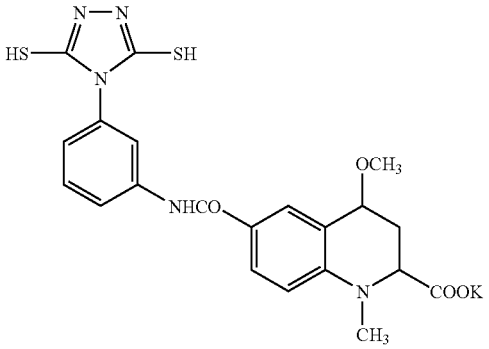
6
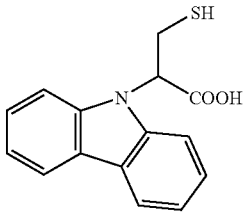
7
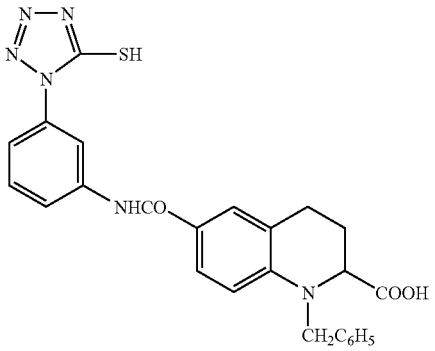
8
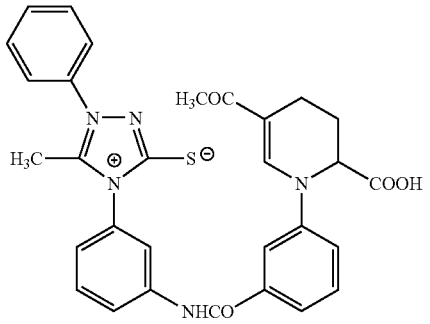
9
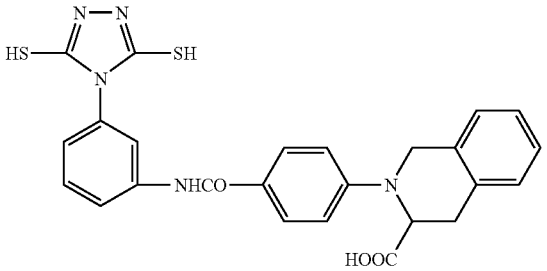
10
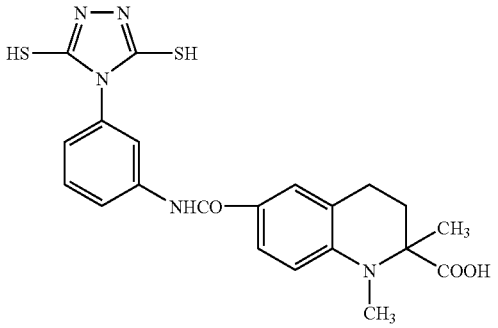
11
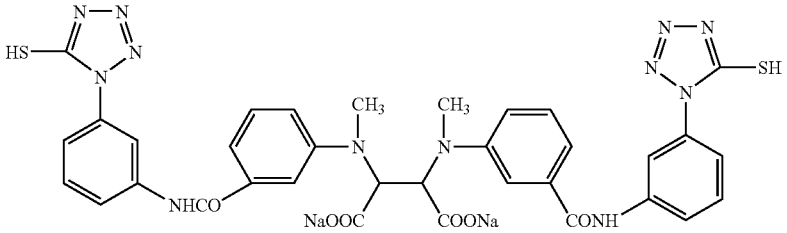
12
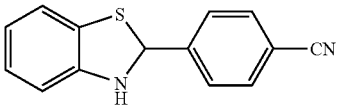
13
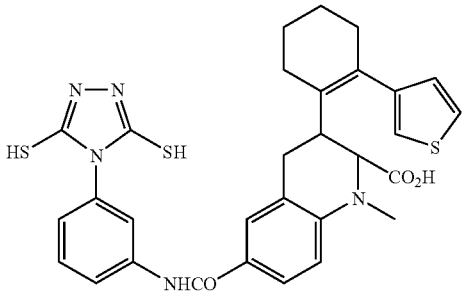

-continued
14
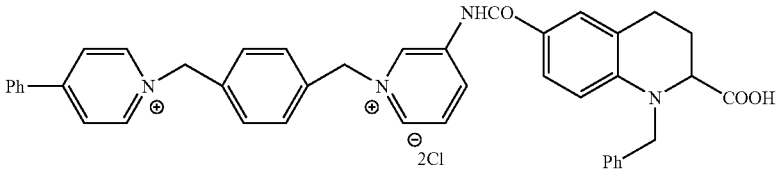
15
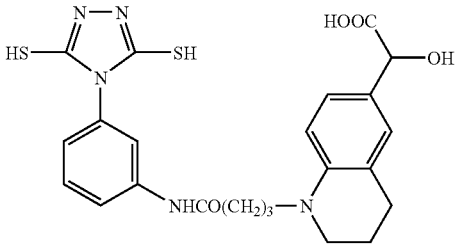
16
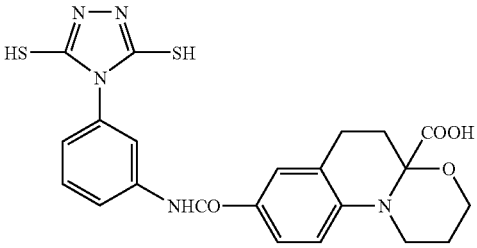
17
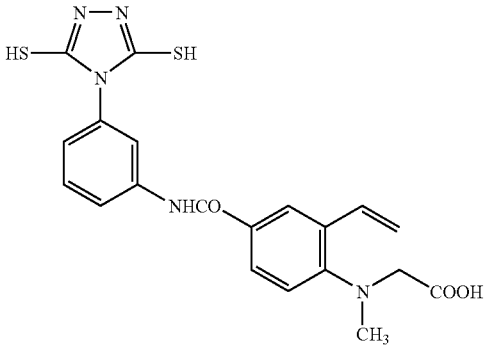
18
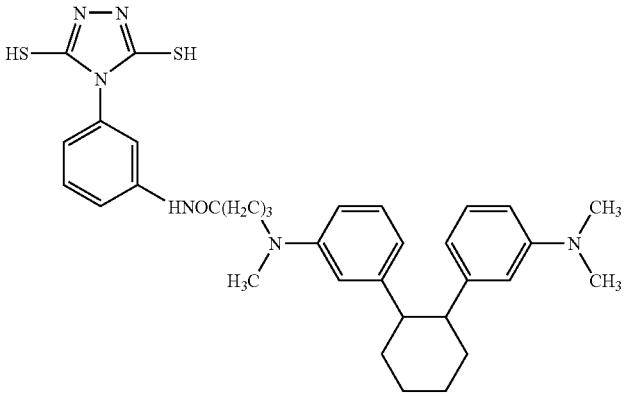
19
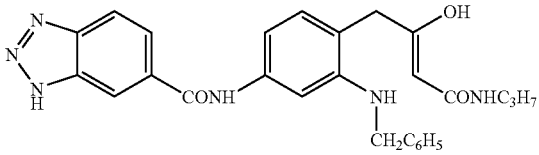
20
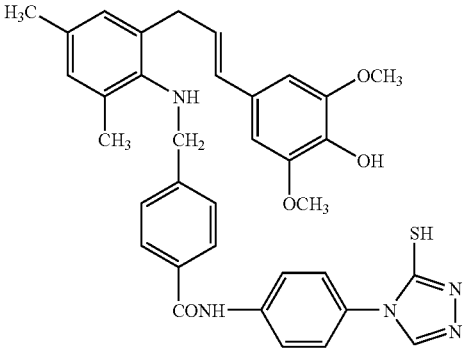

-continued
21
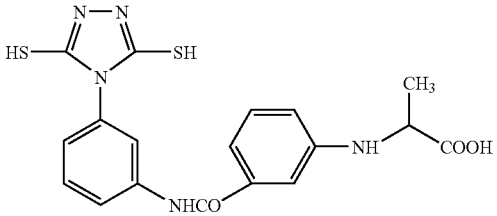
22
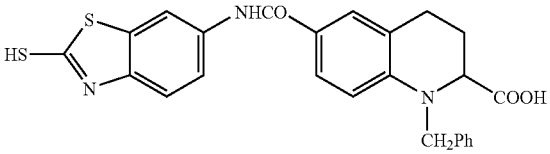
23
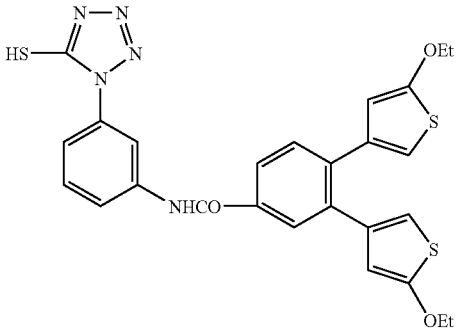
24
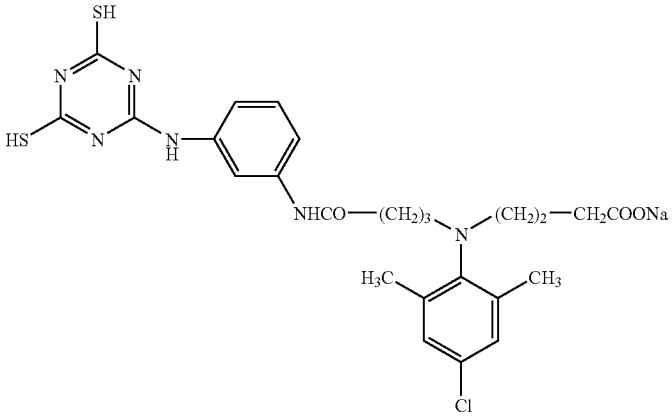
25
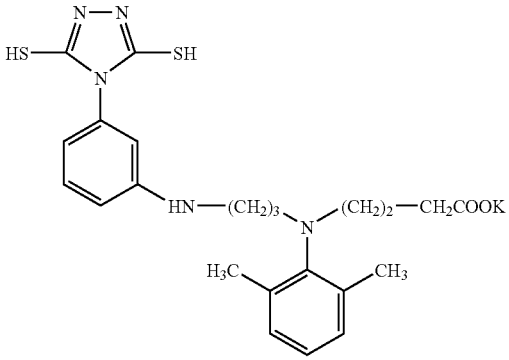
26
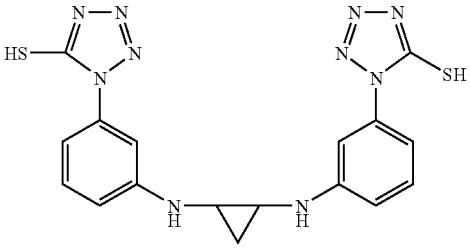

-continued
27
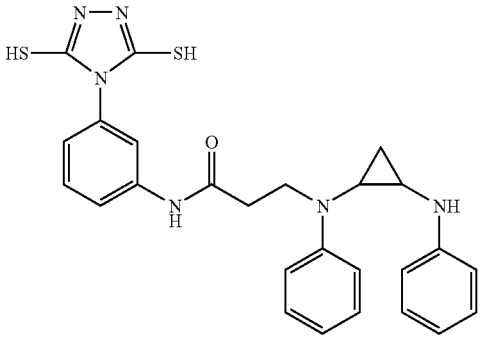
28
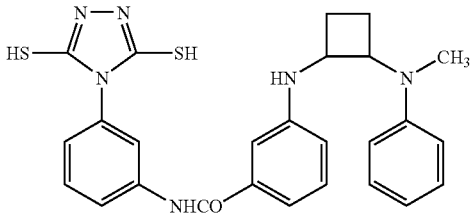
29
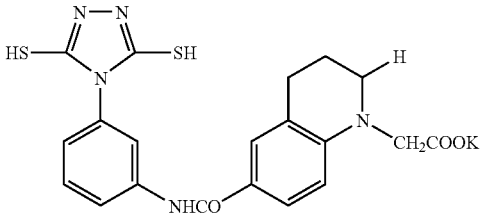
30
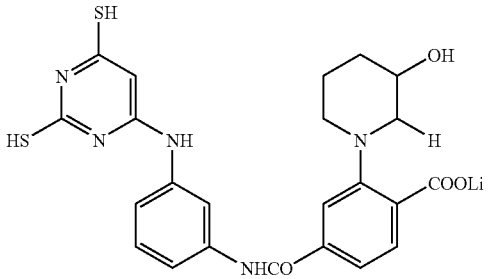
31
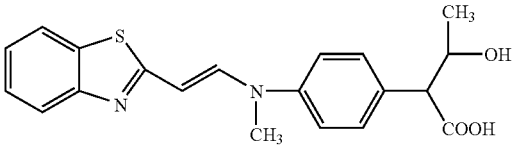
32
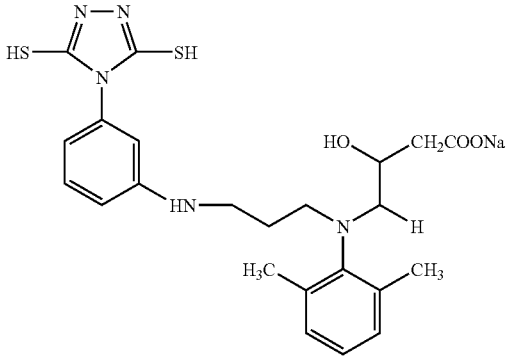
33
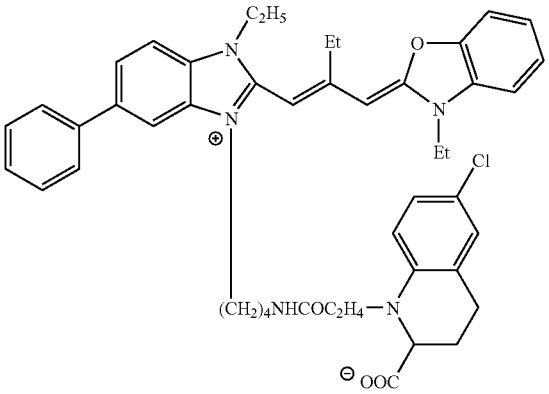

-continued
34
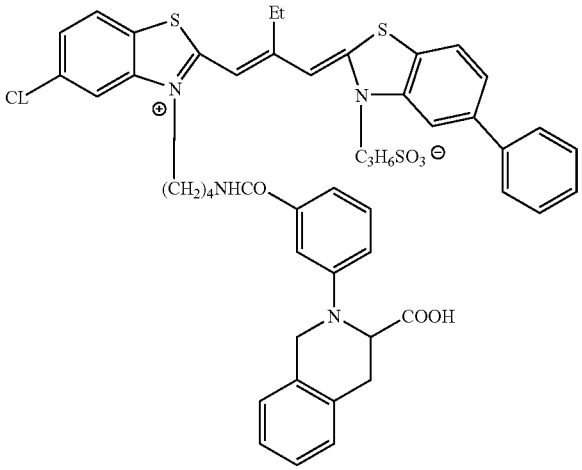
35
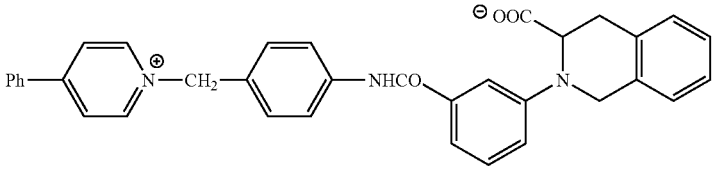
36
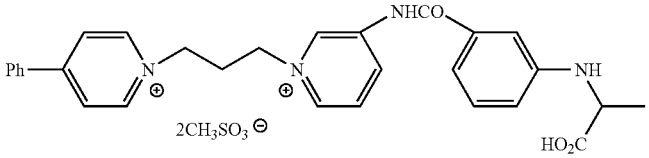
37
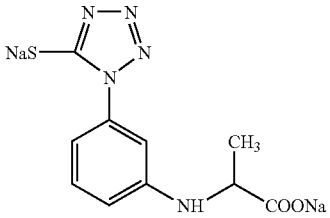
38
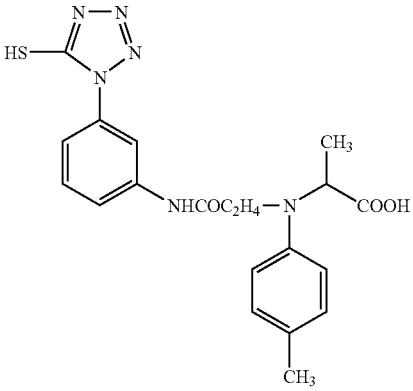
39
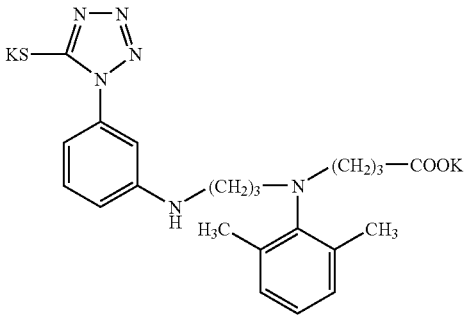
40
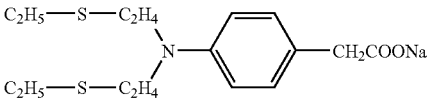

-continued
41
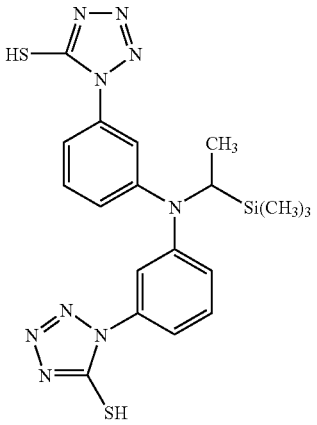
42
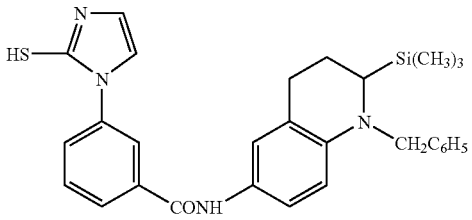
43
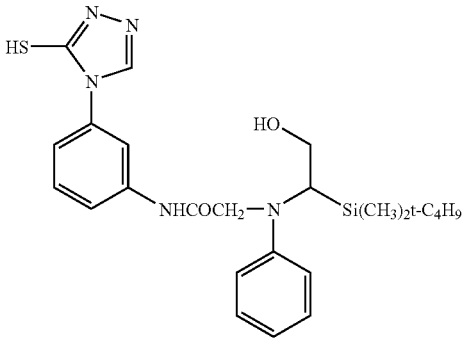
44
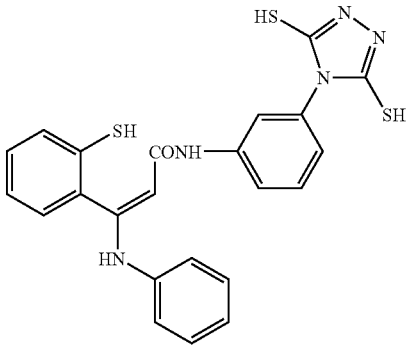
45
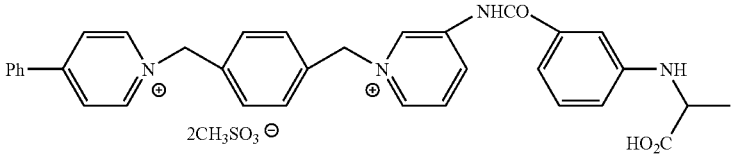
46
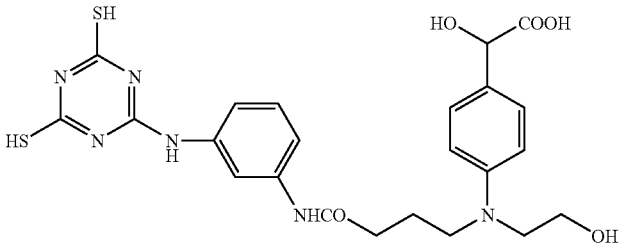
47
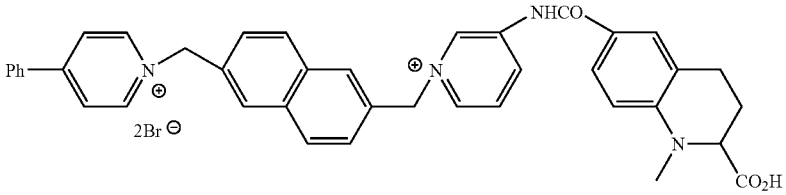

-continued
48
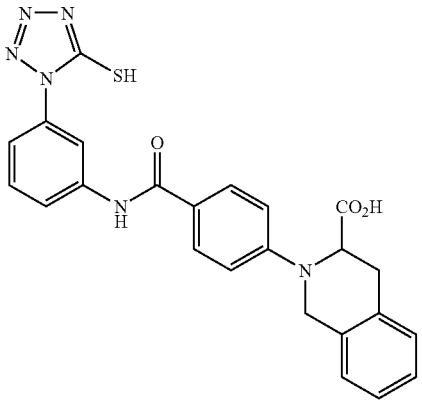
49
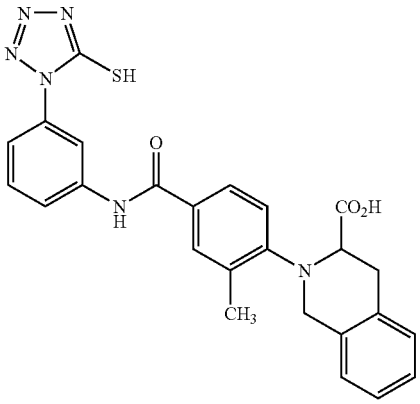
50
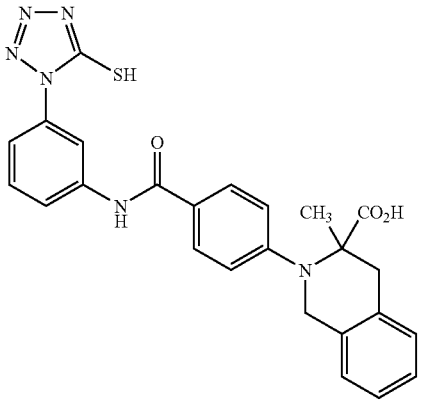
51
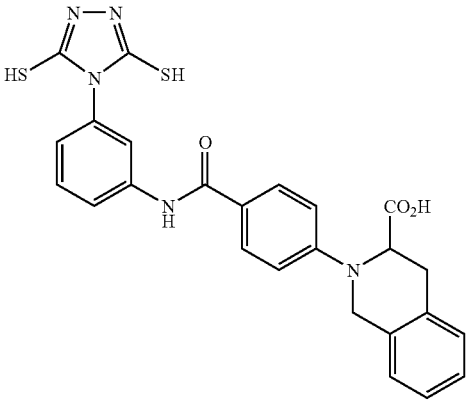
52
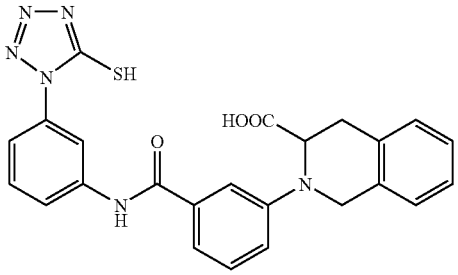
53
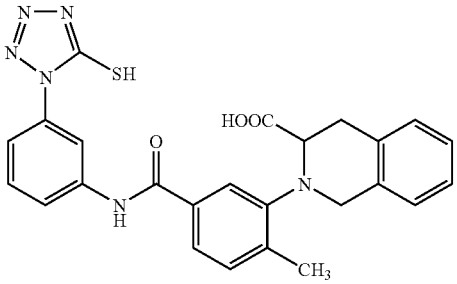
54
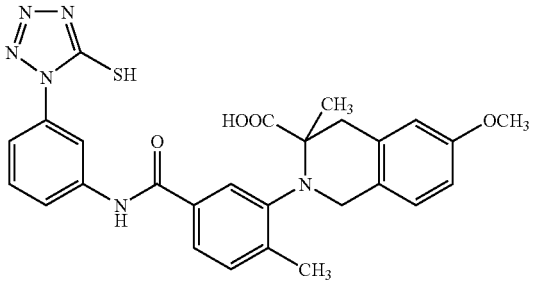
55
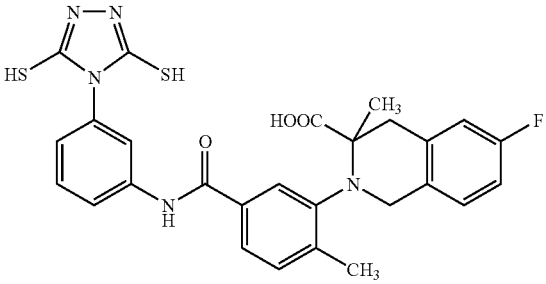
56
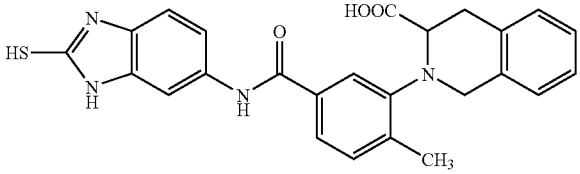

-continued

57

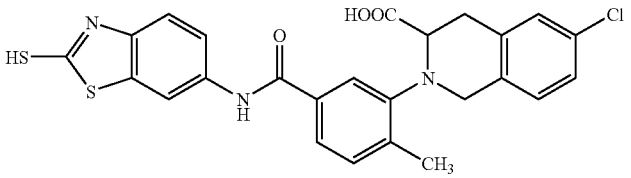

58

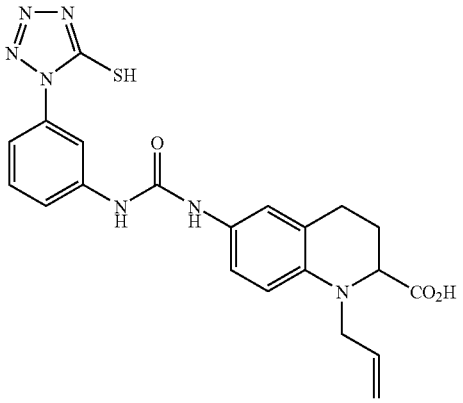

59

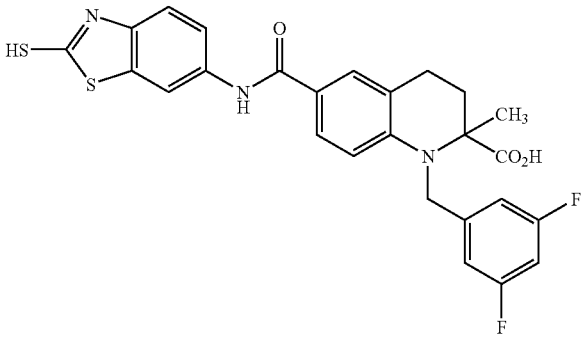

60

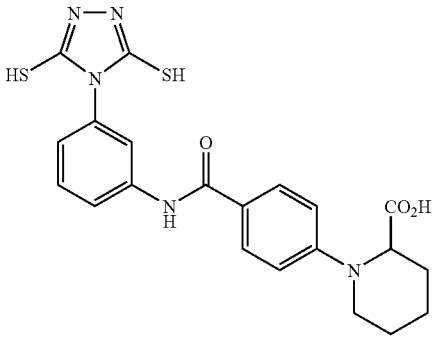

61

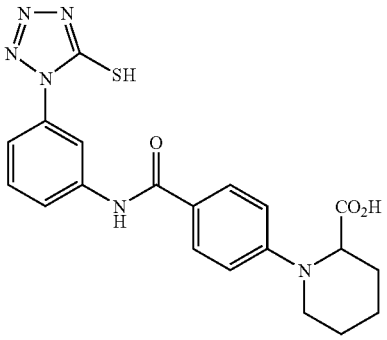

The compounds of type 1 and type 2 according to the present invention may be added at any stage during the emulsion preparation or photosensitive material production. For example, the addition may be effected at grain formation, desalting, chemical sensitization or prior to coating.

The compounds may be divided and added in multiple times during the above stages. The addition stage is preferably after completion of grain formation but before desalting, during chemical sensitization (just before initiation of chemical sensitization to just after termination thereof) or prior to coating. The addition stage is more preferably during chemical sensitization or prior to coating.

The compounds of type 1 and type 2 according to the present invention are preferably dissolved in water, a water soluble solvent such as methanol or ethanol or a mixed solvent thereof before addition. In the dissolving in water, with respect to compounds whose solubility is higher at higher or lower pH value, the dissolution is effected at pH value raised or lowered before addition.

The compounds of type 1 and type 2 according to the present invention, although preferably incorporated in emulsion layers, may be added to not only an emulsion layer but also a protective layer or an interlayer so as to realize diffusion at the time of coating operation. The timing of addition of compounds of the present invention may be before or after sensitizing dye addition, and at either stage the compounds are preferably incorporated in silver halide emulsion layers in an amount of $1\times10^{-9}$ to $5\times10^{-2}$ mol, more preferably $1\times10^{-8}$ to $2\times10^{-3}$ mol per mol of silver halides.

In the photosensitive material which can be used for the method of the present invention, at least one blue-sensitive layer, at least one green-sensitive layer, and at least one red-sensitive layer can be formed on a support. A typical example is a silver halide photosensitive material having, on a support, at least one blue, green and red sensitive layer each consisting of a plurality of silver halide emulsion layers sensitive to substantially the same color but different in sensitivity, and at least one non-light-sensitive layer. This sensitive layer is a unit sensitive layer sensitive to one of blue light, green light, and red light. In a multilayered silver halide color photographic light-sensitive material, sensitive layers are generally arranged in the order of red-, green-, and blue-sensitive layers from a support. However, according to the intended use, this order of arrangement can be reversed, or sensitive layers sensitive to the same color can sandwich another sensitive layer sensitive to a different color. Non-light-sensitive layers can be formed between the silver halide sensitive layers and as the uppermost layer and the lowermost layer. These non-light-sensitive layers can contain, e.g., couplers, DIR compounds, and color amalgamation inhibitors to be described later. As a plurality of silver halide emulsion layers constituting each unit sensitive layer, as described in DE1,121,470 or GB923,045, the disclosures of which are incorporated herein by reference, high- and low-speed emulsion layers are preferably arranged such that the sensitivity is sequentially decreased toward a support. Also, as described in JP-A's-57-112751, 62-200350, 62-206541, and 62-206543, layers can be arranged such that a low-speed emulsion layer is formed apart from a support and a high-speed layer is formed close to the support.

More specifically, layers can be arranged, from the one farthest from a support, in the order of a low-speed blue-sensitive layer (BL)/high-speed blue-sensitive layer (BH)/high-speed green-sensitive layer (GH)/low-speed green-sensitive layer (GL)/high-speed red-sensitive layer (RH)/low-speed red-sensitive layer (RL), the order of BH/BL/GL/GH/RH/RL, or the order of BH/BL/GH/GL/RL/RH.

In addition, as described in JP-B-55-34932, layers can be arranged in the order of a blue-sensitive layer/GH/RH/GL/RL from the one farthest from a support. Furthermore, as described in JP-A's-56-25738 and 62-63936, layers can be arranged in the order of a blue-sensitive layer/GL/RL/GH/RH from the one farthest from a support.

As described in JP-B-49-15495, three layers can be arranged such that a silver halide emulsion layer having the highest sensitivity is arranged as an upper layer, a silver halide emulsion layer having sensitivity lower than that of the upper layer is arranged as an interlayer, and a silver halide emulsion layer having sensitivity lower than that of the interlayer is arranged as a lower layer, i.e., three layers having different sensitivities can be arranged such that the sensitivity is sequentially decreased toward a support. When the layer structure is thus constituted by three layers having different sensitivities, these three layers can be arranged, in the same color-sensitive layer, in the order of a medium-speed emulsion layer/high-speed emulsion layer/low-speed emulsion layer from the one farthest from a support as described in JP-A-59-202464.

In addition, the order of a high-speed emulsion layer/low-speed emulsion layer/medium-speed emulsion layer or low-speed emulsion layer/medium-speed emulsion layer/high-speed emulsion layer can be used.

Furthermore, the arrangement can be changed as described above even when four or more layers are formed.

In a light-sensitive material of the present invention, it is possible to mix, in a single layer, two or more types of emulsions different in at least one of the characteristics, i.e., the grain size, grain size distribution, halogen composition, grain shape, and sensitivity, of a sensitive silver halide emulsion.

It is also preferable to apply surface-fogged silver halide grains described in U.S. Pat. No. 4,082,553, internally fogged silver halide grains described in U.S. Pat. No. 4,626,498 and JP-A-59-214852, and colloidal silver, to light-sensitive silver halide emulsion layers and/or substantially non-light-sensitive hydrophilic colloid layers. The internally fogged or surface-fogged silver halide grain means a silver halide grain which can be developed uniformly (non-imagewise) regardless of whether the location is a non-exposed portion or an exposed portion of the light-sensitive material. A method of preparing the internally fogged or surface-fogged silver halide grain is described in U.S. Pat. No. 4,626,498 and JP-A-59-214852. A silver halide which forms the core of the internally fogged core/shell type silver halide grain can have a different halogen composition. As the internally fogged or surface-fogged silver halide, any of silver chloride, silver chlorobromide, silver iodobromide, and silver bromochloroiodide can be used. The average grain size of these fogged silver halide grains is preferably 0.01 to 0.75 μm, and most preferably, 0.05 to 0.6 μm. The grain shape can be a regular grain shape. Although the emulsion can be a polydisperse emulsion, it is preferably a monodisperse emulsion (in which at least 95% in weight, or number, of silver halide grains have grain sizes falling within the range of ±40% of the average grain size).

In the present invention, a non-light-sensitive fine-grain silver halide is preferably used. The non-light-sensitive fine-grain silver halide preferably consists of silver halide grains which are not exposed during imagewise exposure for obtaining a dye image and are not substantially developed during development. These silver halide grains are preferably not fogged in advance. In the fine-grain silver halide, the content of silver bromide is 0 to 100 mol %, and silver chloride and/or silver iodide can be added if necessary. The fine-grain silver halide preferably contains 0.5 to 10 mol % of silver iodide. The average grain size (the average value of equivalent-circle diameters of projected areas) of the fine-grain silver halide is preferably 0.01 to 0.5 μm, and more preferably, 0.02 to 0.2 μm.

The fine-grain silver halide can be prepared following the same procedures as for a common light-sensitive silver halide. The surface of each silver halide grain may be either spectrally sensitized/chemically sensitized or not spectrally sensitized/chemically sensitized. Further, before the silver halide grains are added to a coating solution, it is preferable to add a well-known stabilizer such as a triazole-based compound, azaindene-based compound, benzothiazolium-based compound, mercapto-based compound, or zinc compound. Colloidal silver can be added to this fine-grain silver halide grain-containing layer.

From the viewpoint of improvement of the sharpness, the silver coating amount of a photosensitive material of the present invention is preferably 0.5 to 8.0 g/m$^2$, more preferably 1.0 to 5.0 g/m$^2$, and most preferably 1.5 to 3.0 g/m$^2$.

Photographic additives usable in the present invention are also described in RDs, and the relevant portions are summarized in the following table.

| | Additives | | RD18716 |
|---|---|---|---|
| | | RD17643 | |
| 1. | Chemical sensitizers | page 23 | page 648, right column |
| 2. | Sensitivity increasing agents | | page 648, right column |
| 3. | Spectral sensitizers, super sensitizers | pages 23-24 | page 648, right column to page 649, right column |
| 4. | Brighteners | page 24 | page 647, right column |
| 5. | Light absorbents, filter dyes, ultraviolet absorbents | pages 25-26 | page 649, right column to page 650, left column |
| 6. | Binders | page 26 | page 651, left column |
| 7. | Plasticizers, lubricants | page 27 | page 650, right column |
| 8. | Coating aids, surface active agents | pages 26-27 | page 650, right column |
| 9. | Antistatic agents | page 27 | page 650, right column |
| 10. | Matting agents | | |
| | | RD307105 | |
| 1. | Chemical sensitizers | page 866 | |
| 2. | Sensitivity increasing agents | | |
| 3. | Spectral sensitizers, super sensitizers | pages 866-868 | |
| 4. | Brighteners | page 868 | |
| 5. | Light absorbent, filter dye, ultraviolet absorbents | page 873 | |
| 6. | Binder | pages 873-874 | |
| 7. | Plasticizers, lubricants | page 876 | |
| 8. | Coating aids, surface active agents | pages 875-876 | |
| 9. | Antistatic agents | pages 876-877 | |
| 10. | Matting agent | pages 878-879 | |

Various dye forming couplers can be used in a light-sensitive material of the present invention, and the following couplers are particularly preferable.

Yellow couplers: couplers represented by formulas (I) and (II) in EP502,424A; couplers (particularly Y-28 on page 18) represented by formulas (1) and (2) in EP513,496A; a coupler represented by formula (I) in claim 1 of EP568,037A; a coupler represented by formula (I) in column 1, lines 45 to 55 of U.S. Pat. No. 5,066,576; a coupler represented by formula (I) in paragraph 0008 of JP-A-4-274425; couplers (particularly D-35 on page 18) described in claim 1 on page 40 of EP498,381A1; couplers (particularly Y-1 (page 17) and Y-54 (page 41)) represented by formula (Y) on page 4 of EP447,969A1; and couplers (particularly II-17 and II-19 (column 17), and II-24 (column 19)) represented by formulas (II) to (IV) in column 7, lines 36 to 58 of U.S. Pat. No. 4,476,219, the disclosures of which are incorporated herein by reference.

Magenta couplers except compounds represented by general formulas (I) and (Z) of the present invention: JP-A-3-39737 (L-57 (page 11, lower right column), L-68 (page 12, lower right column), and L-77 (page 13, lower right column); [A-4]-63 (page 134), and [A-4]-73 and [A-4]-75 (page 139) in EP456,257; M-4 and M-6 (page 26), and M-7 (page 27) in EP486,965; M-45 (page 19) in EP571,959A; (M-1) (page 6) in JP-A-5-204106; and M-22 in paragraph 0237 of JP-A-4-362631, the disclosures of which are incorporated herein by reference.

Cyan couplers: CX-1, CX-3, CX-4, CX-5, CX-11, CX-12, CX-14, and CX-15 (pages 14 to 16) in JP-A-4-204843; C-7 and C-10 (page 35), C-34 and C-35 (page 37), and (I-1) and (I-17) (pages 42 and 43) in JP-A-4-43345; and couplers represented by formulas (Ia) and (Ib) in claim 1 of JP-A-6-67385, the disclosures of which are incorporated herein by reference.

Polymer couplers: P-1 and P-5 (page 11) in JP-A-2-44345, the disclosure of which is incorporated herein by reference.

Couplers for forming a colored dye with proper diffusibility are preferably those described in U.S. Pat No. 4,366,237, GB2,125,570, EP96,873B, and DE3,234,533, the disclosures of which are incorporated herein by reference.

Couplers for correcting unnecessary absorption of a colored dye are preferably yellow colored cyan couplers (particularly YC-86 on page 84) represented by formulas (CI), (CII), (CIII), and (CIV) described on page 5 of EP456,257A1; yellow colored magenta couplers ExM-7 (page 202), EX-1 (page 249), and EX-7 (page 251) described in EP456,257A1; magenta colored cyan couplers CC-9 (column 8) and CC-13 (column 10) described in U.S. Pat. No. 4,833,069; (2) (column 8) in U.S. Pat. No. 4,837,136; and colorless masking couplers (particularly compound examples on pages 36 to 45) represented by formula (A) in claim 1 of WO92/11575, the disclosures of which are incorporated herein by reference.

Examples of compounds (including a coupler) which react with a developing agent in an oxidized form to thereby release a photographically useful compound residue are as follows.

Development inhibitor release compounds: compounds (particularly T-101 (page 30), T-104 (page 31), T-113 (page 36), T-131 (page 45), T-144 (page 51), and T-158 (page 58)) represented by formulas (I), (II), (III), (IV) described on page 11 of EP378,236A1, compounds (particularly D-49 (page 51)) represented by formula (I) described on page 7 of EP436,938A2, compounds (particularly (23) (page 11)) represented by formula (1) in EP568,037A, and compounds (particularly I-(1) on page 29) represented by formulas (I), (II), and (III) described on pages 5 and 6 of EP440,195A2; bleaching accelerator release compounds: compounds (particularly (60) and (61) on page 61) represented by formulas (I) and (I') on page 5 of EP310,125A2, and compounds (particularly (7) (page 7)) represented by formula (I) in claim 1 of JP-A-6-59411; ligand release compounds: compounds (particularly compounds in column 12, lines 21 to 41) represented by LIG-X described in claim 1 of U.S. Pat. No. 4,555,478; leuco dye release compounds: compounds 1 to 6 in columns 3 to 8 of U.S. Pat. No. 4,749,641; fluorescent dye release compounds: compounds (particularly compounds 1 to 11 in columns 7 to 10) represented by COUP-DYE in claim 1 of U.S. Pat. No. 4,774,181; development accelerator or fogging agent release compounds: compounds (particularly (I-22) in column 25) represented by formulas (1), (2), and (3) in column 3 of U.S. Pat. No. 4,656,123, and ExZK-2 on page 75, lines 36 to 38 of EP450,637A2;

compounds which release a group which does not function as a dye unless it splits off: compounds (particularly Y-1 to Y-19 in columns 25 to 36) represented by formula (I) in claim 1 of U.S. Pat. No. 4,857,447, the disclosures of which are incorporated herein by reference.

Preferred examples of additives other than couplers are as follows.

Dispersants of oil-soluble organic compounds: P-3, P-5, P-16, P-19, P-25, P-30, P-42, P-49, P-54, P-55, P-66, P-81, P-85, P-86, and P-93 (pages 140 to 144) in JP-A-62-215272;

impregnating latexes of oil-soluble organic compounds: latexes described in U.S. Pat. No. 4,199,363;

developing agent oxidized form scavengers: compounds (particularly I-(1), I-(2), I-(6), and I-(12) (columns 4 and 5)) represented by formula (I) in column 2, lines 54 to 62 of U.S. Pat. No. 4,978,606, and formulas (particularly a compound 1 (column 3)) in column 2, lines 5 to 10 of U.S. Pat. No. 4,923,787;

blotting inhibitors: formulas (I) to (III) on page 4, lines 30 to 33, particularly I-47, I-72, III-1, and III-27 (pages 24 to 48) in EP298321A;

discoloration inhibitors: A-6, A-7, A-20, A-21, A-23, A-24, A-25, A-26, A-30, A-37, A-40, A-42, A-48, A-63, A-90, A-92, A-94, and A-164 (pages 69 to 118) in EP298321A, II-1 to III-23, particularly III-10 in columns 25 to 38 of U.S. Pat. No. 5,122,444, I-1 to III-4, particularly II-2 on pages 8 to 12 of EP471347A, and A-1 to A-48, particularly A-39 and A-42 in columns 32 to 40 of U.S. Pat. No. 5,139,931;

materials which reduce the use amount of a color enhancer or a color amalgamation inhibitor: I-1 to II-15, particularly I-46 on pages 5 to 24 of EP411324A; formalin scavengers: SCV-1 to SCV-28, particularly SCV-8 on pages 24 to 29 of EP477932A;

film hardeners: H-1, H-4, H-6, H-8, and H-14 on page 17 of JP-A-1-214845, compounds (H-1 to H-54) represented by formulas (VII) to (XII) in columns 13 to 23 of U.S. Pat. No. 4,618,573, compounds (H-1 to H-76), particularly H-14 represented by formula (6) on page 8, lower right column of JP-A-2-214852, and compounds described in claim 1 of U.S. Pat. No. 3,325,287;

development inhibitor precursors: P-24, P-37, and P-39 (pages 6 and 7) in JP-A-62-168139; compounds described in claim 1, particularly 28 and 29 in column 7 of U.S. Pat. No. 5,019,492; antiseptic agents and mildewproofing agents: I-1 to III-43, particularly II-1, II-9, II-10, II-18, and III-25 in columns 3 to 15 of U.S. Pat. No. 4,923,790;

stabilizers and antifoggants: I-1 to (14), particularly I-1, I-60, (2), and (13) in columns 6 to 16 of U.S. Pat. No. 4,923,793, and compounds 1 to 65, particularly the compound 36 in columns 25 to 32 of U.S. Pat. No. 4,952,483;

chemical sensitizers: triphenylphosphine selenide and a compound 50 in JP-A-5-40324;

dyes: a-1 to b-20, particularly a-1, a-12, a-18, a-27, a-35, a-36, and b-5 on pages 15 to 18 and V-1 to V-23, particularly V-1 on pages 27 to 29 of JP-A-3-156450, F-I-1 to F-II-43, particularly F-I-11 and F-II-8 on pages 33 to 55 of EP445627A, III-1 to III-36, particularly III-1 and III-3 on pages 17 to 28 of EP457153A, fine-crystal dispersions of Dye-1 to Dye-124 on pages 8 to 26 of WO88/04794, compounds 1 to 22, particularly the compound 1 on pages 6 to 11 of EP319999A, compounds D-1 to D-87 (pages 3 to 28) represented by formulas (1) to (3) in EP519306A, compounds 1 to 22 (columns 3 to 10) represented by formula (I) in U.S. Pat. No. 4,268,622, and compounds (1) to (31) (columns 2 to 9) represented by formula (I) in U.S. Pat. No. 4,923,788;

UV absorbents: compounds (18b) to (18r) and 101 to 427 (pages 6 to 9) represented by formula (1) in JP-A-46-3335, compounds (3) to (66) (pages 10 to 44) and compounds HBT-1 to HBT-10 (page 14) represented by formula (III) in EP520938A, and compounds (1) to (31) (columns 2 to 9) represented by formula (1) in EP521823A, the disclosures of which are incorporated herein by reference.

Supports which can be suitably used in the present invention are described in, e.g., RD. No. 17643, page 28; RD. No. 18716, from the right column of page 647 to the left column of page 648; and RD. No. 307105, page 879.

In the photosensitive material of the present invention, the thickness of photosensitive silver halide layer closest to the support through surface of the photosensitive material is preferably 24 μm or less, more preferably 22 μm or less, and most preferably 20 μm or less. Film swelling speed $T_{1/2}$ is preferably 30 sec or less, more preferably 20 sec or less. The film swelling speed $T_{1/2}$ is defined as the time that when the saturation film thickness refers to 90% of the maximum swollen film thickness attained by the processing in a color developer at 30° C. for 3 min 15 sec, is spent for the film thickness to reach ½ of the saturation film thickness. The film thickness means one measured under moisture conditioning at 25° C. in a relative humidity of 55% (two days). The film swelling speed $T_{1/2}$ can be measured by using a swellometer described in A. Green et al., Photogr. Sci. Eng., Vol. 19, No. 2, pp. 124 to 129. The film swelling speed $T_{1/2}$ can be regulated by adding a film hardener to gelatin as a binder, or by changing aging conditions after coating. The swelling ratio preferably ranges from 150 to 400%. The swelling ratio can be calculated from the maximum swollen film thickness measured under the above conditions in accordance with the formula:

(maximum swollen film thickness−film thickness)/film thickness.

In the photosensitive material of the present invention, hydrophilic colloid layers (referred to as "back layers") having a total dry film thickness of 2 to 20 μm are preferably provided on the side opposite to the side having emulsion layers. These back layers preferably contain the aforementioned light absorbent, filter dye, ultraviolet absorbent, antistatic agent, film hardener, binder, plasticizer, lubricant, coating aid and surfactant. The swelling ratio of these back layers is preferably in the range of 150 to 500%.

A polyester support used in the present invention will be described below. Details of the polyester support and light-sensitive materials, processing, cartridges, and examples (to be described later) are described in Journal of Technical Disclosure No. 94-6023 (JIII; Mar. 15, 1994), the disclosure of which is incorporated herein by reference. Polyester used in the present invention is formed by using diol and aromatic dicarboxylic acid as essential components. Examples of the aromatic dicarboxylic acid are 2,6-, 1,5-, 1,4-, and 2,7-naphthalenedicarboxylic acids, terephthalic acid, isophthalic acid, and phthalic acid. Examples of the diol are diethyleneglycol, triethyleneglycol, cyclohexanedimethanol, bisphenol A, and bisphenol. Examples of the polymer are homopolymers such as polyethyleneterephthalate, polyethylenenaphthalate, and polycyclohexanedimethanolterephthalate. Polyester containing 50 to 100 mol % of 2,6-naphthalenedicarboxylic acid is particularly preferred. Polyethylene-2,6-naphthalate is most preferred among other polymers. The average molecular weight ranges between about 5,000 and 200,000. The Tg of the polyester of the present invention is 50° C. or higher, preferably 90° C. or higher.

To give the polyester support a resistance to curling, the polyester support is heat-treated at a temperature of preferably 40° C. to less than Tg, and more preferably, Tg −20° C. to less than Tg. The heat treatment can be performed at a fixed temperature within this range or can be performed together with cooling. The heat treatment time is preferably 0.1 to 1500 hr, and more preferably, 0.5 to 200 hr. The heat treatment can be performed for a roll-like support or while a support is conveyed in the form of a web. The surface shape can also be improved by roughening the surface (e.g., coating the surface with conductive inorganic fine grains such as $SnO_2$ or $Sb_2O_5$). It is desirable to knurl and slightly raise the end portion, thereby preventing the cut portion of the core from being photographed. These heat treatments can be performed in any stage after support film formation, after surface treatment, after back layer coating (e.g., an antistatic agent or lubricating agent), and after undercoating. A favorable timing is after the antistatic agent is coated.

An ultraviolet absorbent can be incorporated into this polyester. Also, to prevent light piping, dyes or pigments such as Diaresin manufactured by Mitsubishi Kasei Corp. or Kayaset manufactured by NIPPON KAYAKU CO. LTD. commercially available for polyester can be incorporated.

In the present invention, it is preferable to perform a surface treatment in order to adhere the support and the light-sensitive material constituting layers. Examples of the surface treatment are surface activation treatments such as a chemical treatment, mechanical treatment, corona discharge treatment, flame treatment, ultraviolet treatment, high-frequency treatment, glow discharge treatment, active plasma treatment, laser treatment, mixed acid treatment, and ozone oxidation treatment. Among other surface treatments, the ultraviolet radiation treatment, flame treatment, corona treatment, and glow treatment are preferred.

An undercoat layer can include a single layer or two or more layers. Examples of an undercoat layer binder are copolymers formed by using, as a starting material, a monomer selected from vinyl chloride, vinylidene chloride, butadiene, methacrylic acid, acrylic acid, itaconic acid, and maleic anhydride. Other examples are polyethyleneimine, an epoxy resin, grafted gelatin, nitrocellulose, and gelatin. Resorcin and p-chlorophenol are examples of a compound which swells a support. Examples of a gelatin hardener added to the undercoat layer are chromium salt (e.g., chromium alum), aldehydes (e.g., formaldehyde and glutaraldehyde), isocyanates, an active halogen compound (e.g., 2,4-dichloro-6-hydroxy-s-triazine), an epichlorohydrin resin, and an active vinylsulfone compound. $SiO_2$, $TiO_2$, inorganic fine grains, or polymethylmethacrylate copolymer fine grains (0.01 to 10 μm) can also be contained as a matting agent.

In the present invention, an antistatic agent is preferably used. Examples of this antistatic agent are carboxylic acid, carboxylate, a macromolecule containing sulfonate, cationic macromolecule, and ionic surfactant compound.

As the antistatic agent, it is most preferable to use fine grains of at least one crystalline metal oxide selected from ZnO, $TiO_2$, $SnO_2$, $Al_2O_3$, $In_2O_3$, $SiO_2$, MgO, BaO, $MoO_3$, and $V_2O_5$, and having a volume resistivity of preferably $10^7$ Ω·cm or less, and more preferably, $10^5$ Ω·cm or less and a grain size of 0.001 to 1.0 μm, fine grains of composite oxides (e.g., Sb, P, B, In, S, Si, and C) of these metal oxides, fine grains of sol metal oxides, or fine grains of composite oxides of these sol metal oxides.

The content in a light-sensitive material is preferably 5 to 500 mg/m$^2$, and particularly preferably, 10 to 350 mg/m$^2$. The ratio of a conductive crystalline oxide or its composite oxide to the binder is preferably 1/300 to 100/1, and more preferably, 1/100 to 100/5.

A light-sensitive material of the present invention preferably has a slip property. Slip agent-containing layers are preferably formed on the surfaces of both a light-sensitive layer and back layer. A preferable slip property is 0.01 to 0.25 as a coefficient of kinetic friction. This represents a value obtained when a stainless steel sphere 5 mm in diameter is conveyed at a speed of 60 cm/min (25° C., 60% RH). In this evaluation, a value of nearly the same level is obtained when the surface of a light-sensitive layer is used as a sample to be measured.

Examples of a slip agent usable in the present invention are polyorganocyloxane, higher fatty acid amide, higher fatty acid metal salt, and ester of higher fatty acid and higher alcohol. As the polyorganocyloxane, it is possible to use, e.g., polydimethylcyloxane, polydiethylcyloxane, polystyrylmethylcyloxane, or polymethylphenylcyloxane. A layer to which the slip agent is added is preferably the outermost emulsion layer or back layer. Polydimethylcyloxane or ester having a long-chain alkyl group is particularly preferred.

A light-sensitive material of the present invention preferably contains a matting agent. This matting agent can be added to either the emulsion surface or back surface and is most preferably added to the outermost emulsion layer. The matting agent can be either soluble or insoluble in processing solutions, and the use of both types of matting agents is preferred. Favorable examples are polymethylmethacrylate grains, poly(methylmethacrylate/methacrylic acid=9/1 or 5/5 (molar ratio)) grains, and polystyrene grains. The grain size is preferably 0.8 to 10 μm, and a narrow grain size distribution is favored. It is preferable that 90% or more of all grains have grain sizes 0.9 to 1.1 times the average grain size. To increase the matting property, it is preferable to simultaneously add fine grains with a grain size of 0.8 μm or smaller. Examples are polymethylmethacrylate grains (0.2 μm), poly(methylmethacrylate/methacrylic acid=9/1 (molar ratio, 0.3 μm) grains, polystyrene grains (0.25 μm), and colloidal silica grains (0.03 μm).

In the present invention, as an image-forming method wherein digital image information is recorded on the silver halide photosensitive material by an analog system, there can be mentioned the contact printing method wherein a silver halide photosensitive material, in which digital image information is recorded, and a silver halide photosensitive material, in which no digital image information is recorded, or an unexposed silver halide photosensitive material are contacted and exposed. An example of device for use in the contact printing method is a Model C printer manufactured by BELL & HOWELL Co., Ltd.

The invention will be described below according to Examples in detail, but the invention is not limited to these Examples.

EXAMPLE 1

(Preparation of Emulsion Em-A)

AgBrI monodisperse cubic emulsion was prepared in accordance with the following. The below-mentioned solution was prepared.

<<Solution A>> Aqueous solution containing 30 g of limed ossein gelatin, 0.4 g of KBr and 1.3 L of water.

<<Solution B>> 0.2 L of aqueous solution containing 20 g of $AgNO_3$.

<<Solution C>> 0.2 L of aqueous solution containing 15 g of KBr and 0.6 g of KI.

<<Solution D>> 0.65 L of aqueous solution containing 162.5 g of $AgNO_3$.

<<Solution E>> 0.7 L of aqueous solution containing 124.8 g of KBr, 5.4 g of KI and 0.6 g of NaCl.

The solution A was charged in a reaction vessel and kept warm at 60° C. to be stirred. 150 mL of the solution B was added over 5 minutes. The solution C was added while controlling its addition amount during this time so that pBr in the reaction vessel was kept at 3.5. After completion of the addition, the temperature of the solution in the reaction vessel was raised to 70° C. Successively, 540 mL of the solution D was added over 15 minutes. During this time, the solution E was added while controlling its addition amount so that pBr in the reaction vessel was kept at 3.5. Further, 0.005 g of thiourea dioxide, 0.005 g of sodium benzenesulfonate and 0.0003 g of $K_2IrCl_6$ were added in the reaction vessel during the addition.

After completion of the addition, a desalting process was carried out by a flocculation process. After completion of the desalting process, the below-mentioned chemical sensitization processing and spectral sensitization processing were carried out. The emulsion after completion of the desalting was kept warm at 60° C., sensitization dyes, potassium thiocyanate, chloroauric acid, sodium thiosulfate, N,N-dimethyl selenourea, 4-hydroxy-6-methyl-1,3,3a, 7-tetraazaindene (TAI), the compounds 1, 2 and 3 were added thereto and spectral sensitization and chemical sensitization were carried out optimally. With respect to the sensitization dyes, an optimum amount of the dyes shown in Table 1 was added while suitably changing their ratios. The particles obtained were cubic particles with an average spherical equivalent diameter of 0.21 μm and a fluctuation coefficient of 12%.

(Preparation of Emulsions Em-B, D, E and G)

Emulsions Em-B, D, E and G were prepared in the same manner as the above-mentioned emulsion Em-A except that the temperature of solutions in the reaction vessel, the compositions and densities of the solutions A to E, the addition speed of the solutions B to E, pBr of the solutions in the reaction vessel, the addition amounts of thiourea dioxide, sodium benzenesulfonate and $K_2IrCl_6$, sensitization dyes after completion of desalting and chemical sensitization were suitably changed in the preparation of the above-mentioned emulsion Em-A.

(Preparation of Emulsion Em-C)

AgBr I monodisperse cubic emulsion was prepared in accordance with the following. The below-mentioned solution was prepared.

<<Solution A>> Aqueous solution containing 30 g of limed ossein gelatin, 0.4 g of KBr and 1.5 L of water.

<<Solution B>> 0.65 L of aqueous solution containing 162.5 g of $AgNO_3$.

<<Solution C>> 0.7 L of aqueous solution containing 125.4 g of KBr, 4.5 g of KI and 0.3 g of NaCl.

The solution A was charged in a reaction vessel and kept warm at 55° C. to be stirred. 540 mL of the solution B was added over 10 minutes. The solution C was added while controlling its addition amount during this time so that pBr in the reaction vessel was kept at 3.5. Further, 0.007 g of thiourea dioxide, 0.007 g of sodium benzenesulfonate and 0.0005 g of $K_2IrCl_6$ were added in the reaction vessel during the addition.

After completion of the addition, a desalting process was carried out by a flocculation process. After completion of the desalting process, the below-mentioned chemical sensitization processing and spectral sensitization processing were carried out. The emulsion after completion of the desalting was kept warm at 62° C., sensitization dyes, chloroauric acid, sodium thiosulfate, 4-hydroxy-6-methyl-1,3,3a, 7-tetraazaindene (TAI), the compounds 1, 2 and 3 were added thereto and spectral sensitization and chemical sensitization were carried out optimally. With respect to the sensitization dyes, an optimum amount of the dyes shown in Table 1 was added while suitably changing their ratios. The particles obtained were cubic particles with an average spherical equivalent diameter of 0.09 μm and a fluctuation coefficient of 13%.

(Preparation of Emulsions Em-F, H and I)

Emulsions Em-F, H and I were prepared in the same manner as the above-mentioned emulsion Em-C except that the temperature of solutions in the reaction vessel, the compositions and densities of the solutions A to C, the addition speed of the solutions B to E, pBr of the solutions in the reaction vessel, the addition amounts of thiourea dioxide, sodium benzenesulfonate and $K_2IrCl_6$, sensitization dyes after completion of desalting and chemical sensitization were suitably changed in the preparation of the above-mentioned emulsion Em-C.

TABLE 1

| Emusion | Grain shape | Average Grain size*1 (μm) | Coefficient of variation(%) of ESD*2 | I content (mol %) | Cl content (mol %) | Sensitizing dye*3 |
|---|---|---|---|---|---|---|
| Em-A | Cube | 0.21 | 12 | 3.5 | 1 | ExS-1 [$7.5 \times 10^{-5}$]/ExS-2 [$3.8 \times 10^{-4}$]/ ExS-3 [$3.0 \times 10^{-4}$] |
| Em-B | Cube | 0.15 | 12 | 3.2 | 0 | ExS-1 [$1.4 \times 10^{-4}$]/ExS-2 ($7.3 \times 10^{-4}$]/ ExS-3 [$5.8 \times 10^{-4}$] |
| Em-C | Cube | 0.09 | 13 | 2.5 | 0.5 | ExS-1 [$2.0 \times 10^{-4}$]/ExS-2 [$1.0 \times 10^{-3}$]/ ExS-3 [$8.0 \times 10^{-4}$] |
| Em-D | Cube | 0.41 | 14 | 3.3 | 0.5 | ExS-4 [$2.5 \times 10^{-4}$]/ExS-5 [$2.5 \times 10^{-4}$]/ ExS-6 [$2.5 \times 10^{-4}$]/ExS-7 [$2.5 \times 10^{-4}$] |
| Em-E | Cube | 0.14 | 14 | 2.8 | 0 | ExS-4 [$4.0 \times 10^{-4}$]/ExS-5 [$4.0 \times 10^{-4}$]/ ExS-6 [$4.0 \times 10^{-4}$]/ExS-7 [$4.0 \times 10^{-4}$] |
| Em-F | Cube | 0.08 | 14 | 2.2 | 0 | ExS-4 [$2.2 \times 10^{-4}$]/ExS-5 [$2.2 \times 10^{-4}$]/ ExS-6 [$2.2 \times 10^{-4}$]/ExS-7 [$2.2 \times 10^{-4}$] |
| Em-G | Cube | 0.34 | 13 | 3.5 | 1 | ExS-8 [$8.8 \times 10^{-5}$]/ExS-9 [$2.8 \times 10^{-5}$]/ ExS-10 [$1.4 \times 10^{-5}$] |
| Em-H | Cube | 0.15 | 15 | 3.5 | 0 | ExS-8 [$4.5 \times 10^{-4}$]/ExS-9 [$1.4 \times 10^{-4}$]/ ExS-10 [$6.8 \times 10^{-5}$] |
| Em-I | Cube | 0.10 | 15 | 3.5 | 0 | ExS-8 [$1.0 \times 10^{-3}$]/ExS-9 [$3.0 \times 10^{-4}$]/ ExS-10 [$1.5 \times 10^{-4}$] |

*1Average grain size is an average equivalent spherical diameter.

*2ESD: equivalent spherical diameter

*3[ ] indicates an addition amount (mol/mol Ag).

(Preparation of a Multilayer Color Photosensitive Material (Sample 101))

One surface of the undercoated cellulose triacetate film support was coated with a back layer having the following composition.

| (Back layer) | |
|---|---|
| Methylmethacrylate-methacrylic acid copolymer (copolymerization molar ratio 1:1) | 1.5 parts by mass |
| Cellulose acetate hexahydrophthalate (4% hydroxypropyl group, 15% methyl group, 8% acetyl group, and 36% phthalyl group) | 1.5 parts by mass |
| Acetone | 50 parts by mass |
| Methanol | 25 parts by mass |
| Methylcellosolve | 25 parts by mass |
| Colloid carbon | 1.2 parts by mass |

Coating solution was prepared at a proportion below and coated so that density was 1.0 for white light.

Undercoating was carried out at a side opposite to a back layer of a support on which the back layer was coated, and a sample 101 which is the multilayer color photosensitive material including respective layers with compositions shown in the following was prepared.

(Composition of Photosensitive Layer)

Coating amounts were shown by the amount of Ag represented by a unit of g/m$^2$ for silver halide and colloidal silver and amounts represented by a unit of g/m$^2$ for a coupler, an additive and gelatin.

| | | |
|---|---|---|
| **1st layer (antihalation layer)** | | |
| Black colloidal silver | silver coating amt. | 0.085 |
| Silver iodobromide emulsion grain (average grain diameter 0.07 μm, silver iodide content 2 mol %) | silver coating amt. | 0.025 |
| Gelatin | | 0.905 |
| **2nd layer (Interlayer)** | | |
| Gelatin | | 2.150 |
| ExF-4 | | 0.690 |
| **3rd layer (Low-speed red-sensitive emulsion layer)** | | |
| Em-I | silver coating amt. | 0.260 |
| Gelatin | | 1.745 |
| ExC-1 | | 0.110 |
| ExC-2 | | 0.164 |
| ExC-3 | | 0.010 |
| ExC-4 | | 0.035 |
| ExC-5 | | 0.036 |
| Cpd-2 | | 0.092 |
| Solv-1 | | 0.380 |
| **4th layer (Medium-speed red-sensitive emulsion layer)** | | |
| Em-H | silver coating amt. | 0.230 |
| Gelatin | | 0.670 |
| ExC-1 | | 0.045 |
| ExC-2 | | 0.050 |
| ExC-3 | | 0.003 |
| ExC-4 | | 0.020 |
| ExC-5 | | 0.003 |
| Cpd-2 | | 0.065 |
| Solv-1 | | 0.170 |
| **5th layer (High-speed red-sensitive emulsion layer)** | | |
| Em-G | silver coating amt. | 0.230 |
| Gelatin | | 1.400 |
| ExC-1 | | 0.110 |
| ExC-2 | | 0.153 |

-continued

| | | |
|---|---|---|
| ExC-3 | | 0.022 |
| ExC-5 | | 0.005 |
| Cpd-2 | | 0.050 |
| Solv-1 | | 0.330 |
| **6th layer (Interlayer)** | | |
| Gelatin | | 1.489 |
| Cpd-1 | | 0.069 |
| ExF-5 | | 0.074 |
| ExF-7 | | 0.005 |
| ExF-8 | | 0.032 |
| Solv-1 | | 0.239 |
| **7th layer (Low-speed green-sensitive emulsion layer)** | | |
| Em-F | silver coating amt. | 0.215 |
| Gelatin | | 1.690 |
| ExM-1 | | 0.309 |
| ExM-3 | | 0.102 |
| Solv-1 | | 0.499 |
| Solv-2 | | 0.052 |
| **8th layer (Medium-speed green-sensitive emulsion layer)** | | |
| Em-E | silver coating amt. | 0.155 |
| Gelatin | | 0.502 |
| ExM-1 | | 0.086 |
| ExM-2 | | 0.033 |
| ExM-3 | | 0.022 |
| Solv-1 | | 0.162 |
| Solv-2 | | 0.017 |
| **9th layer (High-speed green-sensitive emulsion layer)** | | |
| Em-D | silver coating amt. | 0.190 |
| Gelatin | | 0.410 |
| ExM-1 | | 0.063 |
| ExM-2 | | 0.025 |
| ExM-3 | | 0.016 |
| Solv-1 | | 0.135 |
| Solv-2 | | 0.009 |
| **10th layer (Yellow filter layer)** | | |
| Yellow colloidal silver | silver coating amt. | 0.058 |
| Gelatin | | 0.950 |
| Cpd-1 | | 0.105 |
| ExF-8 | | 0.028 |
| Solid disperse dye ExF-9 | | 0.135 |
| Solv-1 | | 0.121 |
| **11th layer (Low-speed blue-sensitive emulsion layer)** | | |
| Em-C | silver coating amt. | 0.105 |
| Em-B | silver coating amt. | 0.030 |
| Gelatin | | 1.514 |
| ExY-1 | | 0.056 |
| ExY-2 | | 0.580 |
| ExC-2 | | 0.008 |
| Solv-1 | | 0.260 |
| **12th layer (Medium-speed blue-sensitive emulsion layer)** | | |
| Em-B | silver coating amt. | 0.120 |
| Gelatin | | 0.859 |
| ExY-1 | | 0.039 |
| ExY-2 | | 0.373 |
| ExC-3 | | 0.009 |
| Solv-1 | | 0.159 |
| **13th layer (High-speed blue-sensitive emulsion layer)** | | |
| Em-A | silver coating amt. | 0.122 |
| Em-B | silver coating amt. | 0.152 |
| Gelatin | | 0.374 |
| ExY-1 | | 0.010 |
| ExY-2 | | 0.121 |
| ExC-3 | | 0.003 |
| Solv-1 | | 0.060 |
| Compound 7 | | $5 \times 10^{-5}$ |
| **14th layer (1st protective layer)** | | |
| Silver iodobromide emulsion grain (average grain diameter 0.07 μm, silver iodide content 2 mol %) | silver coating amt. | 0.211 |

-continued

| | |
|---|---|
| Gelatin | 0.683 |
| Solid disperse dye ExF-9 | 0.054 |
| ExF-1 | 0.073 |
| H-1 | 0.160 |
| 15th layer (2nd protective layer) | |
| Gelatin | 0.727 |
| B-1 (diameter 2.0 μm) | 0.007 |
| B-2 (diameter 2.0 μm) | 0.005 |
| B-3 | 0.047 |
| H-1 | 0.170 |

In addition to the above components, 1,2-benzthiazoline-3-on (200 ppm based on a gelatin on average), n-butyl-p-hydroxy benzoate (about 1000 ppm based on the same above-mentioned), and 2-phenoxyethanol (about 10000 ppm based on the same above-mentioned) were added to sample 101.

Furthermore, Cpd-3 to Cpd-7, B-4, B-5, W-1 to W-13, F-1 to F-21, ExF-2, ExF-3, ExF-6, and UV-1 to UV-5 were added.

Preparation of Dispersions of Organic Solid Disperse Dyes

ExF-9 in the 10th layer was dispersed by the following method.

| | |
|---|---|
| Wet cake (containing 17.6 mass % of water) of ExF-9 | 1.210 kg |
| W-11 | 0.400 kg |
| F-15 | 0.006 kg |
| Water | 8.384 kg |
| Total | 10.000 kg |

(pH was adjusted to 7.2 by NaOH)

A slurry having the above composition was coarsely dispersed by stirring by using a dissolver. The resultant material was dispersed at a peripheral speed of 10 m/s, a discharge amount of 0.6 kg/min, and a packing ratio of 0.3-mm diameter zirconia beads of 80% by using an agitator mill, thereby obtaining a solid disperse dye ExF-9. The average grain size of the fine dye grains was 0.15 μm.

The structural formulas of material used in the above-mentioned photosensitive material will be described below.

ExS-1

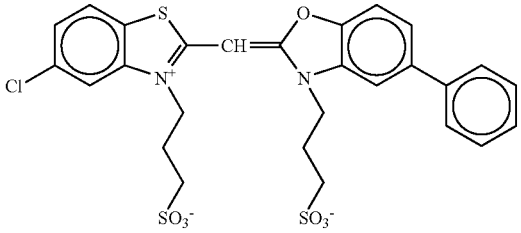

ExS-2

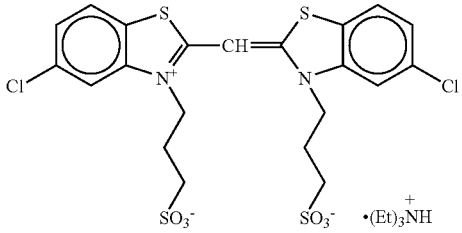

ExS-3

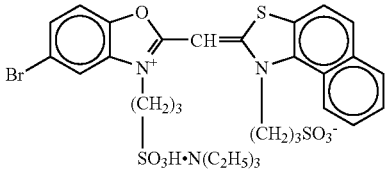

ExS-4

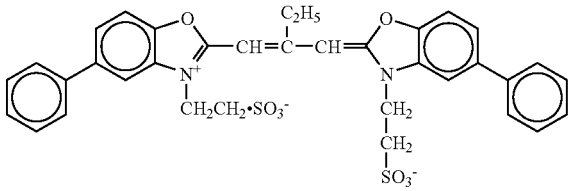

ExS-5

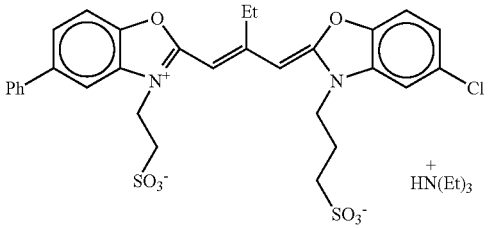

ExS-6

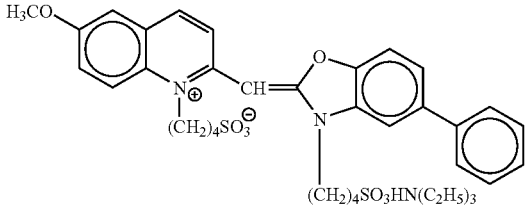

ExS-7

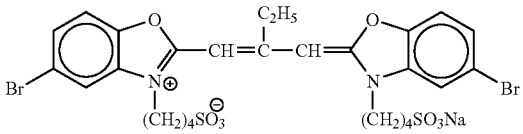

ExS-8

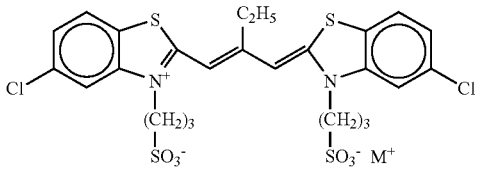

-continued
ExS-9
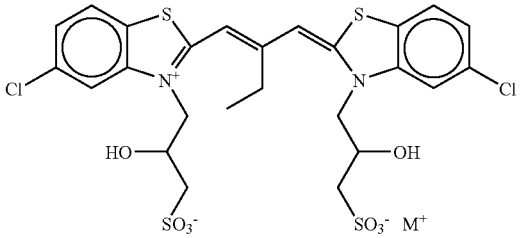
ExS-10
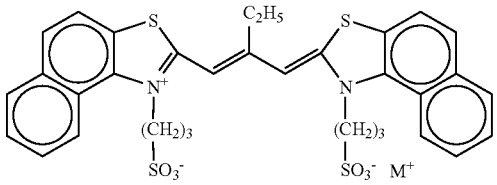
Cmpound 1
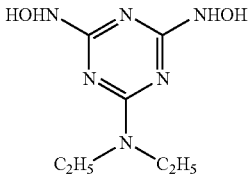
Cmpound 2
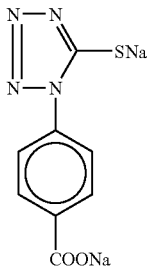
Cmpound 3
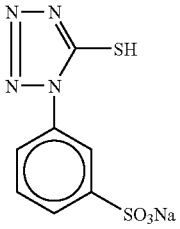
ExM-1
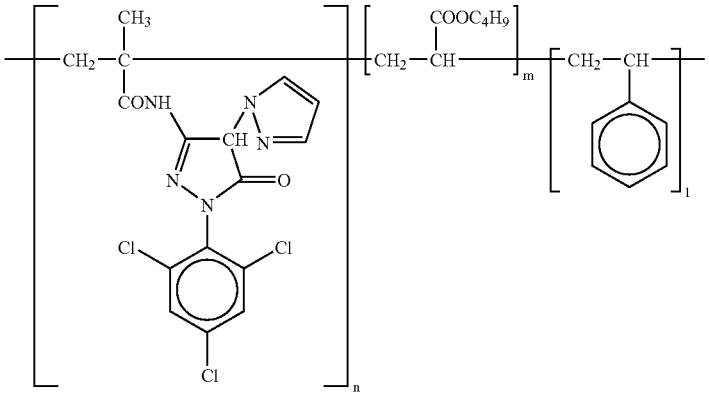
n:m:l = 2:1:1
(mass ratio)
av. mol.wt. 20,000
ExM-2
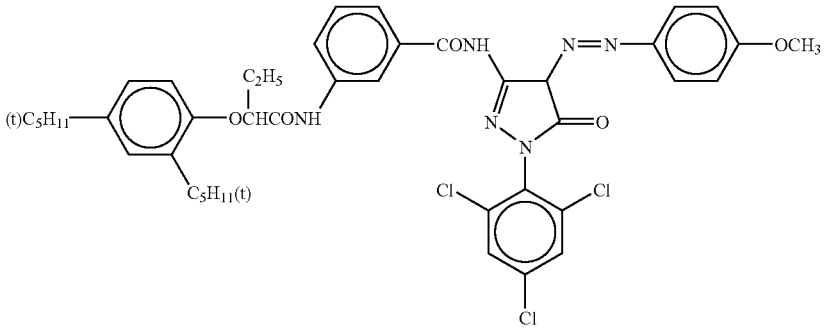

-continued
ExM-3
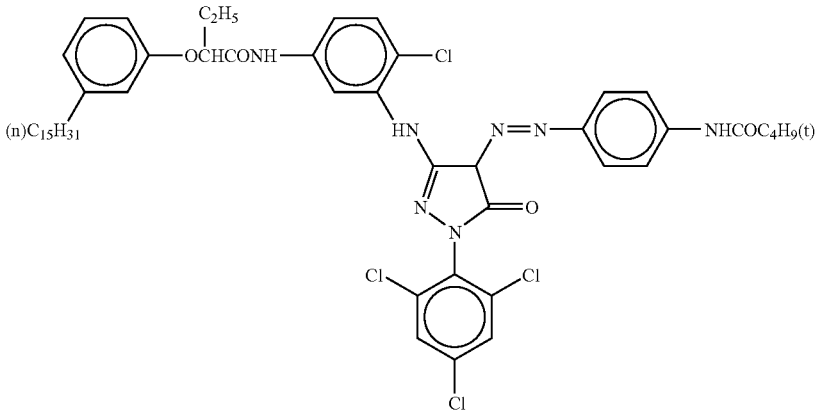
ExC-1
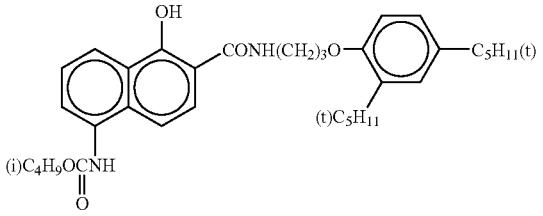
ExC-2
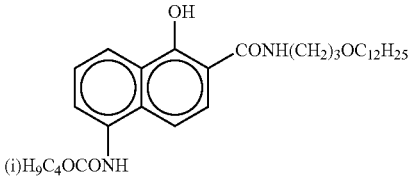
ExC-3
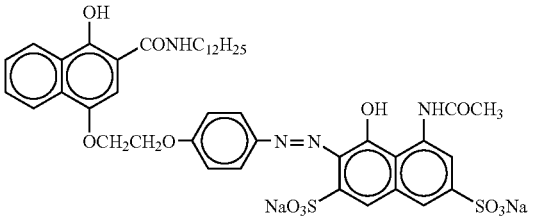
ExC-4
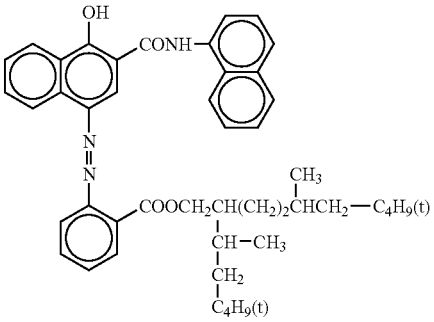
ExC-5
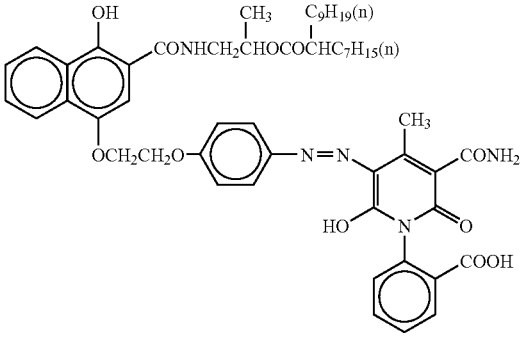

-continued
ExY-1
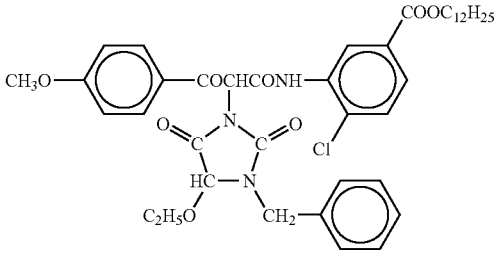
ExY-2
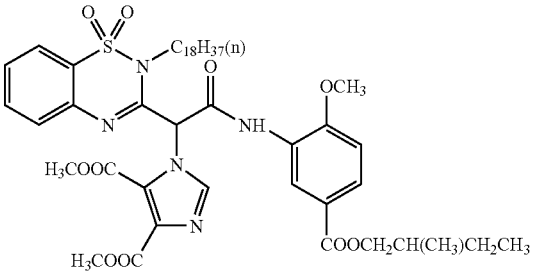
Solv-1
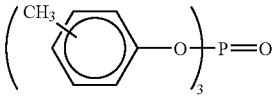
Solv-2
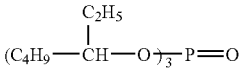
Cpd-1
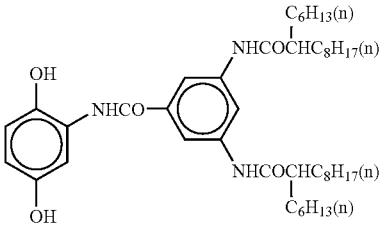
Cpd-2
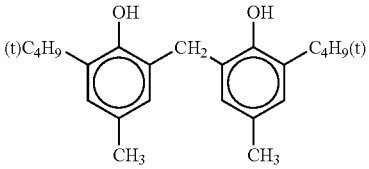
Cpd-3
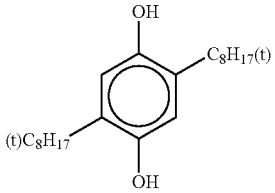
Cpd-4
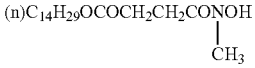
Cpd-5
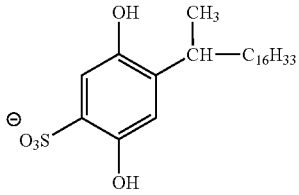
Cpd-6
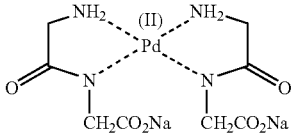
Cpd-7
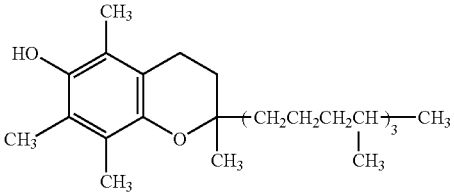
B-1
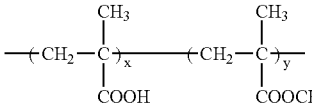
x/y = 10/90
B-2
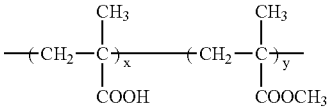
x/y = 40/60
B-3
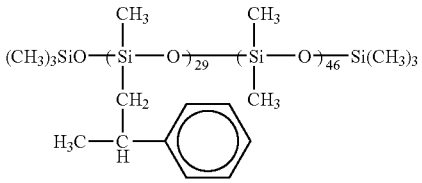
B-4
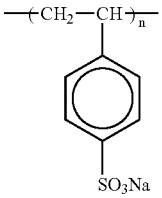

-continued
B-5
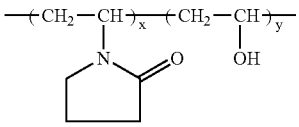
x/y = 70/30
UV-1
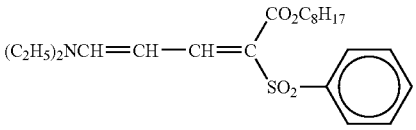
UV-2
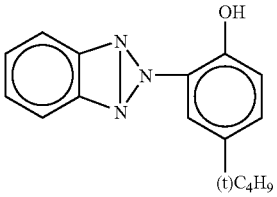
UV-3
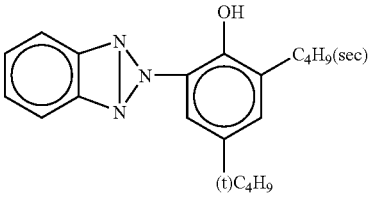
UV-4
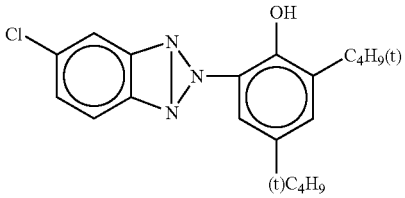
UV-5
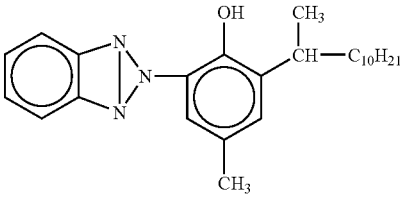
W-1
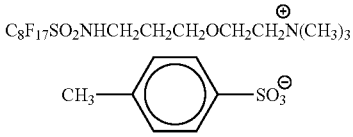
W-2
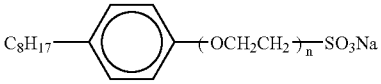
n = 2 to 4
W-3
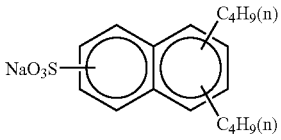
W-4
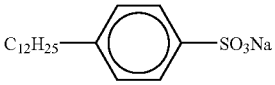
W-5
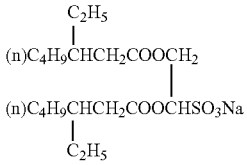
W-6
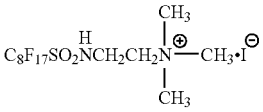
W-7
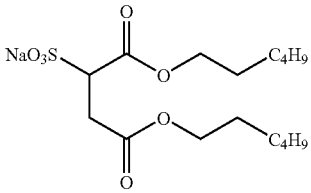
W-8
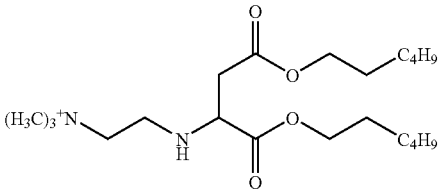
W-9
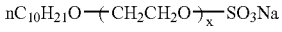
x = 1 to 3
W-10
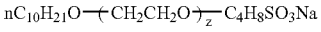
z = 1 to 3
W-11
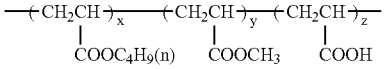
x/y/z = 20/60/20
(mass ratio)
av. mol. wt.: about 36,000
W-12
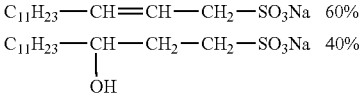
W-13
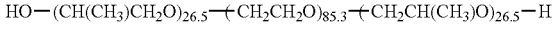

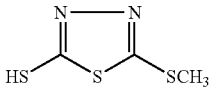
-continued
F-1
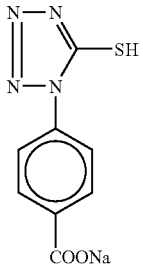
F-2
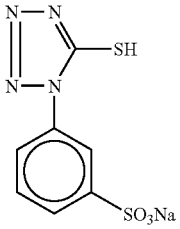
F-3
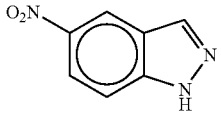
F-4
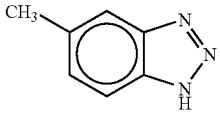
F-5
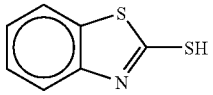
F-6
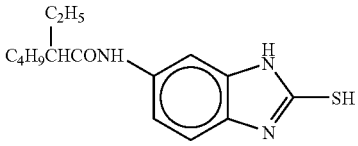
F-7
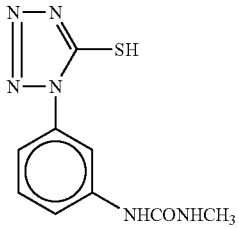
F-8
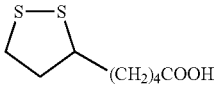
F-9
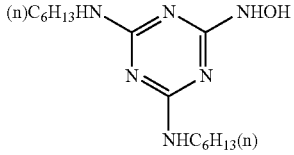
F-10
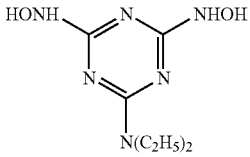
F-11
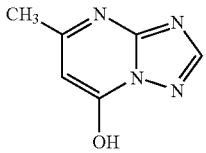
F-12
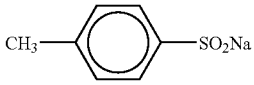
F-13
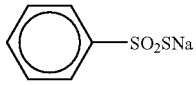
F-14
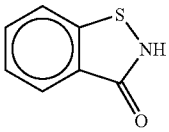
F-15
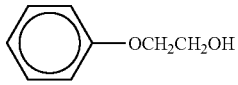
F-16
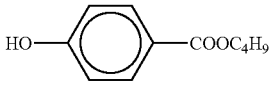
F-17
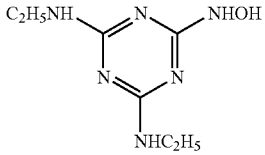
F-18

-continued
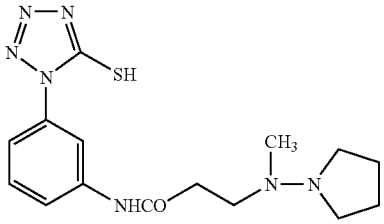
F-19
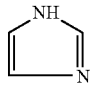
F-20
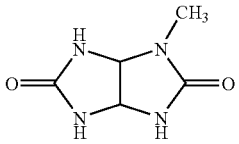
F-21
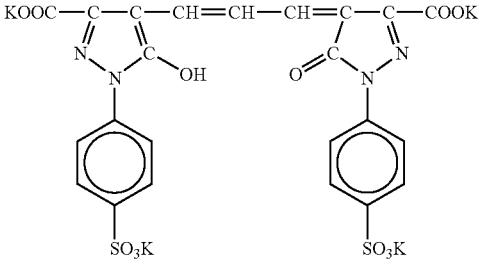
ExF-1
ExF-2
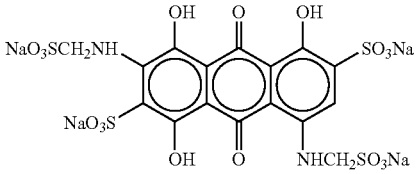
ExF-3
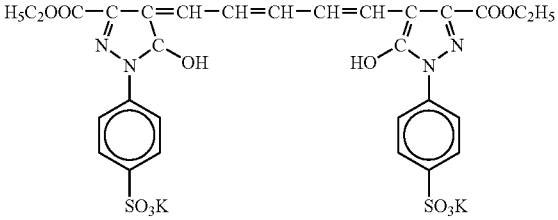
ExF-4
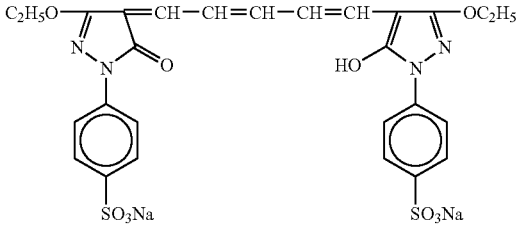
ExF-5
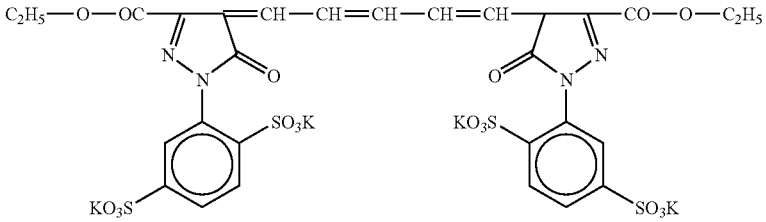
ExF-6
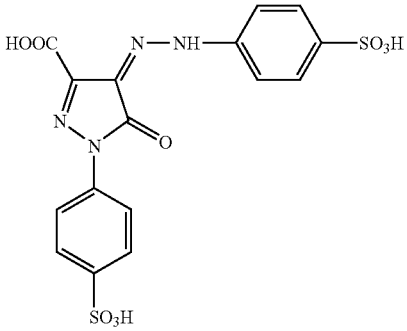

-continued

ExF-7

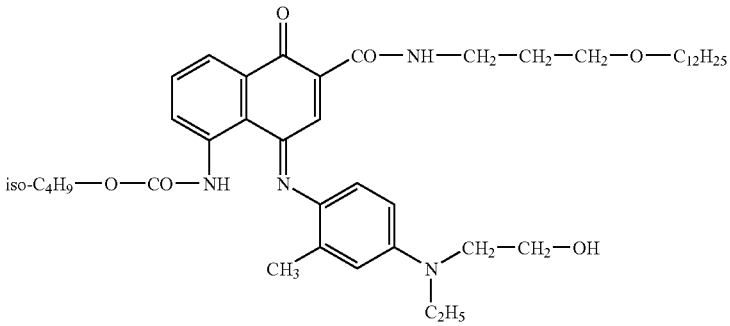

ExF-8

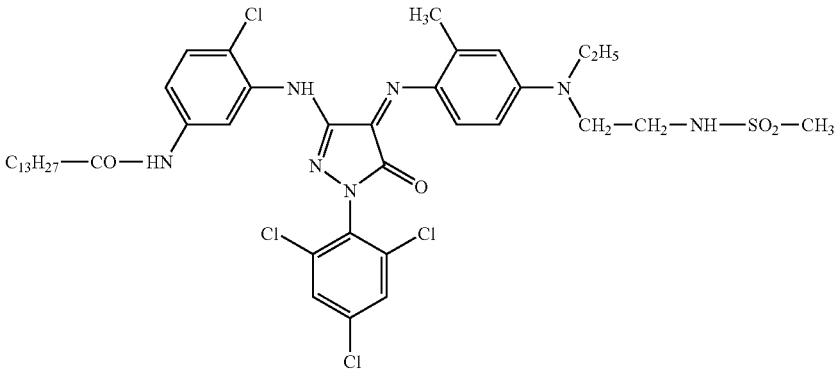

ExF-9

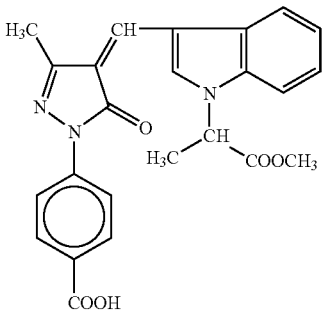

Compound 7

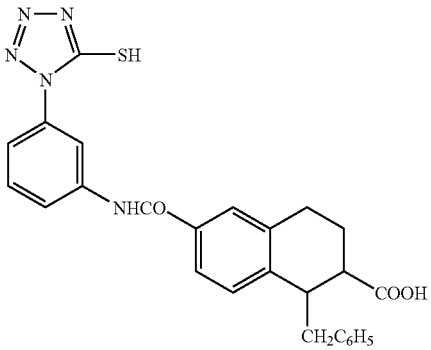

H-1

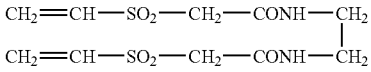

The temperature of solutions in the reaction vessel, the compositions and densities of the solutions A to E, the addition speed of the solutions B to E, pBr of the solutions in the reaction solution, the addition amounts of thiourea dioxide, sodium benzenesulfonate and $K_2IrCl_6$, the amounts of sensitization dyes after completion of desalting and chemical sensitization agent were suitably changed in the preparation of the emulsion Em-G that was used for the fifth layer of the sample 101, and Emulsions Em-1) to 3) were prepared so as to have nearly the same sensitivity as the Em-D. The result is shown in Table 2.

TABLE 2

| Emusion | Grain shape | Average Grain size*1 (μm) | Coefficient of variation(%) of ESD*2 | I content (mol %) | Cl content (mol %) | Sensitizing dye*3 |
|---|---|---|---|---|---|---|
| Em-1) | Cube | 0.33 | 14 | 3.3 | 0.5 | ExS-4 [$2.5 \times 10^{-4}$]/ExS-5 [$2.5 \times 10^{-4}$]/ ExS-6 [$2.5 \times 10^{-4}$]/ExS-7 [$2.5 \times 10^{-4}$] |
| Em-2) | Cube | 0.24 | 14 | 3.3 | 0.5 | ExS-4 [$2.5 \times 10^{-4}$]/ExS-5 [$2.5 \times 10^{-4}$]/ ExS-6 [$2.5 \times 10^{-4}$]/ExS-7 [$2.5 \times 10^{-4}$] |

TABLE 2-continued

| Emusion | Grain shape | Average Grain size*1 (μm) | Coefficient of variation(%) of ESD*2 | I content (mol %) | Cl content (mol %) | Sensitizing dye*3 |
|---|---|---|---|---|---|---|
| Em-3) | Cube | 0.11 | 13 | 3.3 | 0.5 | ExS-4 [2.5 × $10^{-4}$]/ExS-5 [2.5 × $10^{-4}$]/ ExS-6 [2.5 × $10^{-4}$]/ExS-7 [2.5 × $10^{-4}$] |

*1Average grain size is an average equivalent spherical diameter.
*2ESD: equivalent spherical diameter
*3[ ] indicates an addition amount (mol/mol Ag).

The ExM-1 of the seventh to ninth layers of the sample 101 obtained was changed to the coupler of the invention as described below, and photosensitive materials 102 and 103 were prepared.

(Sample 102)

| | | |
|---|---|---|
| 7th layer (Low-speed green-sensitive emulsion layer) | | |
| Em-F | silver coating amt. | 0.215 |
| Gelatin | | 1.690 |
| M-36 | | 0.195 |
| M-37 | | 0.097 |
| ExM-3 | | 0.102 |
| Solv-1 | | 0.499 |
| Solv-2 | | 0.052 |
| 8th layer (Medium-speed green-sensitive emulsion layer) | | |
| Em-E | silver coating amt. | 0.155 |
| Gelatin | | 0.502 |
| M-36 | | 0.054 |
| M-37 | | 0.027 |
| ExM-2 | | 0.033 |
| ExM-3 | | 0.022 |
| Solv-1 | | 0.162 |
| Solv-2 | | 0.017 |
| 9th layer (High-speed green-sensitive emulsion layer) | | |
| Em-D | silver coating amt. | 0.190 |
| Gelatin | | 0.410 |
| M-36 | | 0.040 |
| M-37 | | 0.019 |
| ExM-2 | | 0.025 |
| ExM-3 | | 0.016 |
| Solv-1 | | 0.135 |
| Solv-2 | | 0.009 |

(Sample 103)

| | | |
|---|---|---|
| 7th layer (Low-speed green-sensitive emulsion layer) | | |
| Em-F | silver coating amt. | 0.215 |
| Gelatin | | 1.690 |
| Z-1 | | 0.355 |
| ExM-3 | | 0.102 |
| Solv-1 | | 0.499 |
| Solv-2 | | 0.052 |
| 8th layer (Medium-speed green-sensitive emulsion layer) | | |
| Em-E | silver coating amt. | 0.155 |
| Gelatin | | 0.502 |
| Z-1 | | 0.098 |
| ExM-2 | | 0.033 |
| ExM-3 | | 0.022 |
| Solv-1 | | 0.162 |
| Solv-2 | | 0.017 |
| 9th layer (High-speed green-sensitive emulsion layer) | | |
| Em-D | silver coating amt. | 0.190 |
| Gelatin | | 0.410 |
| Z-1 | | 0.072 |
| ExM-2 | | 0.025 |
| ExM-3 | | 0.016 |
| Solv-1 | | 0.135 |
| Solv-2 | | 0.009 |

Samples 104 to 112 were prepared as shown in Table A by changing the emulsion Em-D used for ninth layer to the Emulsions Em-1) to 3) using the samples 101 to 103 as the basis.

(Evaluation of Blotting Value k and Color Purity)

The evaluation of the blotting and color purity was carried out by the method shown in the specification by exposing digital information of pixel account (2048×1556) at a size of 0.8×0.6 inch using B, G and R lasers followed by development. It was confirmed by the blotting values $k/(D-0.2)^2$ of B and R and Dmax % of color reproduction that the invention was realized. The result of the blotting value k and color reproduction of G and the sensorial evaluation of a landscape picture were shown in Table A.

TABLE A

| Expt No. | Sample | 9th layer Emulsion | Coupler used: 9th layer | Coupler used: 8th layer | Coupler used: 7th layer | Latent image storability: D min + 0.2 variation width | Blotting k of G k ≦ 4.5 μm × (D-0.2)$^2$: D min + 1.0 | Blotting k of G k ≦ 4.5 μm × (D-0.2)$^2$: D min + 2.0 | Color purity of G (D max) % | Sensorial evaluation: Sharpness: Neg. image | Sensorial evaluation: Sharpness: Pos. image | Sensorial evaluation: Color saturation | Remarks |
|---|---|---|---|---|---|---|---|---|---|---|---|---|---|
| 1 | 101 | Em-D | ExM-1 | ExM-1 | ExM-1 | 0.09 | 5.6 | 7.1 | 77 | 3.0 | 3.0 | 3.0 | Comp. |
| 2 | 102 | Em-D | M-36/ M-37 | M-36/ M-37 | M-36/ M-37 | 0.06 | 5.5 | 7.0 | 90 | 3.1 | 3.0 | 4.5 | Comp. |

TABLE A-continued

| Expt No. | Sample | 9th layer Emulsion | Coupler used 9th layer | 8th layer | 7th layer | Latent image storability D min + 0.2 variation width | Blotting k of G k ≦ 4.5 μm × (D-0.2)$^2$ D min + 1.0 | D min + 2.0 | Color purity of G (D max) % | Sensorial evaluation Sharpness Neg. image | Pos. image | Color saturation | Remarks |
|---|---|---|---|---|---|---|---|---|---|---|---|---|---|
| 3 | 103 | Em-D | Z-1 | Z-1 | Z-1 | 0.07 | 5.4 | 6.9 | 82 | 3.1 | 3.2 | 3.4 | Comp. |
| 4 | 104 | Em-1) | ExM-1 | ExM-1 | ExM-1 | 0.09 | 3.3 | 4.3 | 78 | 4.2 | 4.4 | 3.1 | Comp. |
| 5 | 105 | Em-1) | M-36/ M-37 | M-36/ M-37 | M-36/ M-37 | 0.04 | 3.2 | 4.2 | 91 | 4.4 | 4.5 | 5.2 | Comp. |
| 6 | 106 | Em-1) | Z-1 | Z-1 | Z-1 | 0.05 | 3.2 | 4.3 | 84 | 4.3 | 4.4 | 3.5 | Comp. |
| 7 | 107 | Em-2) | ExM-1 | ExM-1 | ExM-1 | 0.08 | 2.8 | 3.7 | 77 | 4.8 | 4.9 | 3.2 | Comp. |
| 8 | 108 | Em-2) | M-36/ M-37 | M-36/ M-37 | M-36/ M-37 | 0.03 | 2.7 | 3.6 | 91 | 4.9 | 5.0 | 5.3 | Inv. |
| 9 | 109 | Em-2) | Z-1 | Z-1 | Z-1 | 0.05 | 2.7 | 3.7 | 83 | 5.0 | 5.1 | 3.5 | Inv. |
| 10 | 110 | Em-3) | ExM-1 | ExM-1 | ExM-1 | 0.08 | 2.3 | 3.2 | 78 | 5.4 | 5.4 | 3.1 | Comp. |
| 11 | 111 | Em-3) | M-36/ M-37 | M-36/ M-37 | M-36/ M-37 | 0.03 | 2.2 | 3.0 | 92 | 5.5 | 5.6 | 5.3 | Inv. |
| 12 | 112 | Em-3) | Z-1 | Z-1 | Z-1 | 0.04 | 2.2 | 3.1 | 84 | 5.5 | 5.5 | 3.6 | Inv. |

The content of color development processing that developed the samples is as follows:

| | Processing step | Temperature (° C.) | Time |
|---|---|---|---|
| (1) | Prebath | 27 ± 1 | 10 sec |
| (2) | Removal of backing and rinsing with water by spray | 27 to 38 | 5 sec |
| (3) | Color development | 41.1 ± 0.1 | 3 minutes |
| (4) | Stoppage | 27 to 38 | 30 sec |
| (5) | Rinsing with water | 27 to 38 | 30 sec |
| (6) | Bleaching | 27 ± 1 | 3 minutes |
| (7) | Rinsing with water | 27 to 38 | 1 minute |
| (8) | Fixation | 38 ± 1 | 2 minutes |
| (9) | Rinsing with water | 27 to 38 | 2 minutes |
| (10) | Stabilization | 27 to 38 | 10 sec |

The prescription of processing solutions used at the respective processing steps is as follows:

Prescription of respective processing solutions

| | Prescription value |
|---|---|
| (1) Prebath | |
| Water at 27 to 38° C. | 800 ml |
| Borax (decahydrate salt) | 20.0 g |
| Sodium sulfate (anhydrous) | 100 g |
| Sodium hydroxide | 1.0 g |
| Water is added to | 1.00 litter |
| pH (27° C.) | 9.25 |
| (2) Color development | |
| Water at 21 to 38° C. | 850 ml |
| ANTICALCIUM No. 4 by Kodak | 2.0 ml |
| Sodium sulfite (anhydrous) | 2.0 g |
| ANTIFOG AF-2000 by Eastman | 5.0 ml |
| Sodium bromide (anhydrous) | 1.20 g |
| Sodium carbonate (anhydrous) | 25.6 g |
| Sodium bicarbonate | 2.7 g |
| Color developing agent: 4-amino-3-methyl-N-ethyl-N-(β-methanesulfonamidoethyl)-aniline | 4.0 g |
| Water is added to | 1.00 litter |
| pH (27° C.) | 10.20 |

-continued

Prescription of respective processing solutions

| | Prescription value |
|---|---|
| (3) Stoppage | |
| Water at 21 to 38° C. | 900 ml |
| 7.0 N sulfuric acid | 50 ml |
| Water is added to | 1.00 litter |
| PH (27° C.) | 0.9 |
| (4) Bleaching solution | |
| Water at 24 to 38° C. | 700 ml |
| PROXEL GXL | 0.07 ml |
| CHELATING AGENT No. 1 by Kodak | 24.2 g |
| 28% ammonium hydroxide | 30.0 ml |
| Ammonium bromide | 32.5 g |
| Glacial acetic acid | 10.0 ml |
| Ferric nitrate (nonahydrate salt) | 28.8 g |
| Water is added to | 1.00 litter |
| PH (27° C.) | 5.0 ± 0.2 |
| (5) Fixation | |
| Water at 20 to 38° C. | 700 ml |
| ANTICALCIUM No. 4 by Kodak | 2.0 ml |
| 58% ammonium thiosulfate solution | 185 ml |
| Sodium sulfite (anhydrous) | 10.0 g |
| Sodium bisulfite (anhydrous) | 8.4 g |
| Water is added to | 1.0 litter |
| pH (27° C.) | 6.5 |
| (6) Stabilization | |
| Water at 21 to 27° C. | 1.00 litter |
| STABILIZER ADDITIVE by Kodak | 0.14 ml |
| Formalin (37.5% solution) | 1.5 ml |

(Sensorial Evaluation)

The Sensorial evaluation of the image quality of the samples 101 to 112 was carried out by the following method.

A landscape image having digital information of pixel account (2048×1556) was exposed to the samples 101 to 112 at a size of 0.8×0.6 inch by B, G and R lasers and negative images obtained were projected and appreciated by 20 surveyors. Evaluation was carried out by a method of relatively evaluating the images, referring to an evaluation value of 3 (standard) at the time of using the sample 101. Further, after exposure was carried out to a Fuji Color positive film F-CP using the negative image, development processing was carried out by the method described in the item of "Fuji Color, Processing of positive film" in FUJIFILM PROCESSING MANUAL Motion Picture Films, to obtain positive images. These images were projected and similarly evaluated.

Sharpness with respect to the negative images and sharpness and color saturation with respect to the positive images were evaluated at the below-mentioned seven stages and the average of the evaluation values of the 20 surveyors was calculated. The result is shown in Table A.

0: Very inferior

1: Inferior

2: Slightly inferior

3: (Standard)

4: Slightly superior

5: Superior

6: Very superior (Evaluation of Latent Image Storability)

Gray sensitometry exposure was carried out using red, green and blue lasers, the image was stored under the conditions of 30° C. and 70% for 1 hour and 20 hours and then, magenta density was measured. For the magenta density, the density of Dmin+0.20 was measured and a variation width between 1 hour and 20 hours was shown in Table A.

It is found from Table A that projection image superior in sharpness and color saturation is obtained by adopting the image recording method of the invention, using the coupler of the invention and setting the particle size of the silver halide emulsion in the ninth layer as the range of the invention, and the silver halide photosensitive material with little change of latent image storability is obtained.

What is claimed is:

1. A silver halide photosensitive material having at least one blue-sensitive layer, at least one green-sensitive layer, and at least one red-sensitive layer, on a transparent support, wherein at least one of the green-sensitive layers contains a coupler represented by general formula (I) or general formula (Z), and all of the green-sensitive layers contain a silver halide emulsion comprising silver halide grains having an average equivalent-spherical diameter of 0.24 μm or less:

General formula (I)

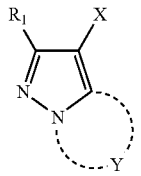

wherein $R_1$ represents a hydrogen atom or a substituent; Y represents a nonmetal atom group containing 1 or 2 nitrogen atoms and necessary for forming a 5-membered azole ring containing 2 or 3 nitrogen atoms, and the azoic ring may optionally have a substituent (including a condensed ring); X represents a hydrogen atom or a group capable of being eliminated at the time of coupling reaction with an oxidant of a developing agent;

General formula (Z)

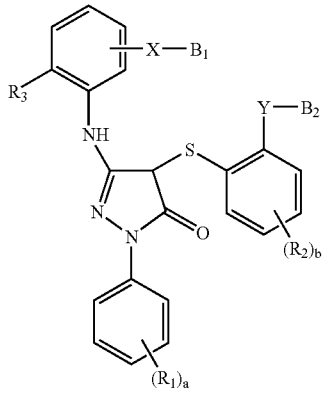

wherein a represents an integer of 0 to 3; b represents an integer of 0 to 2; each of $R_1$ and $R_2$ is independently hydrogen, an alkyl group, an alkoxy group, a halogen group, an aryl group, an aryloxy group, an acylamino group, a sulfonamide group, a sulfamoyl group, a carbamoyl group, an arylsulfonyl group, an aryloxycarbonyl group, an alkoxycarbonyl group, an alkoxysulfonyl group, an aryloxysulfonyl group, an alkylureido group, an arylureido group, a nitro group, a cyano group, a hydroxyl group or a carboxyl group; $R_3$ is a halogen atom, an alkyl group or an aryl group; X and Y are a direct bond or a bonding group; and $B_1$ and $B_2$ are a stabilizing group that does not diffuse the coupler.

2. The silver halide photosensitive material according to claim 1, wherein digital image information can be recorded with little deterioration at the time of image formation in which the digital image information is recorded at a resolution of 2000 dpi or more.

3. The silver halide photosensitive material according to claim 1, wherein digital image information with 3 million or more pixels can be recorded with little deterioration.

4. The silver halide photosensitive material according to claim 1, wherein blotting k of the image at the time of image recording satisfies formula (A):

$$k \leqq 4.5\ \mu m \times (D-0.2)^2 \quad (A)$$

in formula (A);

D: Color density of the silver halide photosensitive material,

Blotting k: blotting (μm) at color density D.

5. The silver halide photosensitive material according to claim 1, wherein color purity rate is 80% or more in the color reproduction at the time of image recording.

6. An image-forming method, wherein digital image information recorded in the silver halide photosensitive material according to claim 1 is further recorded on the silver halide photosensitive material by an analog system.

7. The silver halide photosensitive material according to claim 1, all of the green-sensitive layers contain a silver halide emulsion comprising silver halide grains having an average equivalent-spherical diameter of 0.11 μm or less.

8. The silver halide photosensitive material according to claim 1, all of the green-sensitive layers contain a silver halide emulsion comprising silver halide grains having an average equivalent-spherical diameter of 0.02 μm or more and 0.24 μm or less.

9. The silver halide photosensitive material according to claim 1, all of the green-sensitive layers contain a silver halide emulsion comprising silver halide grains having an average equivalent-spherical diameter of 0.02 μm or more and 0.11 μm or less.

* * * * *